US006002078A

United States Patent [19]

Yoshinaga et al.

[11] Patent Number: 6,002,078

[45] **Date of Patent: *Dec. 14, 1999**

[54] KEYBOARD ASSEMBLY FOR ELECTRONIC MUSICAL INSTRUMENT

[75] Inventors: Kenichi Yoshinaga; Junichi Mishima, both of Hamamatsu, Japan

[73] Assignee: Yamaha Corporation, Hamamatsu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/903,261

[22] Filed: Jul. 25, 1997

Related U.S. Application Data

[63] Continuation of application No. 08/103,183, Aug. 5, 1993, abandoned.

[30] Foreign Application Priority Data

| | | | |
|---|---|---|---|
| Aug. 10, 1992 | [JP] | Japan | UM4-056094 U |
| Aug. 10, 1992 | [JP] | Japan | 4-213076 |
| Nov. 6, 1992 | [JP] | Japan | 4-297059 |
| Dec. 24, 1992 | [JP] | Japan | 4-344942 |
| Dec. 25, 1992 | [JP] | Japan | UM4-088890 U |
| Dec. 28, 1992 | [JP] | Japan | 4-348121 |
| May 6, 1993 | [JP] | Japan | 5-104868 |

[51] Int. Cl.[6] ..... G10C 3/12

[52] U.S. Cl. ..... 84/436; 84/423 R; 84/430; 84/433

[58] Field of Search ..... 84/423 R, 430, 84/433, 436, 441, DIG. 7, 719, 720

[56] References Cited

U.S. PATENT DOCUMENTS

| | | | |
|---|---|---|---|
| 3,797,357 | 3/1974 | Thomas et al. | 84/423 |
| 4,128,035 | 12/1978 | Ericson et al. | 84/433 |
| 4,775,574 | 10/1988 | Fukushima et al. | 428/209 |
| 4,914,999 | 4/1990 | Masubuchi et al. | 84/423 R |

FOREIGN PATENT DOCUMENTS

| | | | |
|---|---|---|---|
| 58-15943 | 7/1956 | Japan . | |
| 48-43367 | 12/1973 | Japan | G10C 3/12 |
| 58-88295 | 6/1983 | Japan | G10H 1/34 |
| 60-54185 | 4/1985 | Japan | G10B 2/13 |
| 61-198997 | 12/1986 | Japan . | |
| 63-178031 | 11/1988 | Japan . | |
| 3-100894 | 10/1991 | Japan . | |
| 3-105894 | 11/1991 | Japan . | |
| 3-110491 | 11/1991 | Japan . | |
| 4-61396 | 5/1992 | Japan . | |
| 4-166995 | 6/1992 | Japan . | |
| 4-75392 | 7/1992 | Japan | G10B 3/12 |

*Primary Examiner*—William M. Shoop, Jr.
*Assistant Examiner*—Kim Lockett
*Attorney, Agent, or Firm*—Graham & James LLP

[57] ABSTRACT

An keyboard assembly for an electronic musical instrument is mainly constructed by a key frame, a key, a key switch and an assembly guide member. A fixing portion of the key is supported by the key frame such that a front portion of the key can be freely rotated up and down. An actuator is attached to and projected downward from a lower side of the key. The key switch (or a key-depression sensor) has an elastic projecting portion at its upper end. This key switch is provided on the key frame and is driven by the actuator, which depresses down the elastic projecting portion of the key switch when the key is depressed down. The assembly guide member guides the key when the key is moved in an assembling direction (i.e., a longitudinal direction of the key) in order to carry out an assembling operation to assemble the key and the key frame together. Herein, the key is guided by the assembly guide member in such a manner that the actuator does not come in contact with the key switch during the assembling operation. Thus, the key switch is not damaged at all by the actuator during the assembling operation of the keyboard.

15 Claims, 31 Drawing Sheets

KEYBOARD ASSEMBLY FOR ELECTRONIC MUSICAL INSTRUMENT

This is a continuation of copending application Ser. No. 08/103,183 filed on Aug. 5, 1993.

BACKGROUND OF THE INVENTION

1. Field of the Invention

The present invention relates to a keyboard assembly for use in electronic musical instruments such as an electronic piano.

2. Prior Art

According to a general construction of the conventional keyboard assembly employed in the electronic musical instrument, a plurality of keys, key switches, key stoppers, key guides and the like are supported by key frames which are fixed to a main body of the instrument. Each of the keys is supported by the key frame such that it can freely rotate about a predetermined fulcrum point. On the key frame, one key switch is provided in connection with the key. When each key is depressed down, the corresponding key switch is driven so that a key-on signal is produced.

FIG. 1 shows cross-sectional views illustrating a mechanical construction of the keyboard assembly. At a front edge portion of a key frame 8, there is provided a key guide 11 which functions to avoid a lateral swinging movement or a twisting movement of the key to be occurred when the key is depressed. The key frame 8 is made by use of a metal plate having a rectangular shape. The tip edge portion of the key frame 8 is bent, and then, a resin mold is formed to cover the bent portion of the key frame, so that the key guide 11 will be eventually formed. Or, the bent shape of the key frame is made by the resin, and then, a bent portion of the key frame which comes in contact with the key is covered by a flexible resin, so that the key guide 11 will be eventually formed as one part of the key frame. A key switch 10 is mounted on a circuit board 81 so as to form a switch-circuit assembly. This switch-circuit assembly is securely fixed to the key frame 8 by a screw 82. The key switch 10 contains a projecting member made of an elastic material such as rubber. When the key is depressed down, an actuator 6 which is attached to a lower surface of a key 1 presses down the projecting member of the key switch 10 so that the projecting member will be deformed. Thus, internal contacts (not shown) of the key switch 10 come in contact with each other so that the key switch 10 is turned on.

A guided member 4 is formed as a part of the key 1 such that the guided member 4 projects from an lower surface of the key 1. When the key 1 is depressed down, the guided member 4 is slid down by being guided by the key guide 11 of the key frame 8. A stopper element 5 is formed as a part of the guided member 4. When the key 1 is returned from a depressed position, the stopper element 5 comes in contact with the key guide 11 so that an upper-limit stopper will be emerged for the key 1. Incidentally, a numeral 3 designates a black key. The key 1 (i.e., white key) provides a projection 7 which projects downward from a common base-edge portion 2. This common base-edge portion is provided at back edge portions of the keys. This projection 7 is inserted into a hole 9 which is formed at a predetermined back-edge portion of the key frame 8, and then, the key 1 is fixed with the key frame 8 by a screw 83.

When assembling the key 1 and key frame 8 together, the projection 7 of the key 1 is temporarily mounted on the key frame 8; and then, the key 1 is slid on the key frame 8 in a horizontal direction so that the guided member 4 is engaged with the key guide 11; thereafter, the projection 7 is inserted into the hole 9. As described above, the key 1 should be slid on the key frame 8 in the horizontal direction because of the shape of the guided member 4. In other words, the stopper element 5 is horizontally extended from the guided member 4 in a backward direction (i.e., a left-side direction of FIG. 1), so that in order to engage the guided member 4, having a letter-L-like shape, with the key guide 11, the key should be horizontally moved in a backward direction just before the keyboard apparatus is assembled together.

When assembling the conventional keyboard apparatus, a certain lower-surface portion of the key 1 and the actuator 6 are moved in a horizontal direction with respect to the key switch 10 projected from the key frame 8 while being in contact with each other, and then, they are fixed together. Due to such fixing manner, the key switch 10 is sometimes deformed in a horizontal direction. If the key 1 and the key frame 8 are fixed together in such manner, the key switch 10 cannot operate well, which causes a problem in the function of the key switch 10 may not be completely carried out. In order to the aforementioned deformation which is caused by the force to be effected in a horizontal direction when fixing the key 1 and the key frame 8 together, the conventional technology provides some countermeasures by which the thickness of the rubber wall of the key switch 10 is enlarged or the hardness of the rubber is increased. Or, in order to do so, it is necessary to fix the key switch 10 to the key frame 8 by a harder strength. Another countermeasure is disclosed in U.S. Pat. No. 4,914,999 in which the key is vertically moved down to the key frame, and then, the key is inserted to be attached to the key frame. In order to do so, a special-designed valve-like structure is provided for the key frame, key switch and circuit board such that the stopper element 5 can be smoothly moved downward along the key guide 11 when fixing the key and the key frame together.

However, if the thickness of the rubber wall of the key switch 10 is enlarged or the rubber used for the key switch 10 is made harder as described above, a key-depression sensitivity should be deteriorated. In order to intensely fix the key switch with the key frame, a number of fixing members or a number of steps for fixing the key switch with the key frame should be increased. Further, the workers should pay a great attention to the fixing operation such that components of the key do not touch with the key switch when fixing the key and the key frame together. Such complicated fixing operation requires much working hours, or much manual skill is required for the workers.

In the aforementioned technique disclosed by the U.S. patent, the construction of the key unit and the key-frame unit should be complicated, and a complicated process is required when forming the key frame. In addition, the stopper element should be passed through a valve-like portion when fixing the key with the key frame. Such operation is required for each of the keys. Thus, the disclosed technique suffers from its complication.

SUMMARY OF THE INVENTION

It is accordingly a primary object of the present invention to provide a keyboard assembly, employed for the electronic musical instrument, in which the key switch can be prevented from being deformed by an external force to be applied thereto when assembling the key with the key frame.

According to a fundamental construction of the keyboard assembly as defined by the present invention, there are provided a key, a key frame, a key-depression sensor, an actuator and a key guide. A fixing portion of the key is supported by the key frame such that a front portion of the key can be freely rotated up and down. The actuator is attached to a lower side of the key, while the key-depression sensor is attached on the key frame. When the key is depressed down, the actuator drives the key-depression sensor so that a key-depression event is sensed. The key-depression sensor can be designed as a key switch having a projecting portion made of an elastic material. Thus, when the key is depressed down, the actuator depresses and partially deforms the projecting portion of the key switch, so that the key switch is turned on.

When the key is assembled together with the key frame, the key is guided by the key guide such that the actuator does not directly come in contact with the key switch while the key is moved in a longitudinal direction of key. Thus, it is possible to prevent the external force from being applied to the key switch during the assembling operation by which the key and the key frame are assembled together.

BRIEF DESCRIPTION OF THE DRAWINGS

Further objects and advantages of the present invention will be apparent from the following description, reference being had to the accompanying drawings wherein the preferred embodiments of the present invention are clearly shown.

In the drawings.

DESCRIPTION OF THE PREFERRED EMBODIMENTS

Figure 1:
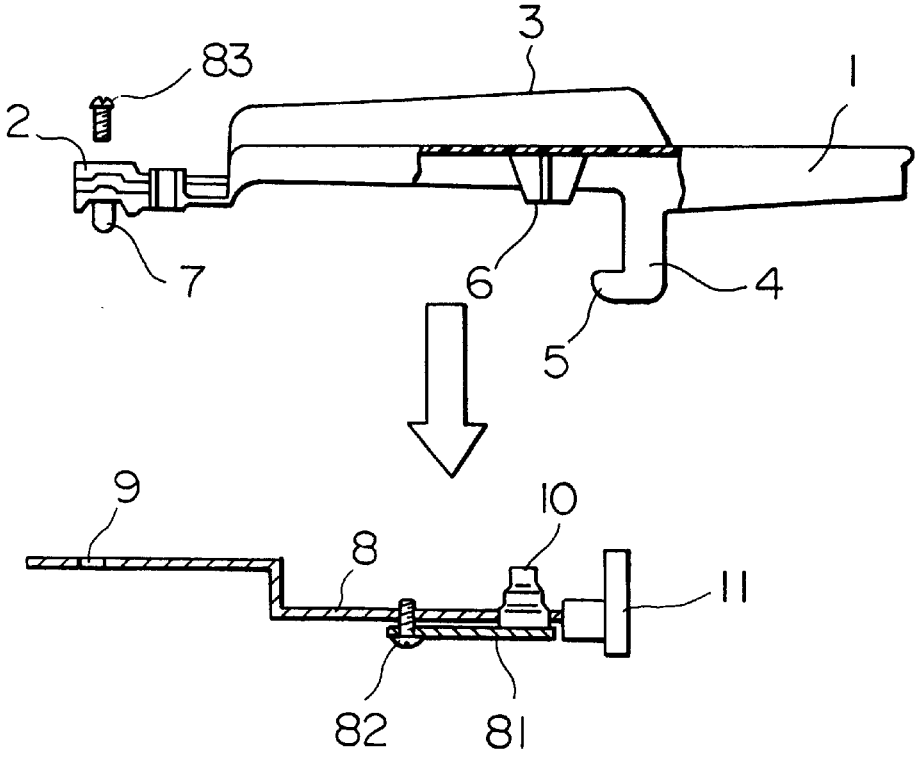
FIG. 1 (PRIOR ART)
FIG. 1 is an assembly drawing illustrating an assembling operation to be effected between a key unit and a key-frame unit in the conventional keyboard assembly.

Now, the preferred embodiments of the present invention will be described below by referring to the drawings, among which the same parts will be designated by the same numerals.

[A] First Embodiment

Figure 2:
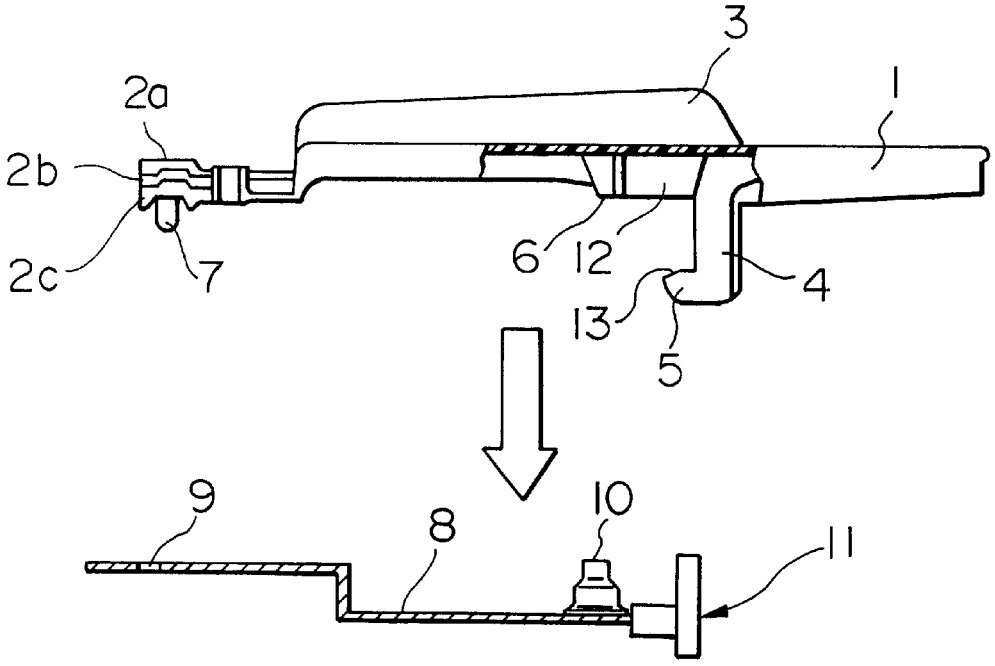
FIG. 2 is an assembly drawing illustrating an assembling operation to be effected between a key unit and a key-frame unit in a keyboard assembly according to a first embodiment of the present invention.

FIG. 2 is an assembly drawing illustrating a cross-sectional view of the key unit and another cross-sectional view of the key-frame unit which are assembled together. All of the keys used in the present keyboard apparatus is classified into three groups, hence, three blocks are provided for three groups of the keys respectively. A first block corresponds to a plurality of black keys which are disposed on the keyboard in parallel, wherein five black keys are provided for one octave. A second block corresponds to a group of white keys each corresponding to every other one of the white keys to be selected from a line of white keys. A third block corresponds to another group of white keys which are not selected for the second block. These three blocks are assembled together by combining three common base-edge portions 2*a*, 2*b* and 2*c* together. The white key 1 provides a projection 7 which is projected downward from the lower surface of the common base-edge portion 2*c*. This common base-edge portion 2*c* is provided at the back-edge portion of the key 1. This projection 7 is inserted through the hole 9 of the key frame 8, so that the key unit and the key-frame unit are assembled together. A key guide 11 is provided at the front-edge portion of the key frame 8 in order to avoid the lateral swinging movement or twisting movement of the key 1 which is occurred when the key 1 is depressed down. When forming the key guide 11, the tip edge portion of the key frame 8, made of the metal plate having a rectangular shape, is bent; and then, the bent portion is covered by the resin-mold material. Or, the key frame 8 having a bent shape is formed by the resin material, and then, a key-contact portion thereof is only coated by the flexible resin material so as to form the key guide 11. On the key frame 8, the key switch 10 is provided for each of the keys. As described before, the key switch 10 contains a projecting portion made of the elastic material such as the rubber. This projecting portion is deformed by being pressed by the actuator 6 when the key is depressed. Herein, a movable contact is attached at an interior wall of the projecting portion, while a fixed contact is provided in the key switch 10 at a position facing with the movable contact. Thus, when the key is depressed, the movable contact comes in contact with the fixed contact so that a key-on state is sensed. On a printed circuit board which is attached to the lower surface of the key frame 8, the above-mentioned projecting portion is mounted. Therefore, a tip edge portion of the projecting portion is projected upward from a through hole provided in the key frame 8.

The guided member 4 is provided as one part of the key 1. This guided member 4 is slid up and down while being guided by the key guide 11 of the key frame 8. The stopper element 5, which functions as the upper-limit stopper for the key 1, is provided as the lower edge portion of the guided member 4. This stopper element 5 comes in contact with the key guide 11 when the depressed key is returned to its original position. Incidentally, a numeral 3 designates a black key.

Figure 3A:
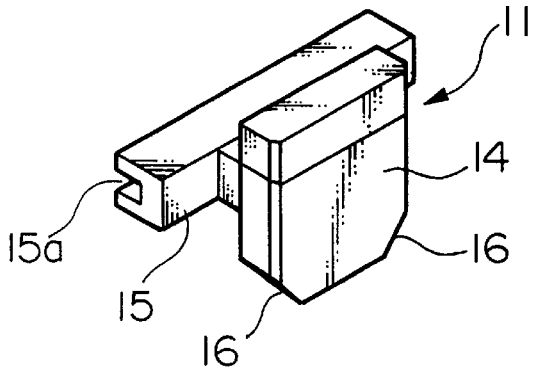
FIG. 3(A) is a perspective-side view illustrating a detailed construction of a key guide.

FIG. 3(A) shows an example of the detailed construction of the key guide 11. The key guide 11 is mainly constructed by a guide member 14 and a stopper member 15. Both of side portions of the guide member 14 are formed as guide surfaces, by which the key can be moved up and down while being guided by the guide surfaces. The stopper member 15 can be formed as one large frame which is provided for a plurality of keys disposed in parallel. Further, the key guide 11 can be formed, independent of the key frame 8. In this case, after the key guide 11 is formed, the key guide 11 is attached to the key frame by inserting the tip edge portion of the key frame into a channel 15*a* which is formed in the stopper member 15 in its longitudinal direction. At both of lower edge portions of the guide member 14, there are formed inclined faces 16, by which the guided member 4 can be smoothly guided by the guide member 14 or the guided member 4 can be smoothly assembled together with the key guide 11.

Figure 3B:
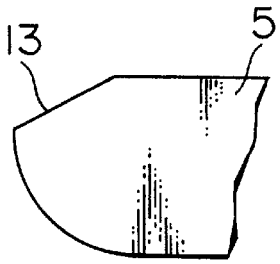
FIG. 3(B) shows a shape of a stopper element.

The guide member 14 of the key guide 11 is sandwiched by the guided members 4 of the key 1. A taper 13 as shown in FIG. 3(B) is formed at the tip edge portion of the stopper element 5 which is formed as the lower edge portion of the guided member 4. This taper 13 helps the stopper element 5 to be smoothly attached with the guide member 14. When assembling the key unit and the key-frame unit together, the stopper element 5 is pressed toward the guide member 14.

Figure 4A:
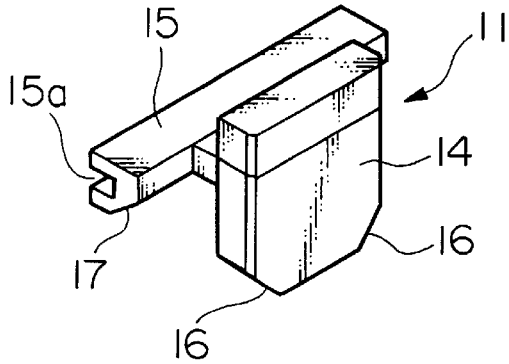
FIG. 4(A) shows another example of the key guide.
Figure 4B:
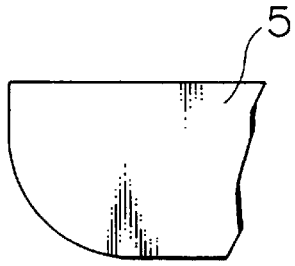
FIG. 4(B) shows another example of the stopper element.

FIG. 4(A) shows another example of the key guide 11. In this example, a taper 17 is formed along a lower edge portion of the stopper member 15. As shown in FIG. 4(B), the stopper element 5 of the guided member 4 does not provide the taper 13 (see FIG. 3(B)). However, by further providing the taper 13 to the stopper element 5, it is possible to make the assembling operation further smoothly. In other words, by attaching the taper 17 to the stopper element 5, it is possible to smoothly perform the assembling operation in which the stopper element 5 is pressed into the stopper member 15.

Figure 5A:
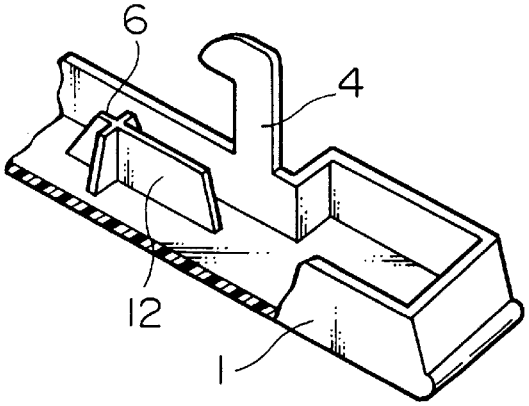
FIG. 5(A) is a perspective-side view illustrating a detailed construction of an assembly guide element.
Figure 5B:
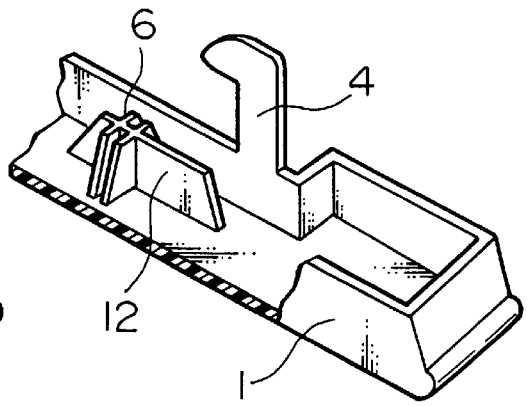
FIG. 5(B) shows another example of the assembly guide element.

In the meantime, an assembly guide element 12 is formed to be extended from a rib of the actuator 6 which projects downward from an interior wall of the key 1 as shown in FIG. 5(A). FIGS. 5(A) and 5(B) are perspective-side views each showing a detailed construction of the assembly guide element 12. Incidentally, each of these drawings shows an essential part of the inside portion of the key 1 which is reversely illustrated. FIG. 5(A) shows an example wherein one rib directing the lateral direction is provided for the actuator 6, while FIG. 5(B) shows another example wherein two ribs are provided for the actuator 6. In each of these examples, the assembly guide element 12 extends from the rib in a longitudinal direction. The assembly guide element 12 is located at the position at which the assembly guide element 12 comes in contact with the upper edge portion of the key guide 11 of the key frame 8 when assembling the key unit and the key-frame unit together. Such assembly guide element 12 does not have a function as the actuator to press the key switch 10. In short, this assembly guide element 12 merely has a function to guide the members when performing the assembling operation.

Figure 6A:
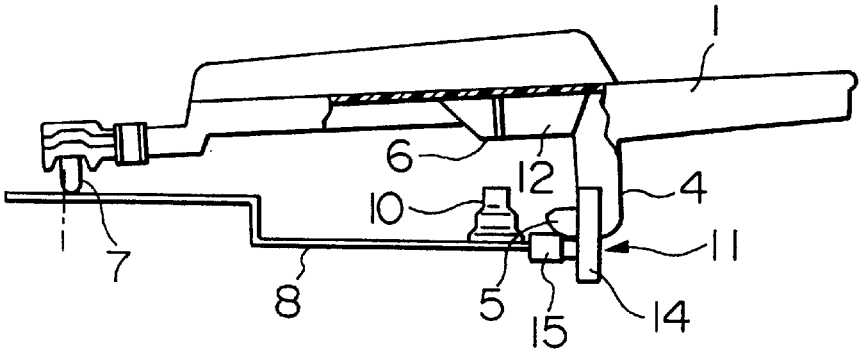
FIGS. 6(A) through 6(D) show steps for an assembling process for assembling the keyboard assembly according to the first embodiment of the present invention.

FIGS. 6(A) to 6(D) show respective steps for the assembling process of the keyboard apparatus. At first, as shown in FIG. 6(A), the projection 7 of the key 1 is mounted at a position in the vicinity of the hole of the key frame 8 (see a dashed-line point). At this time, the stopper element 5 of the guided member 4 is located above the stopper member 15 of the key guide 11.

Figure 6B:
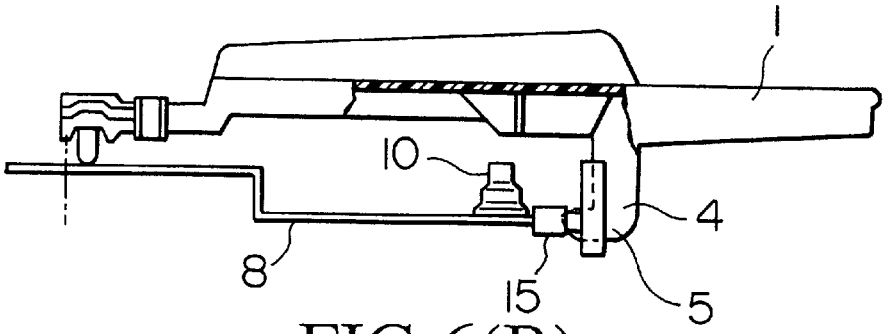

Then, as shown in FIG. 6(B), the key 1 is depressed down by being rotated about the projection 7 which functions as the fulcrum point. At this time, the tip edge portion of the stopper element 5 is slightly moved in a front direction (i.e., right-side direction of the drawing) as compared to the former position of the stopper element 5 shown in FIG. 6(A). Then, the tip edge portion of the stopper element 5 is slid down along a front face of the stopper member 15 of the key guide 11.

Figure 6C:
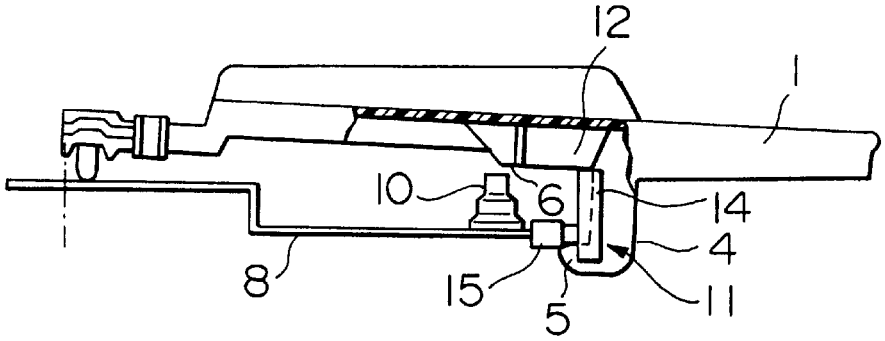

By further elevating down the key 1, the upper face of the stopper element 5 eventually reaches to face with the lower face of the stopper member 15 as shown in FIG. 6(C). At this time, the lower face of the assembly guide element 12 comes in contact with the summit portion of the guide member 14 of the key guide 11. In addition, the actuator 6 is located above and apart from the upper face of the key switch 10. Therefore, at this stage, the actuator 6 does not at all come in contact with the key switch 10.

Figure 6D:
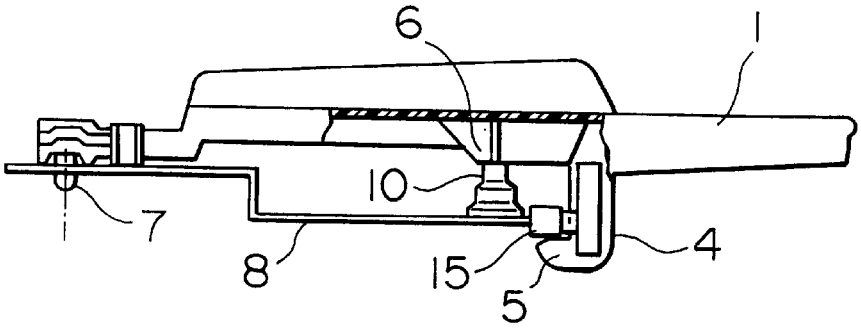

Under the state where the assembly guide element 12 is in contact with the summit portion of the guide element 14 of the key guide 11, the key 1 is slightly shifted in a backward direction (i.e., a left-side direction of the drawing). Therefore, as shown in FIG. 6(D), the projection 7 is eventually inserted into the hole of the key frame 8. Thus, the assembling operation is completed. At this time, the stopper element 5 of the guided member 4 is set at a certain position which comes in contact with the lower face of the stopper member 15. This position is defined as an upper limit at which an elevating motion of the key 1 is limited when the key 1 is returned from a key-depressed position. Both of the stopper member 15 and the stopper element 5 form an upper-limit stopper for the key 1. At this state where the assembly guide element 12 is located above and apart from the guide member 14 of the key guide 11, so that the assembly guide element 12 does not interfere with the down motion of the key 1 which is depressed down. When the key 1 is depressed down, the actuator 6 presses and deforms the key switch 10 so that the key switch 10 is driven.

Figure 7A:
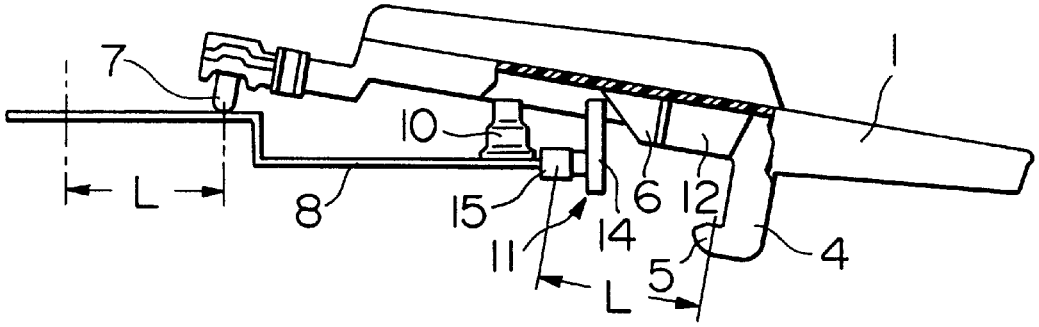
FIGS. 7(A) and 7(B) show another example of the steps for the assembling process of the keyboard assembly.
Figure 7B:
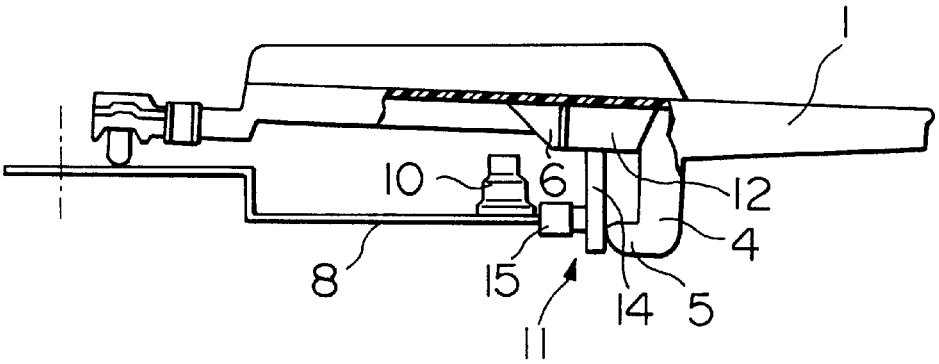

FIGS. 7(A) and 7(B) show another assembling process for the keyboard apparatus. The projection 7 of the key 1 is mounted at a certain position of the key frame 8 which departs from the position of the hole (see dashed-line point) by a distance "L" as shown in FIG. 7(A). At this state, the key 1 is moved backward (i.e., a left-side position of the drawing) while the lower surface thereof is slid in contact with the summit portion of the guide member 14. In a state as shown in FIG. 7(A) where the summit portion of the guide member 14 reaches a root portion of the rib of the actuator 6 which extends in a longitudinal direction of the key 1, the aforementioned distance "L" between the projection 7 and the hole becomes equal to the distance between the stopper element 5 of the guided member 4 and the stopper member 15 which will be in contact with the stopper element 5. In short, after the guide member 14 comes in contact with the rib of the actuator 6, the key 1 is moved in a horizontal direction by the distance L while being slid on the key frame 8.

From the state as shown in FIG. 7(A), the key 1 is further moved in a left-side direction while the summit portion of the guide member 14 is slid along the rib of the actuator 6. Thus, the key 1 is moved leftward while being raised up. Then, the summit portion of the guide member 14 reaches the summit portion of the rib. Further, as shown in FIG. 7(B), the summit portion of the guide member 14 eventually reaches the position of the assembly guide element 12.

If the key 1 is further moved in a left-side direction, the foregoing state shown in FIG. 6(C) is obtained. Then, the key 1 is finally fixed with the key frame 8 as shown in FIG. 6(D).

When carrying out the assembling process as shown by FIGS. 7(A) and 7(B), the key 1 is moved in a horizontal direction while the guide member 14 is moved to be slid along the rib of the actuator 6. For this reason, the rib which extends in a longitudinal direction is not formed with a sharply rising angle. In other words, it is necessary to form the rib by a gradually inclining angle.

Figure 8:
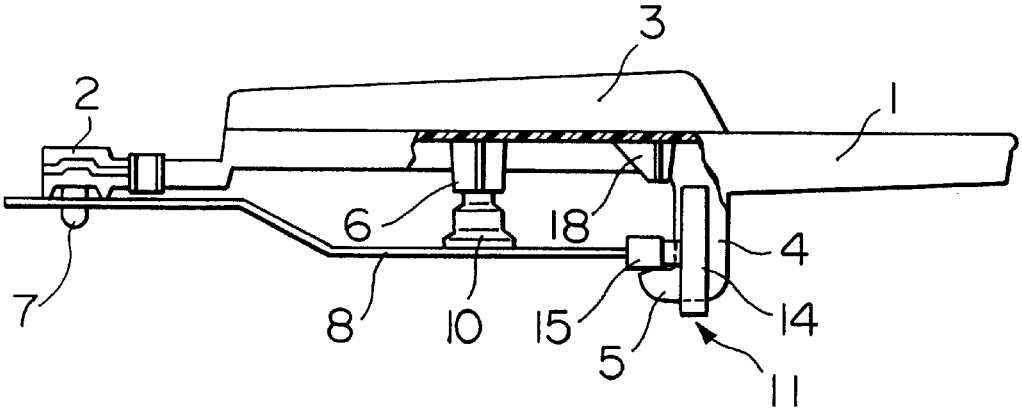
FIG. 8 is a cross-sectional view illustrating another example of the keyboard assembly.

FIG. 8 shows another example of the mechanical construction of the keyboard apparatus. Different from the foregoing examples, this keyboard apparatus is designed to replace the foregoing assembly guide element 12 by an assembly guide rib 18 which is located apart from the actuator 6.

Figure 9A:
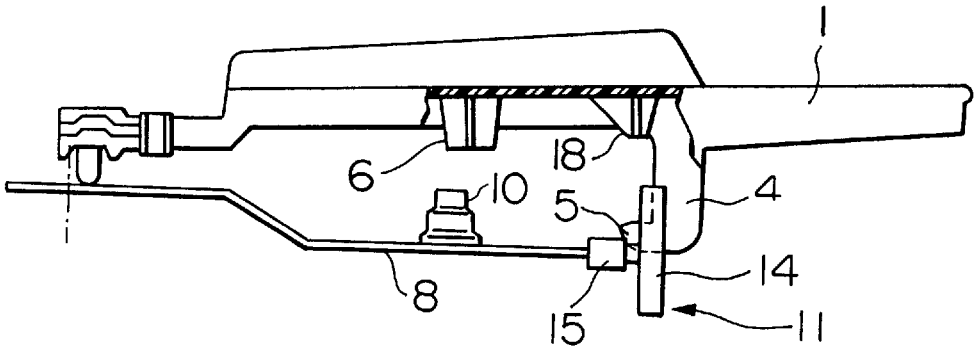
FIGS. 9(A) through 9(C) show steps for an assembling operation for another example of the keyboard assembly shown in FIG. 8.
Figure 9B:
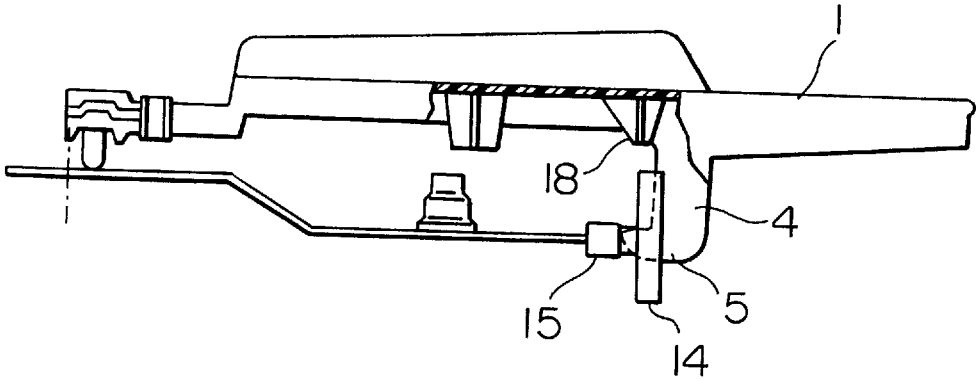
Figure 9C:
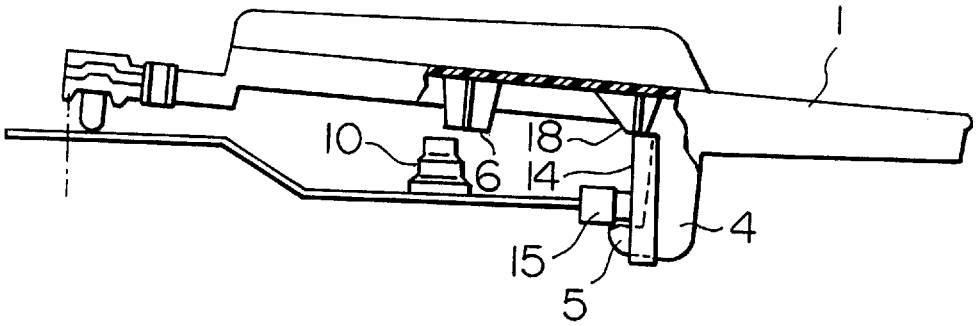

FIGS. 9(A) to 9(C) show an assembling process for this keyboard apparatus. At first, as shown in FIG. 9(A), the projection 7 of the key 1 is mounted at a certain position in the vicinity of the position of the hole (see dashed-line point) of the key frame 8. The stopper element 5 of the guided member 4 is located above the stopper member 15 of the key guide 11.

Next, as shown in FIG. 9(B), the key 1 is raised up by being rotated about the projection 7. At this time, the tip edge portion of the stopper element 5 is slightly moved in a front direction (i.e., a right-side direction of the drawing) as compared to the state shown in FIG. 9(A). Therefore, the tip edge portion of the stopper element 5 is elevated down by being slid along the front face of the stopper member 15 of the key guide 11.

By further moving down the key 1, the upper face of the stopper element 5 reaches to be in contact with the lower face of the stopper member 15 as shown in FIG. 9(C). At this time, the assembly guide rib 18 comes in contact with the summit portion of the guide member 14 of the key guide 11. In addition, the actuator 6 is located above and apart from the upper face of the key switch 10. At this stage, the actuator 6 does not at all come in contact with the key switch 10.

At the state where the assembly guide rib 18 comes in contact with the summit portion of the guide member 14 of the key guide 11, the key 1 is shifted backward (in a left-side direction of the drawing). Thus, as shown in FIG. 8, the projection 7 is inserted into the hole of the key frame 8, so that the assembling process is completed. At this time, the stopper element 5 of the guided member 4 is in contact with the lower face of the stopper member 15. The contact point between them forms an upper limit for the key 1 when the key 1 is returned from the key-depressed position. In other words, the stopper member 15 is associated with the stopper element 5 to form an upper-limit stopper for the key 1. At this state, the assembly guide rib 18 departs from the guide member 14 of the key guide 11, so that the assembly guide rib 18 does not interfere with the key-depressing motion of the key 1. Thus, when the key 1 is depressed down, the actuator 6 presses and deforms the key switch 10 so that the key switch 10 is driven.

Figure 10A:
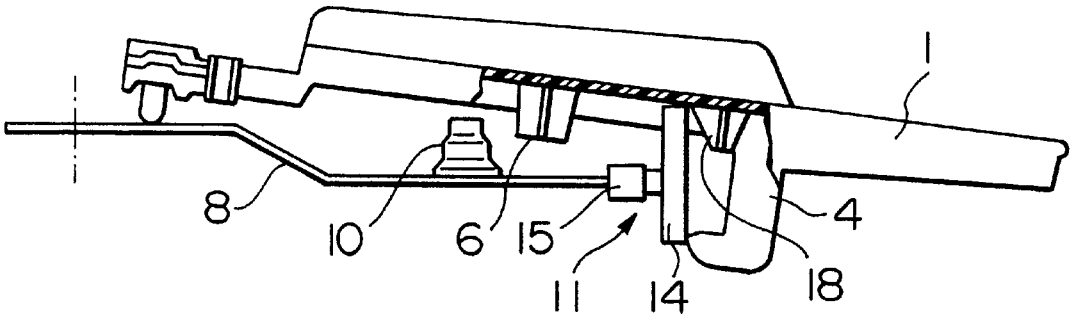
FIGS. 10(A) and 10(B) show another example of the steps for the assembling process for another example of the keyboard assembly.
Figure 10B:
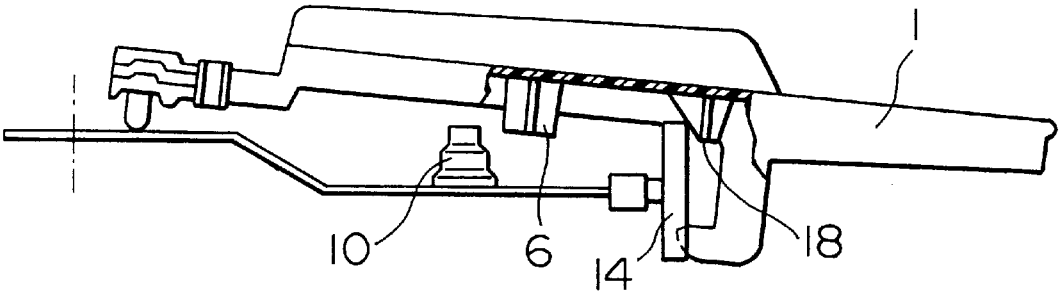

FIGS. 10(A) and 10(B) show another assembling process for the keyboard apparatus shown in FIG. 8. As shown in FIG. 10(A), the projection 7 of the key 1 is mounted on the key frame 8 at a certain position which is located apart from the position of the hole (see dashed-line point). At this state, the guide member 14 of the key guide 11 is in contact with the lower face of the key 1. Then, the key 1 is moved backward while the lower face of the key 1 is slid along the summit portion of the guide member 14. In the state as shown in FIG. 10(A) where the guide member 14 reaches a root portion of a longitudinal-rib portion of the assembly guide rib 18, the actuator 6 does not reach the key switch 10 so that the actuator 6 is departed from the key switch 10.

Thereafter, the key 1 is further moved in a left-side direction while the summit portion of the guide member 14 is slid along the assembly guide rib 18. Thus, as shown in FIG. 10(B), the key 1 is moved in a left-side direction while being raised up.

By further moving the key 1 in the left-side direction, the summit portion of the guide member 14 reaches the summit portion of the assembly guide rib 18. Thus, the foregoing assembled state shown in FIG. 9(C) is obtained. Thereafter, the key 1 is moved as described before, so that the key 1 is finally assembled together with the key frame 8 as shown in FIG. 8.

When carrying out the assembling process as shown by FIGS. 10(A) and 10(B), the key 1 is moved in a horizontal direction while the guide member 14 is slid along the assembly guide rib 18. For this reason, the longitudinal-rib portion of the assembly guide rib 18 is not formed with a sharply rising angle. In short, it is necessary to form this longitudinal-rib portion by a moderately inclining angle.

In the foregoing examples, the keyboard apparatus is designed such that the guide member 14 comes in contact with the assembly guide element 12 or the assembly guide rib 18. However, it is possible to modify these examples such that the position of the guide member 14 is shifted to another position along with a longitudinal direction of the key 1. In this case, a projecting element exclusively designed to be in contact with the assembly guide element 12 or the assembly guide rib 18 can be planted at the position where the guide member 14 is previously located.

Figure 11:
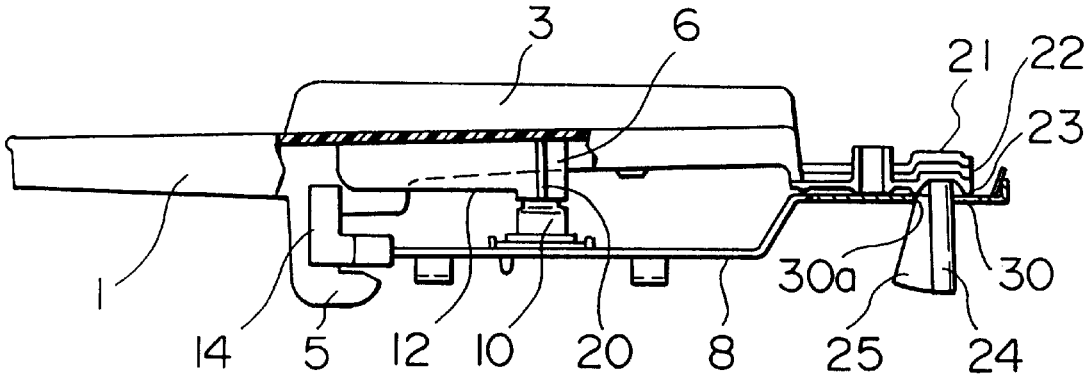
FIG. 11 is a cross-sectional view illustrating a still another example of the keyboard assembly.

FIG. 11 shows a still another example of the keyboard apparatus. As described before, one black-key block 21 and two white-key blocks 22, 23 are piled up to form a key assembly, wherein the black-key block corresponds to a plurality of black keys, while the white-key block corresponds to a plurality of white keys. These key blocks are piled up together such that all of the keys can be disposed on the keyboard in parallel. FIG. 11 only shows one white key 1 and one black key 3, however, plural white keys and plural black keys are actually disposed in parallel on the keyboard.

In order to avoid the contact between the actuator 6 (attached to the key 1) and the key switch 10 (provided on the key frame 8) when assembling the key unit and the key-frame unit together, the assembly guide element 12 is provided in a manner as described in the foregoing examples. This example further provides a reinforcing rib 20 which extends in a lateral direction. At the tip edge portion of the key frame 8, there is provided a key-depression guide member 14 (i.e., guide member 14) which guides the key 1 in a vertical direction (i.e., key-depression direction) when the key 1 is depressed. In addition, an upper-limit stopper (i.e., stopper element) 5 is provided to the key 1.

In the present example, a hollow-cylindrical-shaped boss 24 is projected downward from the common base-edge portion of the white-key block 23 which is located at the lowest position of the foregoing key assembly. This boss 24 may correspond to the foregoing projection 7. A vertical-direction assembly guide member 25 is formed with the boss 24 along a long-axis direction of the boss 24. This assembly guide member 25 has a skirt-like shape (or a taper-like shape) so that the root portion thereof is formed relatively small, while the edge portion thereof is formed relatively wide. The assembly guide member 25 is provided to avoid an event in which when attaching the key blocks 21, 22 and 23 (i.e., key assembly) to the key frame 8, the actuator 6 is roughly moved down in a vertical direction from the above position of the key switch 10 so that an external force is applied to the key switch 10 in a horizontal direction.

As described before, when assembling the key unit and the key-frame unit together, the key 1 is moved in a horizontal direction and a vertical direction; and then, the key 1 is rotated about the fulcrum point (i.e., the projection 7 which is provided at the tip edge portion of the key 1); and finally, the projection 7 is inserted into the hole 9 (see FIG. 2) of the key frame 8, thus completing the assembling operation (see FIGS. 6(A) through 10(B)). The above-mentioned complicated assembling motions of the key 1 must be required to partially bend the upper-limit stopper 5 and then locate it beneath the key frame 8. In other words, it is not possible to simply move the key 1 so that the projection 7 will be vertically moved to be inserted into the hole 9 of the key frame 8. Just before the projection 7 is inserted into the hole 9 of the key frame 8, the actuator 6 attached to the key 1 is located just above the key switch 10. Before reaching this state, due to the function of the assembly guide element 12 or the assembly guide rib 18 which is effected in a horizontal direction, the actuator 6 is prevented from being in contact with the key switch 10. Thus, it is possible to prevent the external force from being effected on the key switch 10 in a lateral direction when carrying out the assembling operation. As a result, it is possible to raise the reliability of the function of the key switch 10 after the key unit is completely assembled together with the key-frame unit.

In the meantime, when inserting the projection 7 into the hole 9 of the key frame 8, the key 1 is rotated about the upper-limit stopper 5 under the state where the upper-limit stopper 5 is located beneath the key-depression guide 14 provided for the key frame 8. At this time, the projection 7 is moved downward while the side face thereof is slid in contact with the edge portion of the hole 9. In accordance with the progress of the insertion of the projection 7 into the hole 9, the projection 7 is moved closer to the hole 9 so that the key 1 is consequently moved in a lateral direction (or a horizontal direction). Due to such motion of the key 1, the actuator 6 eventually and slightly applies the external force to the key switch 10 in a horizontal direction.

The present example is provided to avoid the above-mentioned phenomenon in which when finally inserting the projection 7 into the hole 9 of the key frame 8, the actuator 6 is roughly moved down in a vertical direction from the above position of the key switch 10 so that the external force is applied to the key switch 10 in a lateral direction. Thus, the present example can improve the reliability of the function of the key switch 10.

More specifically, the boss 24 attached to the key block 23 provides the vertical-direction assembly guide member 25 having a taper-like shape, and the boss 24 is elevated down while a taper-edge portion of the assembly guide member 25 is slid along an edge portion 30*a* of a hole 30 which is formed at a certain position of the key frame 8. Under the state where the taper portion 13 of the upper-limit stopper 5 is located beneath the key-depression guide 14 of the key frame 8, when the key block 23 is rotated about a rotation center corresponding to the upper-limit stopper 5, the provision of the assembly guide member 25 having the taper-like shape functions such that the same distance is maintained between the rotation center and the taper edge portion of the assembly guide member 25. Therefore, the root portion of the taper-like shape is designed smaller, in other words, the taper edge portion of the assembly guide member 25 forms a part of a circular arc when the key block 23 is rotated about the rotation center. The boss 24 is inserted into the hole 30 of the key frame 8 by being moved along the taper edge portion. Since the same distance is maintained between the rotation center and the taper edge portion of the assembly guide member 25 when rotating the key block about the rotation center, even if the boss is entered into the hole 30 in accordance with the rotation, no force is caused and applied to the key block 23 so that the key block 23 may not be moved toward the hole 30. Therefore, the actuator 6 attached to the key 1 is roughly moved down in a vertical direction from the above position of the key switch 10 provided on the key frame 8, however, no force is applied to the key switch 10 in a lateral direction during the down motion of the actuator 6.

Figure 12A:
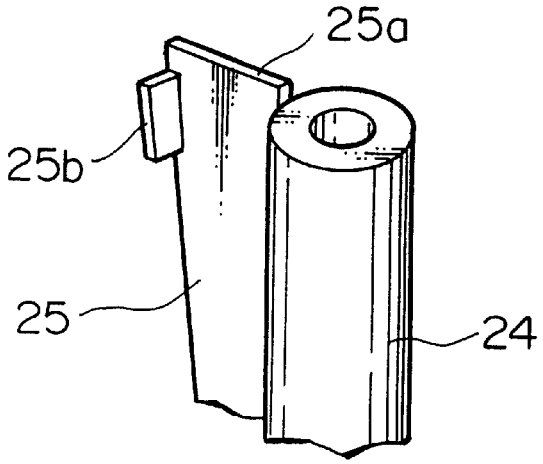
FIGS. 12(A) and 12(B) show different examples of a vertical-direction assembly guide member employed in the keyboard assembly shown in FIG. 11.
Figure 12B:
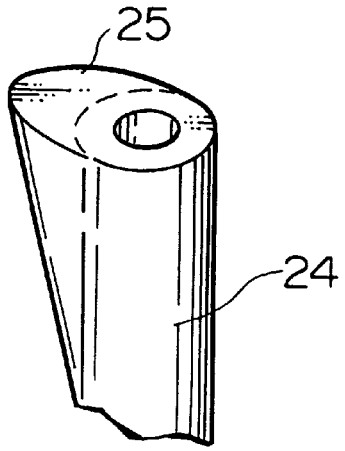

FIGS. 12(A) and 12(B) are perspective-side views each illustrating an example of the shape of the assembly guide member 25. In these drawings, the illustration of the boss 24 is reversed as compared to the illustration of FIG. 11. FIG. 12(A) shows the assembly guide member 25 which is constructed by a rib-shaped thin plate member. A lower edge portion 25*a* is projected from the level of the edge portion of the boss 24 in order to guide the boss 24 toward the hole 30 in a horizontal direction before inserting the boss 24 into the hole 30. This lower edge portion 25*a* will be slid into a hole 29 (which will be described later in conjunction with FIGS. 15 and 16). Further, an auxiliary element 25*b* works to broaden a taper-guide face so as to ensure the guide operation for the boss 24 and smoothly perform a horizontal guide operation (which will be described later). This auxiliary element 25*b* can be extended along with a whole length of the taper edge portion.

FIG. 12(B) shows another example of the assembly guide member 25 of which edge portion is roughly shaped like an ellipse and in which the taper edge portion is formed larger as compared to the root portion. The fundamental function of this assembly guide member 25 shown in FIG. 12(B) is identical to that of the assembly guide member 25 shown in FIG. 12(A).

Figure 13:
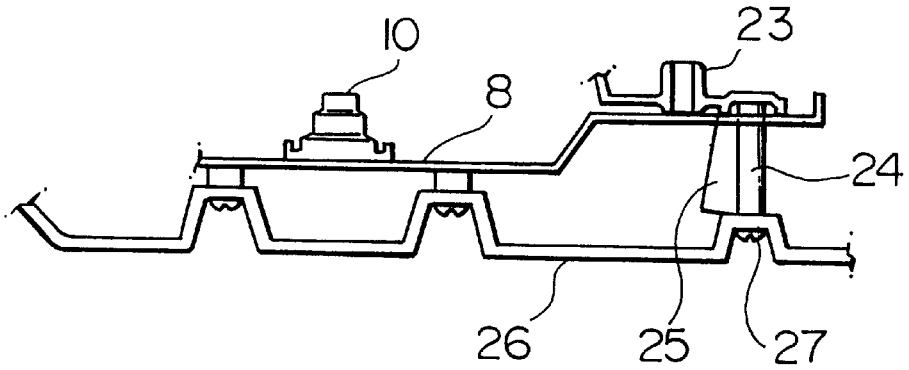
FIG. 13 shows a usage example of a boss accompanied with a taper-shaped assembly guide member.

FIG. 13 shows a usage example for the boss 24 having the above-mentioned assembly guide member 25. According to this example, the boss 24 is used as a fixing member for fixing the key with a lower case 26 which forms a part of the main body of the musical instrument. Herein, the boss 24 has a hollow shape and provides a cylindrical screw hole. A tapping screw 27 is inserted into the screw hole of the boss 24 via the lower case 26, so that the key frame 8 is fixed to the lower case 26.

Figure 14:
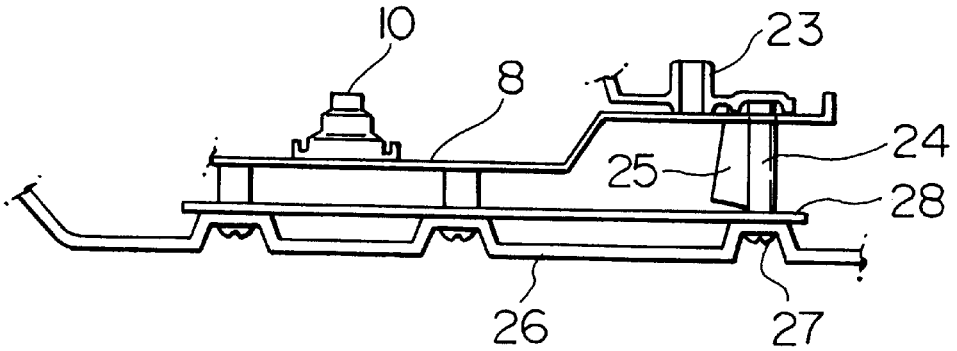
FIG. 14 shows another usage example of the boss accompanied with the taper-shaped assembly guide member.

FIG. 14 shows another usage example for the boss having the assembly guide member 25. In this example, a printed circuit board 28 on which electronic circuits for controlling electronic sounds of the musical instrument are mounted is fixed beneath the key frame 8, while the key frame 8 is fixed with the lower case 26 by means of the printed circuit board 28. The tapping screw 27 is inserted into the boss 24 via the printed circuit board 28, so that the lower case 26 and the key frame 8 are mutually fixed together. Incidentally, this example can be modified such that the printed circuit board 28 is only screwed with the boss 24.

Figure 15:
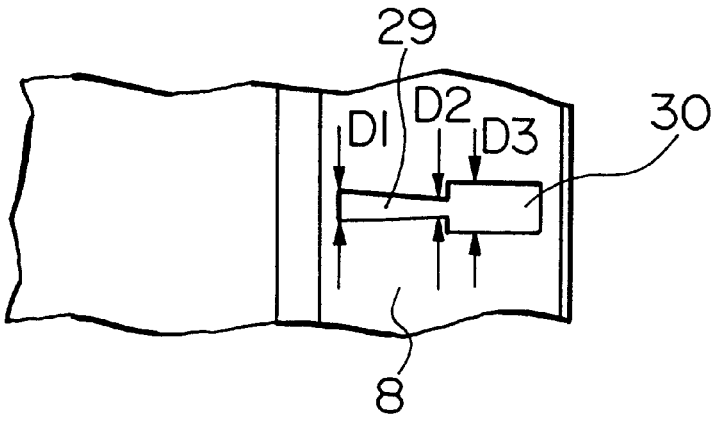
FIG. 15 is a plan view illustrating shapes of a guide channel and a hole formed in the key frame.

FIG. 15 shows a shape of the hole 30 formed in the key frame 8 through which the assembly guide member 25 is to be inserted. In this hole 30, a guide channel 29 is provided to slide the boss 24 attached to the key block in a horizontal direction on the key frame 8 and guide it to the hole 30 when assembling the key block and the key frame 8 together. This guide channel 29 can be modified to a through hole which is formed through the key frame 8 as similar to the hole 30. Or, this guide channel 29 can be formed as a concave portion which is formed on the key frame 8 by the press working and the like.

The aforementioned lower edge portion 25*a* of the assembly guide member 25 is entered into and engaged with the guide channel 29. In accordance with a progress of the assembling operation, the assembly guide member 25 is guided by this guide channel 29 so that the boss 24 is eventually guided toward the hole 30. In the guide channel 29, a first-edge width D1 is set larger than a second-edge width D2. Due to such taper-like shape of the guide channel 29, even if the lower edge portion 25*a* of the assembly guide member 25 is roughly inserted into the guide channel 29 at first, a progressing course of the assembly guide member 25 is narrowed so that the boss 24 can be accurately inserted into the hole 30. In short, it is possible to simplify the inserting operation of the boss 24. Incidentally, a width D3 of the hole 30 matches with an outside diameter of the boss 24.

Figure 16A:
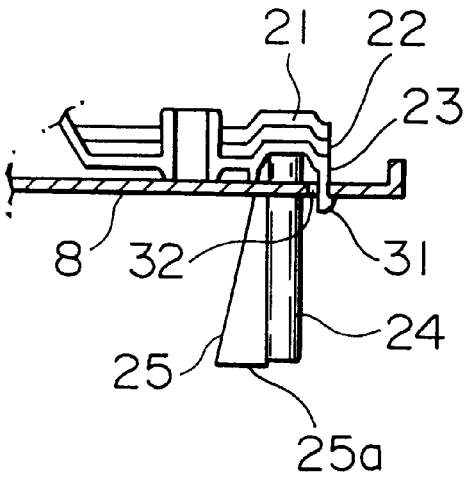
FIG. 16(A)shows an insertion manner of the boss which is inserted into the hole of the key frame.
Figure 16B:
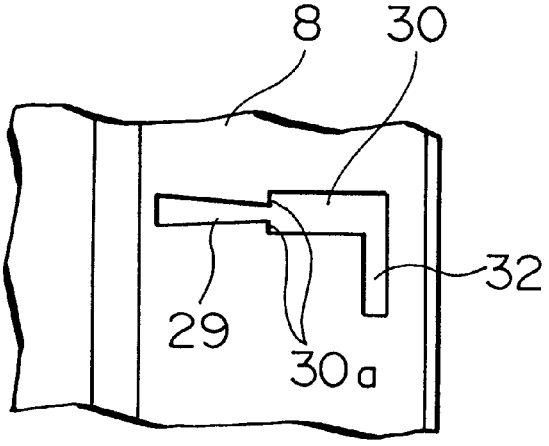
FIG. 16(B) shows another example of the shapes of the guide channel and the hole formed in the key frame.

FIGS. 16(A) and 16(B) show a modified example of the hole 30 which is formed through the key frame 8. As shown in FIG. 16(B), a locking hole 32 is further formed with the hole 30 such that these holes are crossed together by a square angle. In short, a whole shape of these holes is like a letter "L" shape. As shown in FIG. 16(A), a claw 31 is formed with the black-key block 21 (which is piled up at the highest position among the key blocks 21, 22 and 23). This claw 31 is elastically inserted into the locking hole 32 and then hooked at the locking hole 32, so that the key block is securely fixed with the key frame 8.

Figure 17A:
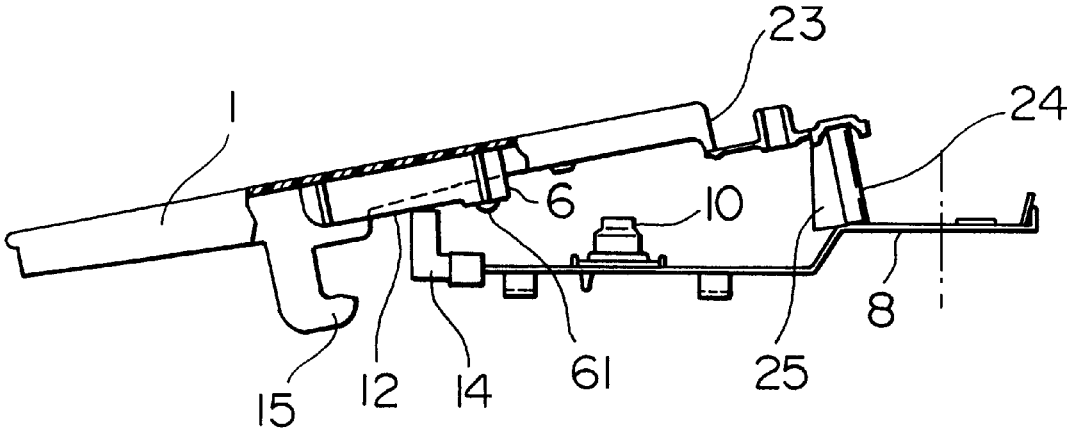
FIGS. 17(A) through 17(F) show steps for an assembling process for assembling the keyboard assembly shown in FIG. 11.
Figure 17B:
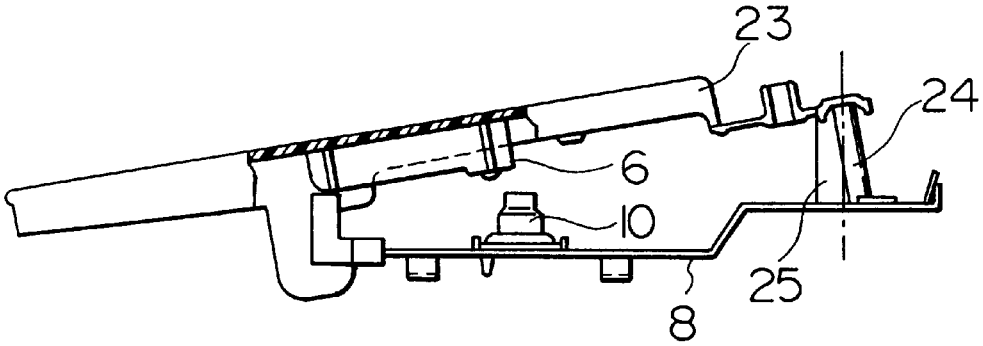
Figure 17C:
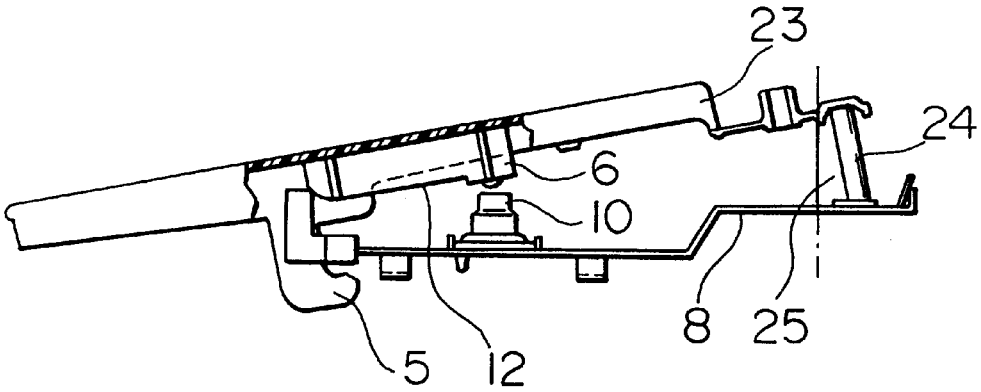

FIGS. 17(A) through 17(F) show steps of the assembling operation by which the white-key block 23 providing the aforementioned assembly guide member 25 is attached to the key frame 8. When actually assembling the keyboard apparatus, the foregoing key assembly containing three key blocks is attached to the key frame at once. However, since the assembling operation for the key assembly is identical to the assembling operation for the white-key block 23, the assembling operation for the white-key block 23 is only described in detail for convenience's sake. In these drawings, the dashed line shows an edge position of the hole 30 of the key frame 8 through which the boss 24 will be inserted. At first, as shown in FIG. 17(A), the boss 24 is mounted on the key frame 8. From this state, the back-edge portion of the assembly guide member 25 is slid along the guide channel 29 (see FIG. 15) so as to slide the boss 24 in a right-side direction toward the hole 30 as shown in FIG. 17(B). FIG. 17(C) represents the state where the back-edge portion of the assembly guide member 25 reaches the edge position of the hole 30 (designated by the dashed line). At this state, the actuator 6 attached to the key block 23 is located just above the key switch 10. As described before, until the actuator 6 reaches this position, the actuator 6 is forced not to be in contact with the key switch 10 under the effect of the assembly guide element 12 which is continuously formed with the actuator 6 in a horizontal direction.

Figure 17D:
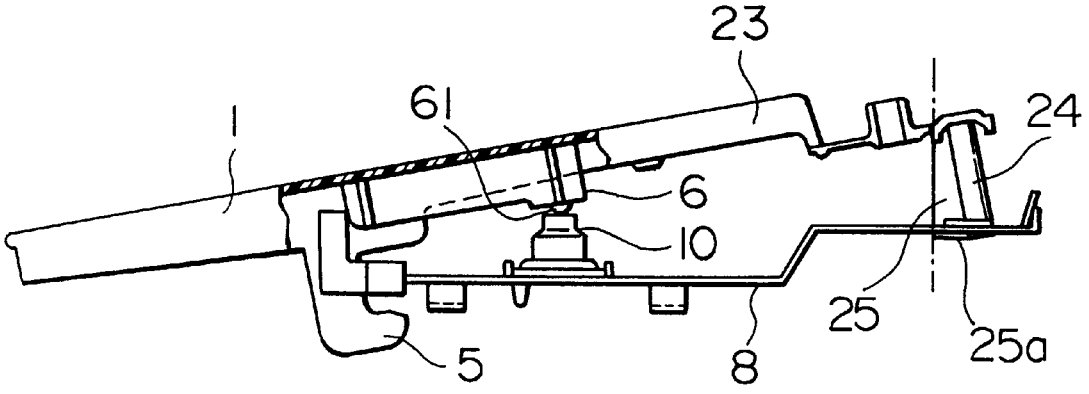
Figure 17E:
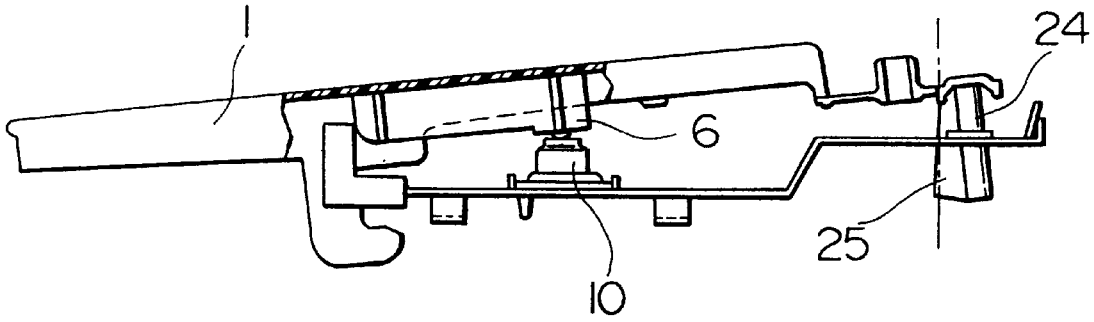
Figure 17F:
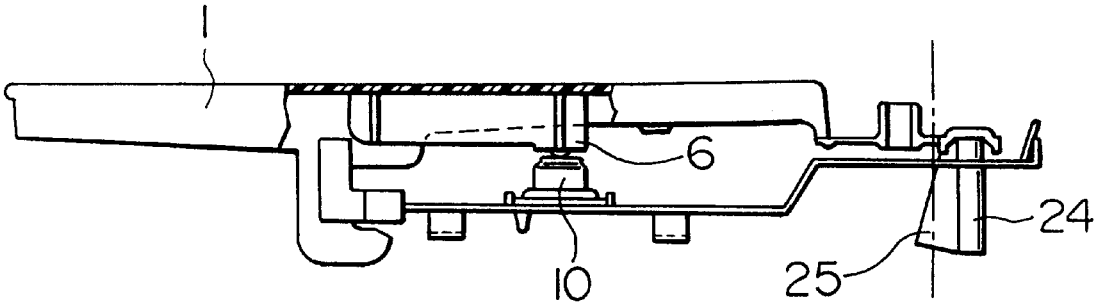

At the state shown in FIG. 17(C), the key block 23 is rotated about the rotation center which is located in the vicinity of the upper-limit stopper 5 located beneath the key-depression guide 14 attached to the key frame 8. Due to the rotation of the key block 23, the boss 24 accompanied with the assembly guide member 25 is dropped into the hole 30 of the key frame 8. FIG. 17(D) shows a state where the lower edge portion 25*a* of the assembly guide member 25 is slightly dropped down into the hole of the key frame 8 so that the actuator 6 is moved down from the just above position of the key switch 10, and consequently, the actuator 6 comes in contact with the head portion of the key switch 10. At this moment, the key-depression guide 14 is also slid along the edge portion of the assembly guide element 12 and then partially inserted into an interior portion of the key 1. At this state, a projection 61 of the actuator 6 is engaged with the head portion of the key switch 10, so that a securely fixed relationship is established between the actuator 6 and the key switch 10 afterwards. Therefore, even a shock or a vibration which is inevitably occurred when moving down the key 1 may not change such relationship. Due to such relationship, a balanced state can be automatically established for the key as a whole, whereas the position of the key switch 10 works as a balance center. FIG. 17(E) shows a state where the key 1 is fallen down while the outside edge portion of the assembly guide member 25 is sliding along the edge portion of the hole. In this state, the actuator 6 is roughly moved down in a vertical direction while pressing the head portion of the key switch 10 made of the elastic material. FIG. 17(F) shows a state where the boss 24 is completely inserted into the hole 30. In this state, even the root portion of the assembly guide member 25 can be inserted into the hole of the key frame 8. During the insertion of the boss 24 into the hole, the actuator 6 is always moved down in a vertical direction (or a switch-driving direction) of the key switch 10. Therefore, no force is applied to the key switch 10 in a horizontal direction. In other words, the key switch 10 made of the elastic material is not pressed and deformed in a lateral direction.

Figure 18A:
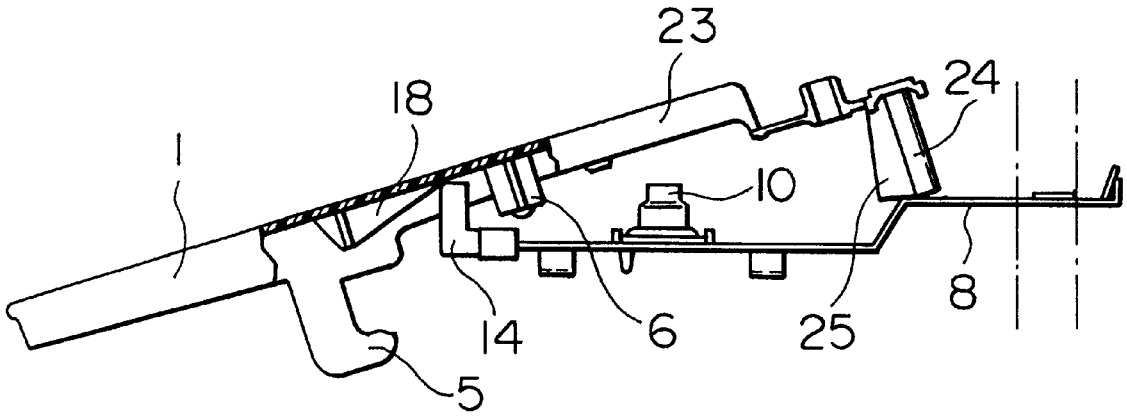
FIGS. 18(A) through 18(F) show another example of the steps for the assembling process for assembling the keyboard assembly shown in FIG. 11.
Figure 18B:
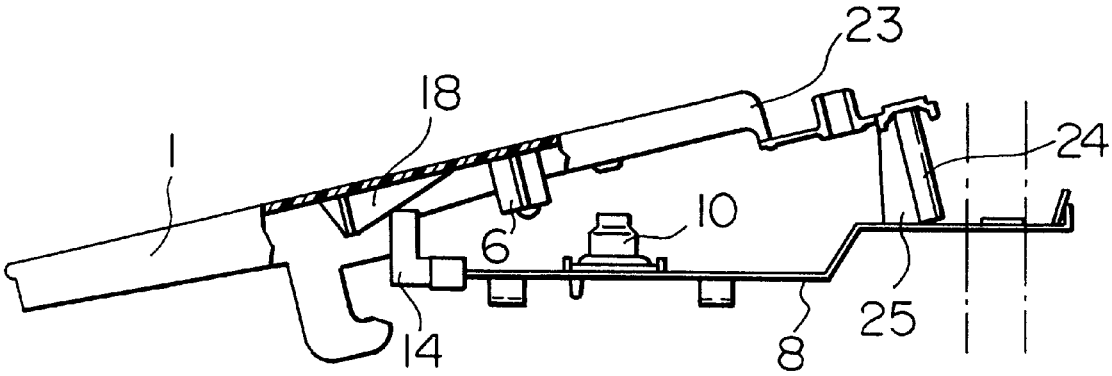
Figure 18C:
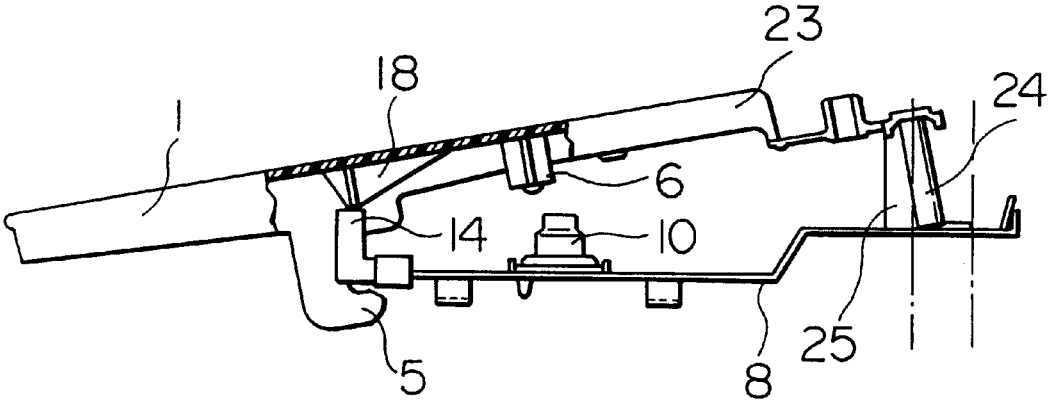
Figure 18D:
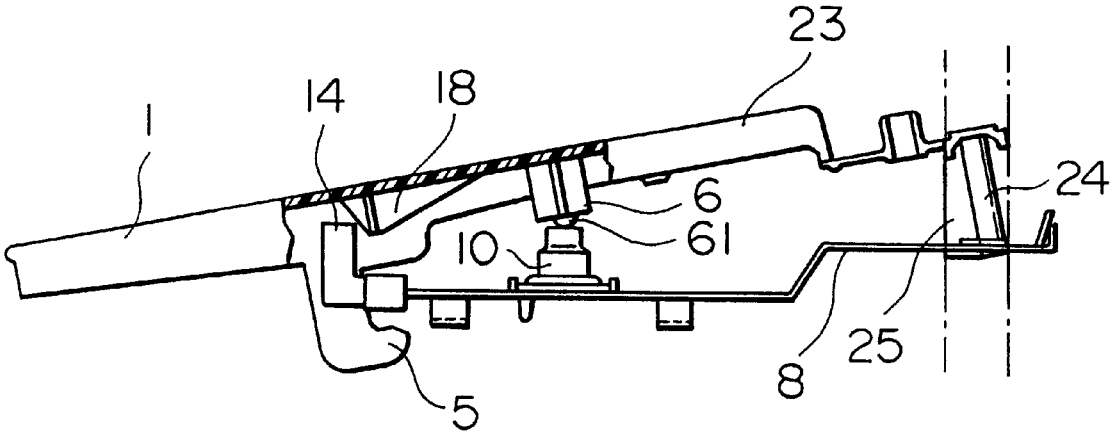
Figure 18E:
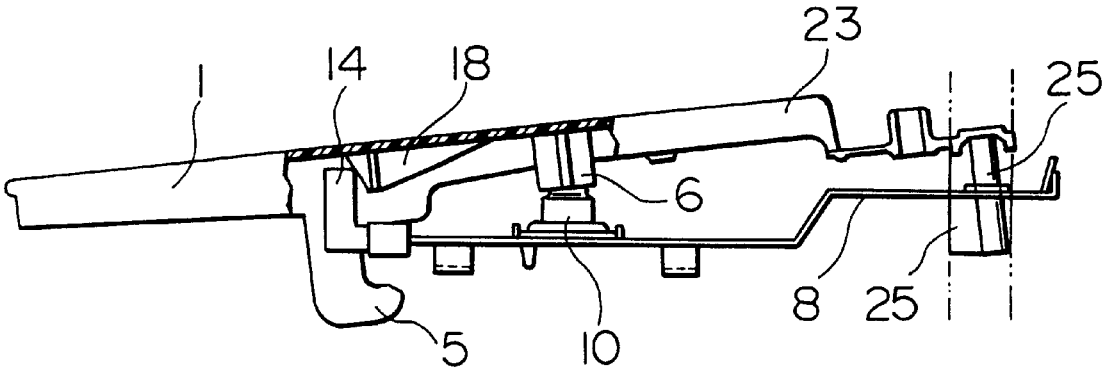
Figure 18F:
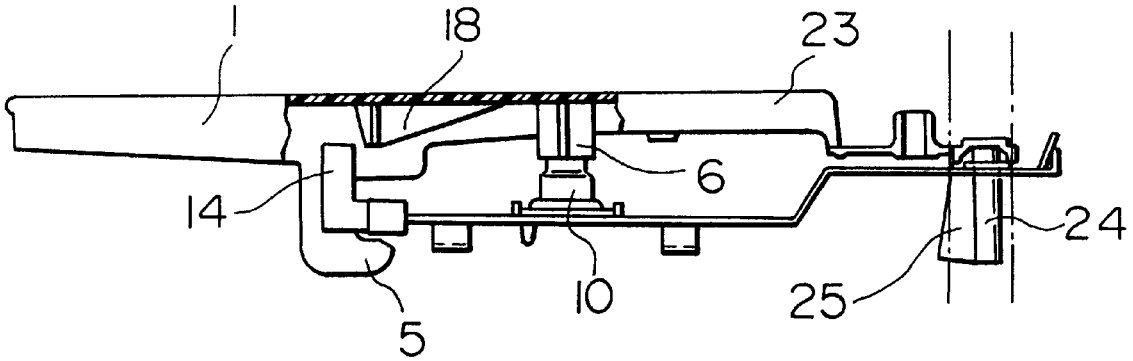

FIGS. 18(A) through 18(F) show another example of the steps of the assembling operation by which the key block 23 providing the aforementioned boss 24 having the taper-shaped assembly guide member 25 is attached to the key frame 8. Different from the foregoing example as shown in FIGS. 17(A) through 17(F), the assembly guide element 12 which is continuously formed with the actuator 6 is replaced by the assembly guide rib 18 which is separated from the actuator 6. The functions and operations of the assembly guide rib 18 have been already described in conjunction with FIGS. 8 through 10(B). In a first state shown in FIG. 18(A), the upper edge portion of the key-depression guide 14 is directly in contact with the lower surface of the key 1, so that the inclination of the key block 23 must be larger as compared to the foregoing example shown in FIG. 17(A). However, the assembly guide member 25 performs the substantially same function in this example as compared to the foregoing example shown in FIGS. 17(A) through 17(F). From the state shown in FIG. 18(A), the boss 24 is slid and guided toward the hole of the key frame 8 (see FIGS. 18(B) and 18(C)). When the back-edge portion of the assembly guide member 25 reaches the edge portion of the hole as shown in FIG. 18(D), the boss 24 is fallen down while the outside edge portion of the assembly guide member 25 is sliding along the edge portion of the hole as shown in FIG. 18(E). Finally, the insertion of the boss 24 is completed as shown in FIG. 18(F). As described above, the structure of the boss 24 accompanied with the taper-shaped assembly guide member 25 can be employed in combination with the assembly guide rib 18, extending in a horizontal direction, which is attached to the interior wall of the white key 1 and separated from the actuator 6.

Figure 19:
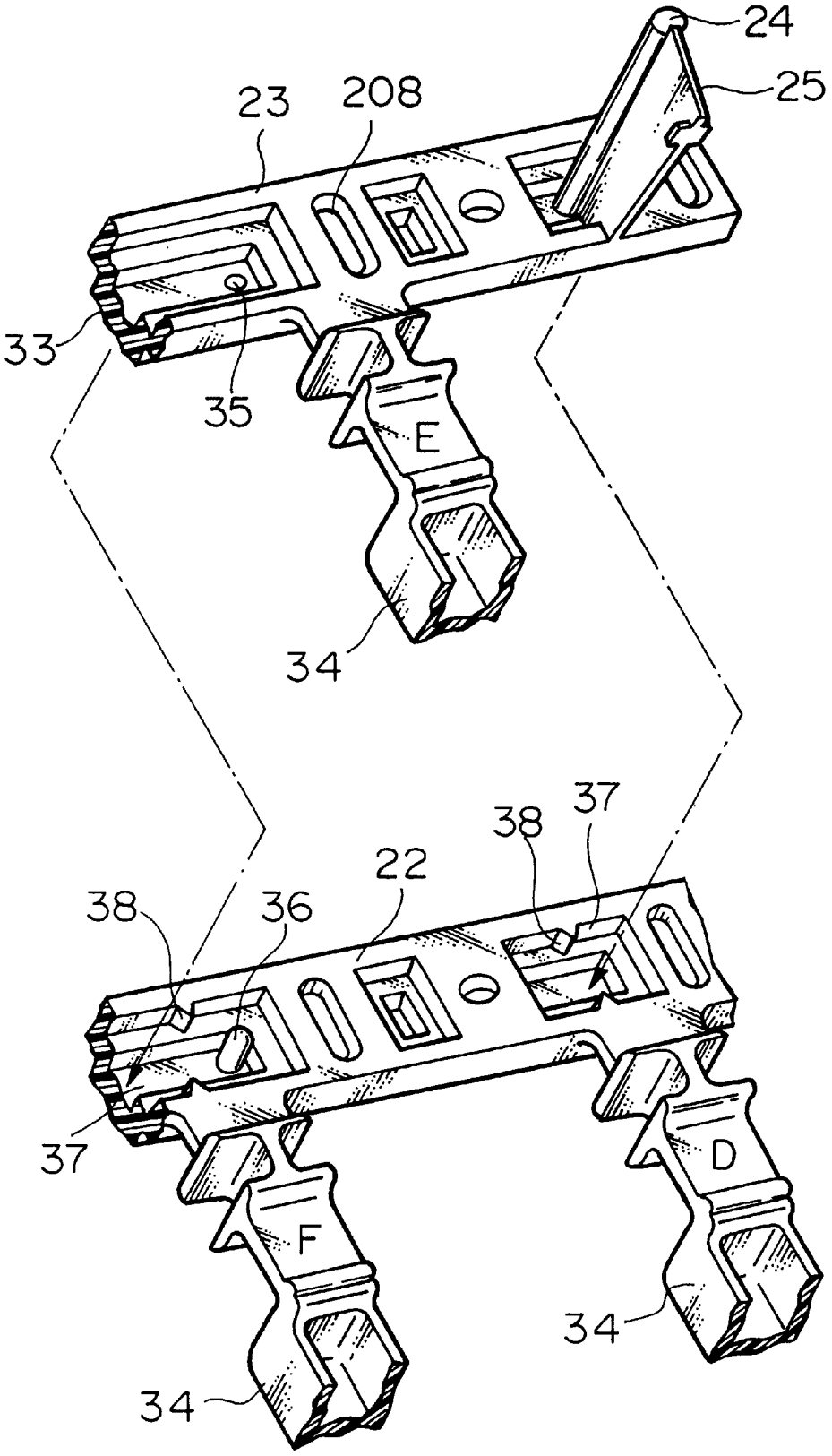
FIG. 19 is an exploded perspective-side view showing an assembling operation for assembling two key blocks together.

FIG. 19 is an exploded perspective-side view illustrating an essential part of the key assembly. This drawing represents a bottom view for two white-key blocks 22 and 23. A plurality of white keys 34 are formed with each of the key blocks 22 and 23. Each of the white keys 34 can be rotated about the root portion thereof made of the elastic material. This drawing illustrates three white keys 34, wherein the key block 23 provides an E key, while the key block 22 provides a F key and a D key. A plurality of projecting portions 33 are formed in the key block 23. The key block 22 provides a plurality of concave portions 37 each of which corresponds to each of the projecting portions 33. By engaging the projecting portions 33 with the concave portions 37 respectively, the key blocks 22 and 23 can be piled up and assembled together while the keys 34 are disposed in parallel. A numeral 35 designates a positioning hole which is engaged with a positioning projection 36. Ribs 38 are respectively projected from interior side walls of the concave portion 37. These ribs 38 are formed as parts of the key block 22 made of the elastic material. Due to the provision of the ribs 38 made of the elastic material, when the key blocks 22 and 23 are assembled together by engaging the concave portion 37 with the projecting portion 33, the key blocks 22 and 23 can be securely fixed together. In FIG. 19, the black-key block 21 (not shown) is located below the white-key block 22. Since the common base-edge portion of this black-key block 21 providing the black keys is similar to that of the white-key block 22 or 23 providing the white keys, the illustration of the black-key block 21 is omitted. Of course, there are provided plural ribs 38 in the black-key block. Instead of providing the ribs 38 at the inside of the concave portion 37, it is possible to provide them at the outside of the projecting portion 33.

[B] Second Embodiment

Figure 20:
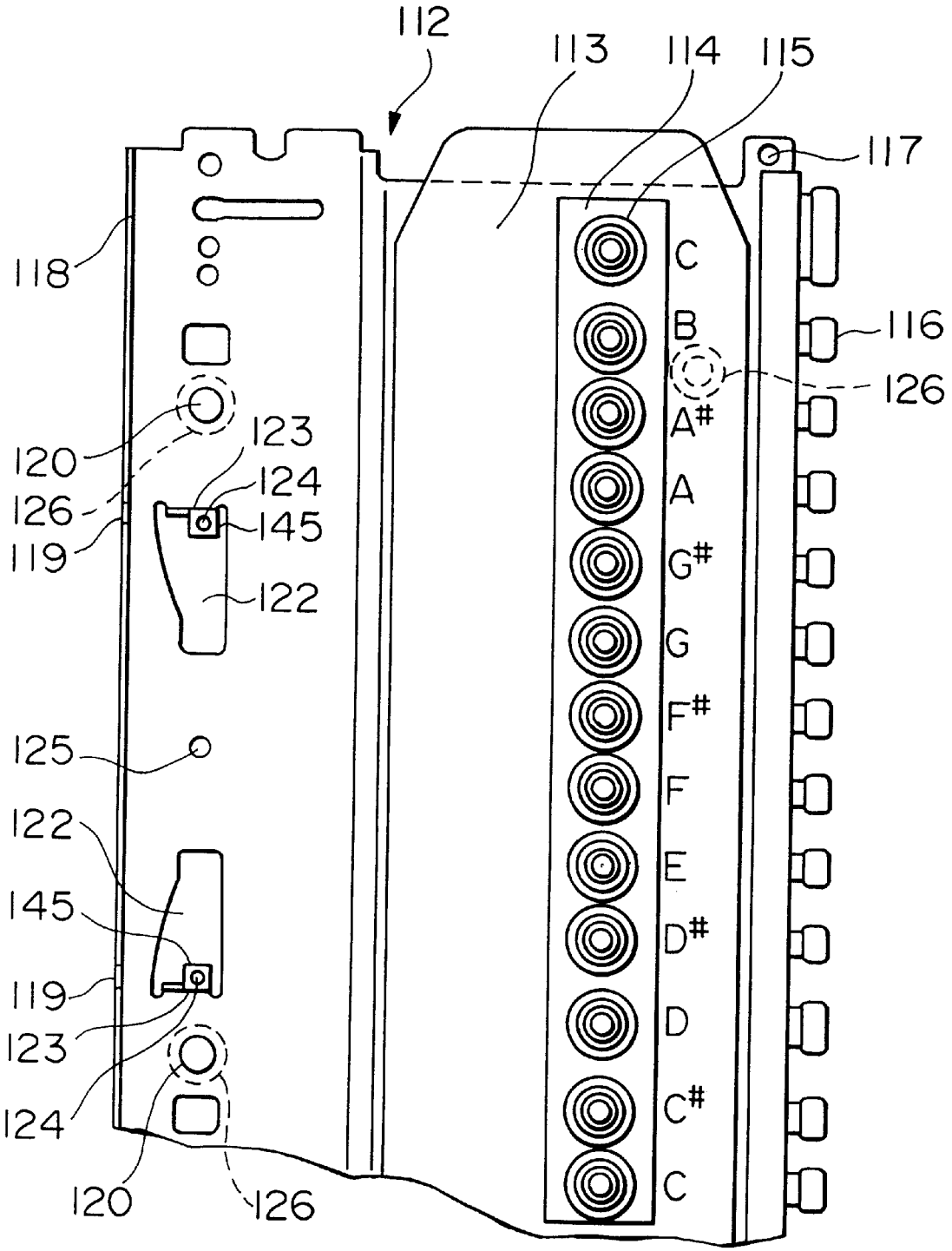
FIG. 20 is a plan view illustrating an essential part of the key frame used in the keyboard apparatus according to a second embodiment of the present invention.

FIG. 20 is a plan view illustrating a key supporting member which is used for the keyboard apparatus according to a second embodiment of the present invention. On a key frame 112 (i.e., key supporting member) made of a metal material, a flexible board 113 made of a resin material (such as the polyester film) is mounted. An edge portion of the flexible board 113 is folded back to a lower side of the key frame 112, and then, the folded portion is attached to a main board (see FIG. 21) 135 by a connector 1132 which is located at an edge part of a fold portion 1131. On the flexible board 113, a key-depression sensor (i.e., key switch) 115 which can be elastically deformed is attached by means of a rubber sheet 114 in connection with each of the keys. The key switch 115 contains two movable contacts within a projecting portion thereof, while two fixed contacts respectively corresponding to the two movable contacts are arranged in a concentric manner on the flexible board 113. When being pressed by an actuator 132 (which will be described later), two switching elements of the key switch 115 are sequentially turned on with a certain time interval, so that the key switch 115 can create touch response information. The above-mentioned structure of the movable contacts of the key switch 115 can be used for a stroke sensor. For example, the projecting portion containing the movable contacts is removed; an upper face of the key switch is formed by a mirror; and then, a photo-reflector-type optical sensor is fixed on the flexible board 113 at a position facing the mirror with respect to each of the keys, thus, it is possible to re-design the key switch as the stroke sensor which senses the key-depression stroke. As the key-depression sensor, the present embodiment can employ the stroke sensor or an initial/after-touch sensor other than the key switch. In short, the key-depression sensor is not limited by the key switch, however, for convenience's sake, the present embodiment uses the key switch as the key-depression sensor.

Along with a side-edge portion (i.e., right-side portion in FIG. 20) of the key frame 112, a plurality of key guides 116 are arranged, wherein each of them is provided to avoid the lateral swinging movement or the twisting movement of the key when the key is depressed down. A numeral 117 designates a fixing hole by which the key frame 112 is fixed to each of side portions of an upper case (not shown) which forms a part of the main body of the keyboard instrument.

A back-edge portion (i.e., left-side portion in FIG. 20) of the key frame 112 is bent upward so as to form a standing portion 118. At a predetermined position of the standing portion 118, there is formed a claw hole 119 by which the key assembly will be securely fixed. A predetermined number of fixing holes 120 by which the aforementioned lower case is securely fixed are formed at respective positions of the key frame 112. The number of the fixing holes 120 are determined such that one or two holes are provided for the keys corresponding to the tone pitches within one-octave range, for example. A boss 126 is inserted through the fixing hole 120, and a screw 1201 is screwed into the boss 126 from its lower side. Thus, the key frame 112 is securely screwed together with the lower case.

A predetermined portion of the back-edge portion of the key frame 112 is partially cut and folded up so as to form a guide portion 123. 122 designates an opening which is cut. The guide portion 123 is vertically bent up on the key frame 112. An upper edge portion of this guide portion 123 is further bent in a horizontal direction so as to form a supporting element 145 which will support the upper case. Further, a fixing hole 124 is formed through the supporting element 145 in order to securely fix the upper case. Incidentally, a numeral 125 designates a positioning hole which is used when assembling the key assembly.

Figure 21:
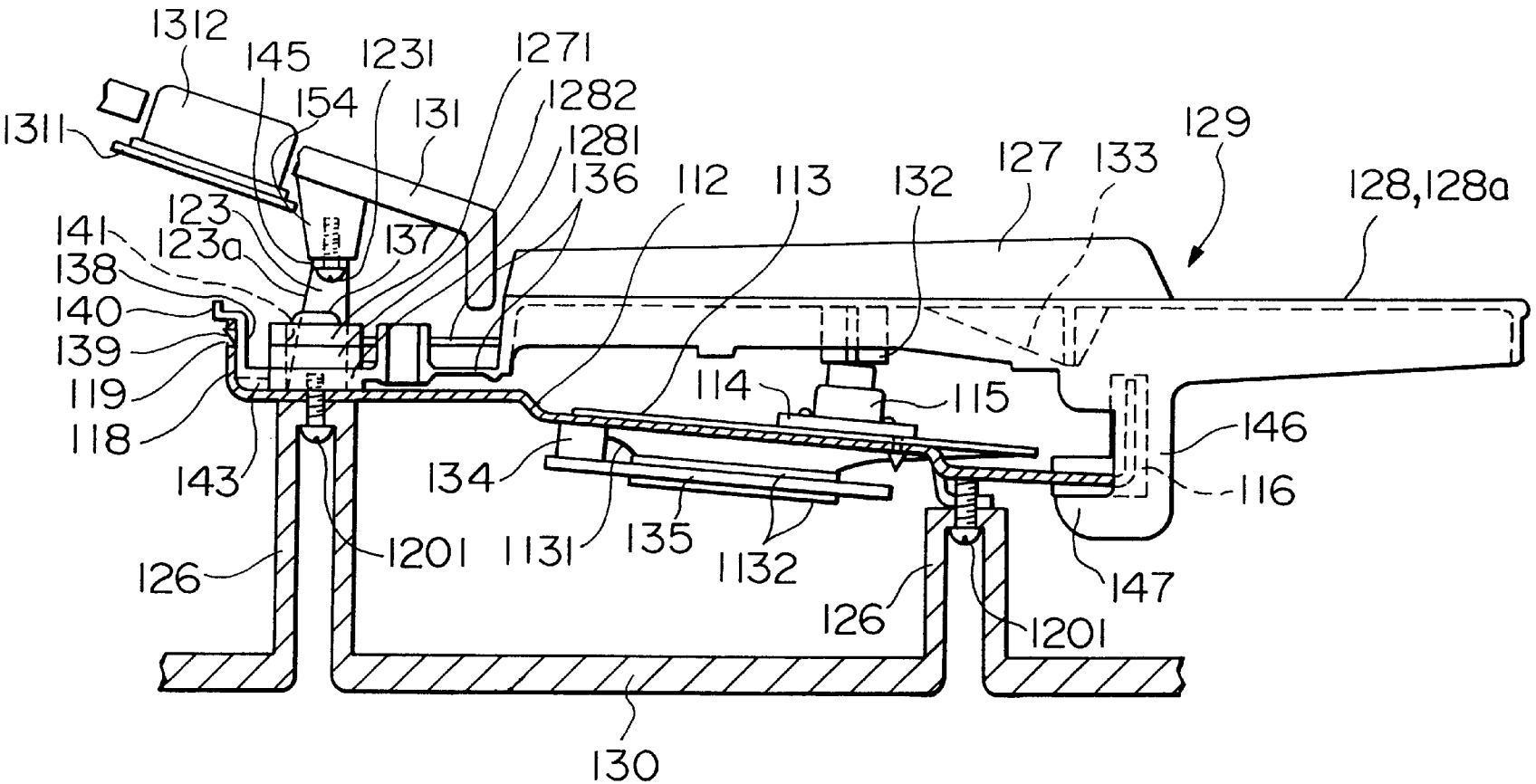
FIG. 21 is a side view illustrating an assembled state of the keyboard apparatus.

FIG. 21 is a sectional view of the keyboard apparatus in which the key is attached to the key frame 112 and the key assembly is fixed with the upper case and the lower case. Beneath a center portion of the key frame 112, there is provided the main board 135 which is fixed to the key frame 112 by means of a spacer 134. The flexible board 113 is folded back to the lower side of the key frame 112, and then, the folded portion of the flexible board 113 is connected to the main board 135. The main board 135 is a circuit board which holds several kinds of electronic circuits such as a micro-computer, memories and sound source circuits. These circuits are used for carrying out a key-depression assignment operation, a musical tone control operation and the like.

The key assembly 129 which is attached to the key frame 112 is mainly constructed by three key blocks 1281, 1282 and 1271 which are piled up and assembled together at the common base-edge portion. FIG. 21 illustrates two white keys 128, 128a and one black key 127.

Each of the white keys 128 provides an actuator 132 which presses the key switch 115 when being depressed down. As one part of the front-side portion of the key, slide guide elements 146 are formed and located such that a key guide 116 is sandwiched by them. A lower edge portion of the slide guide element 146 is bent to form a stopper element 147 which comes in contact with a lower edge face of the key guide 116 so as to stop a return-back motion of the key which is returned back from the key-depressed position. Moreover, a rib 133 is attached to an interior wall of the key 128. Due to the provision of the rib 133, when sliding the key in a horizontal direction in order to assemble the key and the key frame together, the upper face of the key guide 116 is slid along the rib 133 so that the actuator 132 is prevented from being touched with the key switch 115.

In the key assembly 129, an elastic element 138 providing a projecting claw 139 is projected from the common base-edge portion of the white key 128. This projecting claw 139 is elastically engaged with the claw hole 119 formed through the standing portion 118 of the key frame 112, so that the key assembly 129 is fixed with the key frame 112. The key blocks 1281, 1282 and 1271 of the key assembly 129 are piled up and fixed to the key frame 112 by a screw 137. Thus, each of the keys is supported by the key frame 112 at the back-edge portion thereof by means of a hinge portion 136 such that it can be freely rotated in a key-depression direction (i.e., a vertical direction).

Meanwhile, the accurate positioning is performed between the key and the key frame in a longitudinal direction of key and a width direction of key. Such positioning is performed by use of the hole 125 and its corresponding projection (not shown) provided between the keys. If the key and the key frame are fixed together at a certain one point, the projection 123 and the guide hole 141 cannot perfectly function to stop a minor rotation of the key unit. In order to stop the rotation of the key unit which must be securely fixed to the key frame, the present embodiment employs a fixing mechanism consisting of the projecting portion 143, the elastic element 138 and the standing portion 118 by which the key unit is accurately fixed to the key frame. Incidentally, two fixing mechanisms are provided for one-octave width of the keyboard.

In the meantime, a board 1311 is fixed to the upper case 131 by a boss (not shown) which is projected from the upper case 131. The upper case 131 provides a switch panel containing a plurality of tone-color selecting switches 1312 which are mounted on the board 1311.

When assembling the keyboard instrument as shown in FIG. 21, the upper case 131 is reversely put on a base (not shown); the key frame 112 fixed with the key unit is reversed, and a screw 1231 is inserted through the opening 122; the screw 1231 is further inserted through the hole 124 of the supporting element 145 provided in the guide portion 123; and then, the screw 1231 is inserted into a boss 154 attached to the upper case 131, resulting that the key frame 112 fixed with the key unit is securely screwed together with the upper case 131. At this state, the lower case 130 which is reversed is brought above the key frame 112; a screw 1201 is inserted into the boss 126, so that the lower case 130 is securely screwed with the key frame 112. Thus, the assembling operation for assembling the key unit, key frame 112, upper case 131 and lower case 130 together is completely carried out.

Figure 22:
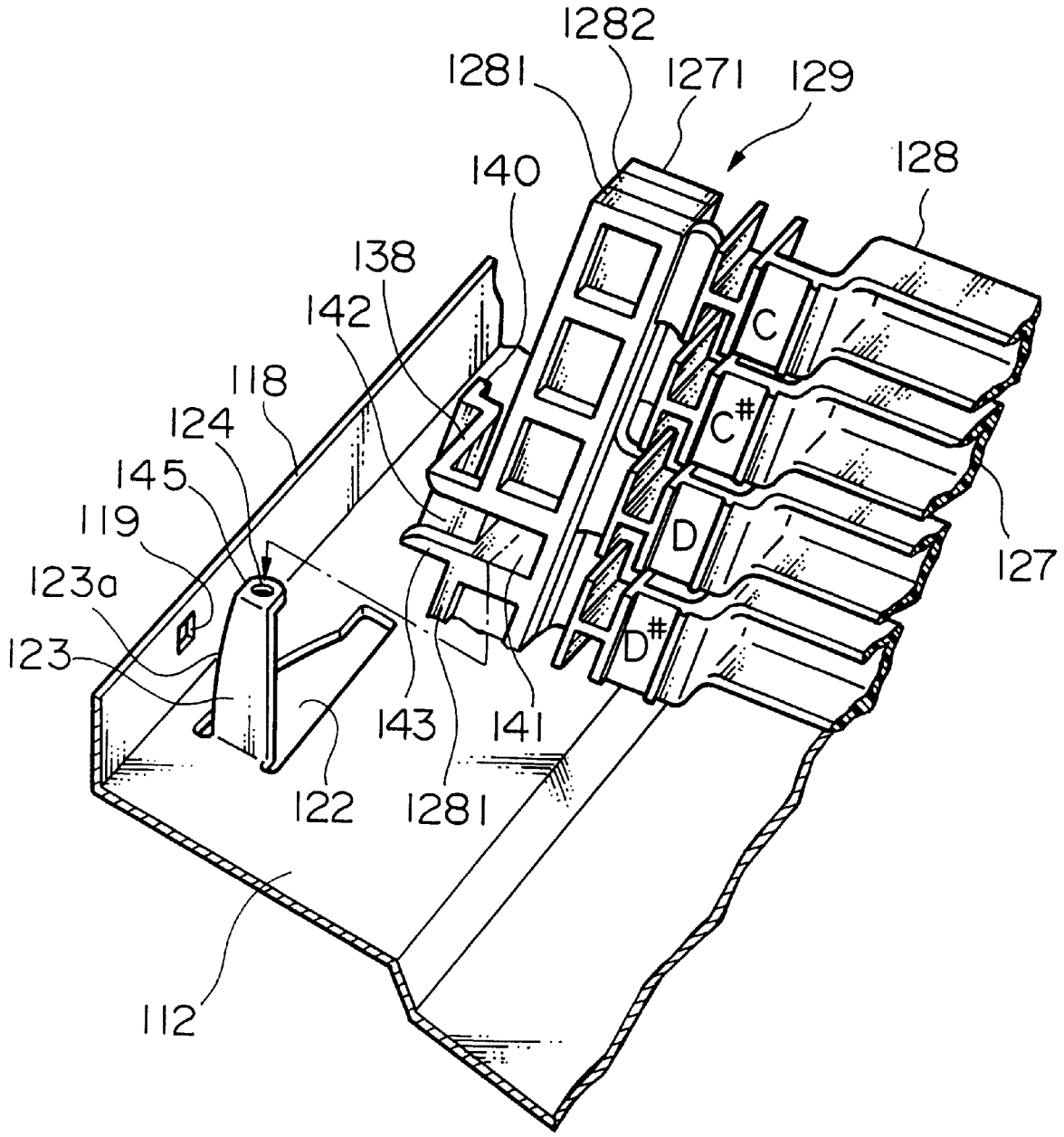
FIG. 22 is a perspective-side view illustrating the key assembly and the key frame which are not assembled together.
Figure 23:
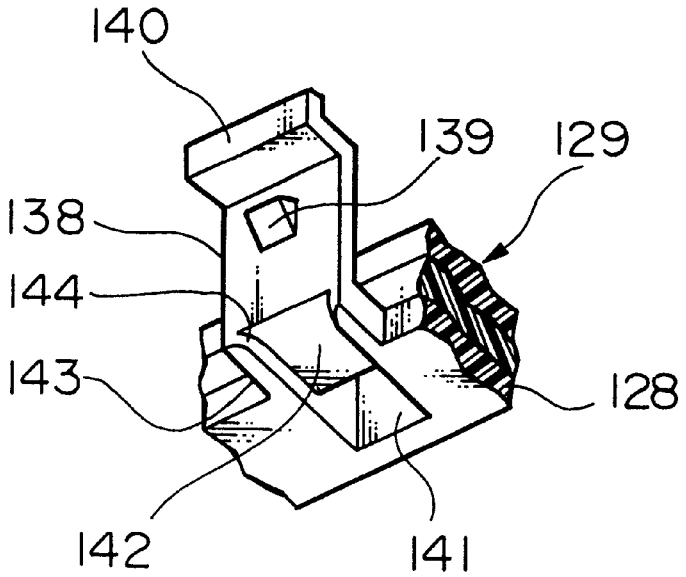
FIG. 23 is a perspective-side view illustrating an example of the back-edge portion of the key assembly.
Figure 24:
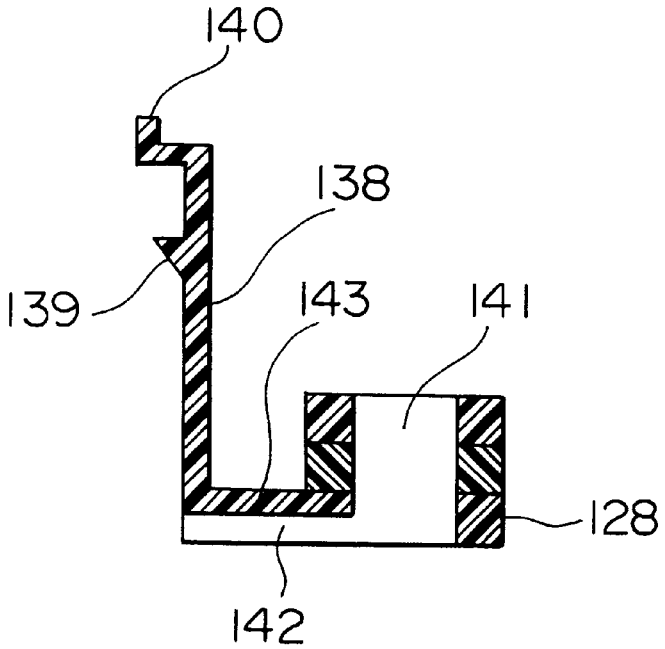
FIG. 24 is a cross-sectional view of the key assembly shown in FIG. 23.

FIG. 22 is a perspective-side view illustrating a back-side portion of the keyboard apparatus which is not assembled together, wherein the key frame 112 is illustrated from an upper view, while the key assembly 129 is illustrated from a lower view. FIG. 23 is a perspective-side view illustrating a part of a back-edge portion of the key assembly 129, while FIG. 24 is a sectional view for FIG. 23. A guide hole 141 is formed through the common base-edge portion, in which three key blocks are piled up and assembled together, at a predetermined position which meets with the guide portion 123 of the key frame 112. A projecting portion 143 is further projected in a back-side direction of the guide hole 141. A guide channel 142 is formed at a lower-face portion of the projecting portion 143. At a back-edge entry portion of the guide channel 142, a taper 144 is formed such that the entry portion of the guide channel 142 will be broadened.

A back-edge portion of the projecting portion 143 is bent upward so as to form the elastic element 138. This elastic element 138 can be elastically bent in a longitudinal direction of key. The aforementioned projecting claw 139 is further formed at a back-face portion o the elastic element 138. An upper-edge portion of the elastic element 138 is bent in a back-side direction to form a pressing element 140. A back-edge portion of the guide portion 123 which is cut and bent upward from the key frame 112 is formed in a curved shape so as to form the guide face 123*a* having a linear-taper-like shape.

Figure 25A:
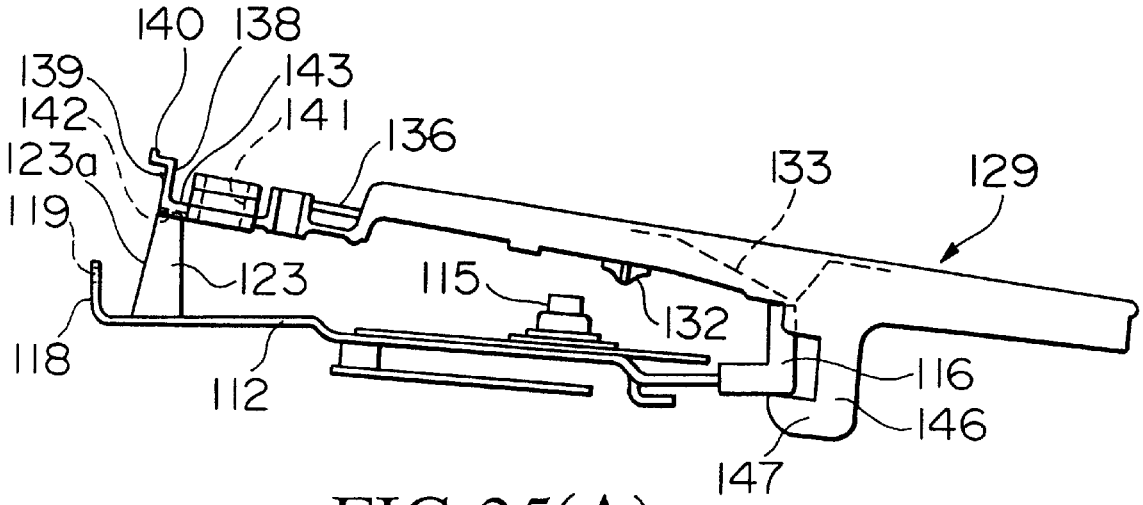
FIGS. 25(A) through 25(C) are side views illustrating an example of the assembling procedure by which the key assembly and the key frame are assembled together.

Next, an assembling procedure by which the key assembly 129 is assembled together with the key frame 112 will be described by referring to FIGS. 25(A) through 25(C). For convenience's sake, the illustration of the black key is omitted from these drawings. At first, the key assembly 129 is moved in a horizontal direction by sliding the guide rib 133 along the summit portion of the key guide 116 of the key frame 112. As shown in FIG. 25(A), the summit portion of the guide portion 123 projected from the key frame 112 is engaged with the guide channel 142 which is formed at the back-edge portion of the key assembly 129.

Figure 25B:
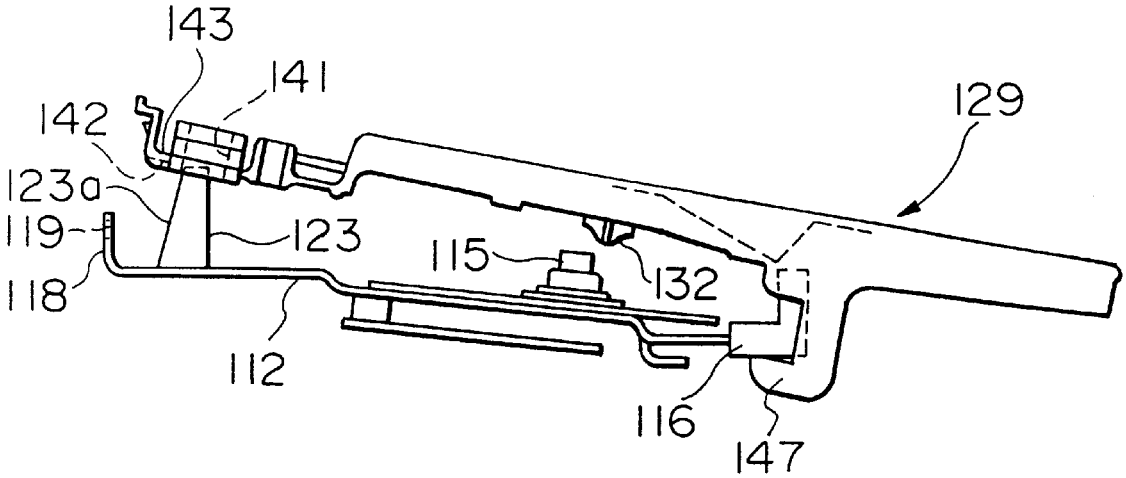

Then, as shown in FIG. 25(B), the key assembly 129 is slid in a back-side direction (i.e., left-side direction of the drawing), so that a back-side interior-edge portion of the guide hole 141 reaches the back-edge portion of the guide face 123*a* of the guide portion 123. At this time, the actuator 132 of the key assembly 129 is located above and apart from the key switch 115 attached on the key frame 112.

Figure 25C:
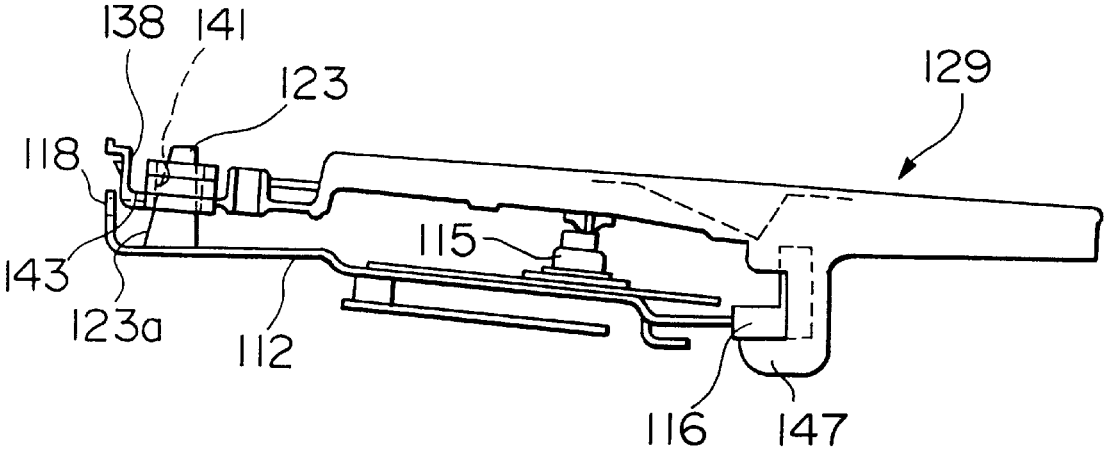

From the state shown in FIG. 25(B), the key assembly 129 is elevated down such that the interior-edge portion of the guide hole 141 slides along the guide face 123*a* of the guide portion 123 as shown in FIG. 25(C). In this case, the back-edge portion of the key assembly 129 is fallen down in a natural fall-down manner while resistance which is effected to the fall-down motion of the key assembly 129 in its horizontal direction is roughly maintained at zero level. Thus, the actuator 132 of the key assembly 129 is fallen down from the above position of the key switch 115, so that the actuator 132 eventually comes in contact with the key switch 115. Therefore, no force is applied to the key switch 115 in a horizontal direction.

Thereafter, under the state where the stopper element 147 of the key assembly 129 (which functions as the upper-limit stopper) is located beneath the lower face of the key guide 116, an upper face 1271 of the common base-edge portion provided for the black key is depressed down so that the projecting claw 139 is elastically hooked with the hole 119 formed in the standing portion 118 of the key frame 112. At this state, a bottom face of the common base-edge portion completely comes in contact with the upper face of the back-edge portion of the key frame 112, so that the fixing relationship is established between the key assembly 129 and the key frame 112 in a horizontal direction as shown in FIG. 21. In short, the keyboard apparatus according to the present embodiment is designed such that at the contact portion to be formed between the key assembly 129 and the key frame 112, a sum of the thickness of the back-edge portion of the guide hole 141 and the projecting length of the projecting portion 143 is set equal to the distance between the standing portion 118 and the guide face 123*a* of the guide portion 123 projected from the key frame 112. Therefore, under the state where the bottom face of the key assembly 129 is in contact with the upper face of the key frame 112, the key assembly 129 cannot be moved in a longitudinal direction of key, so that the horizontal position of the key assembly 129 is securely fixed with respect to the key frame 112. Since the projecting claw 139 of the elastic element 138 is snapped into the claw hole 119 formed through the key frame 112, the vertical motion of the key assembly 129 is regulated, in other words, a drop-out accident of the key assembly 129 can be avoided during the assembling operation. Incidentally, when removing the key assembly 129 from the key frame 112, the pressing element 140 of the elastic element 138 is pressed back against the elastic resistance of the elastic element 138 so that the projecting claw 139 is pulled out from the claw hole 119.

As described above, the projecting portion 143 and the elastic element 138 are located to be sandwiched between the standing portion 118 and the guide face 123*a* of the guide portion 123; and then, the guide hole 141 is fallen down along with the guide face 123*a*, thus, the key assembly 129 is automatically guided to the predetermined position with respect to the key frame 112.

Figure 26A:
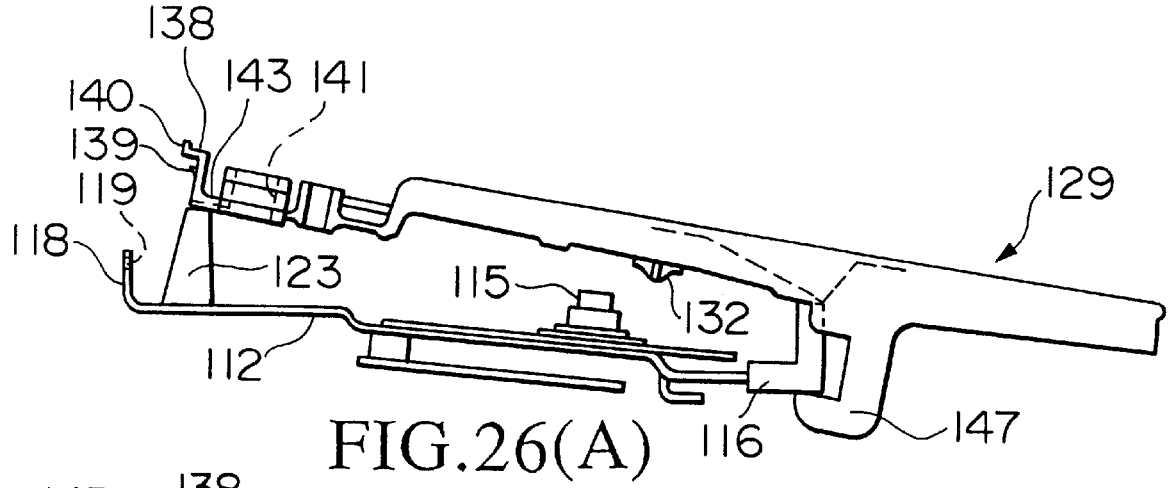
FIGS. 26(A) through 26(D) are side views illustrating another example of the assembling procedure.
Figure 26B:
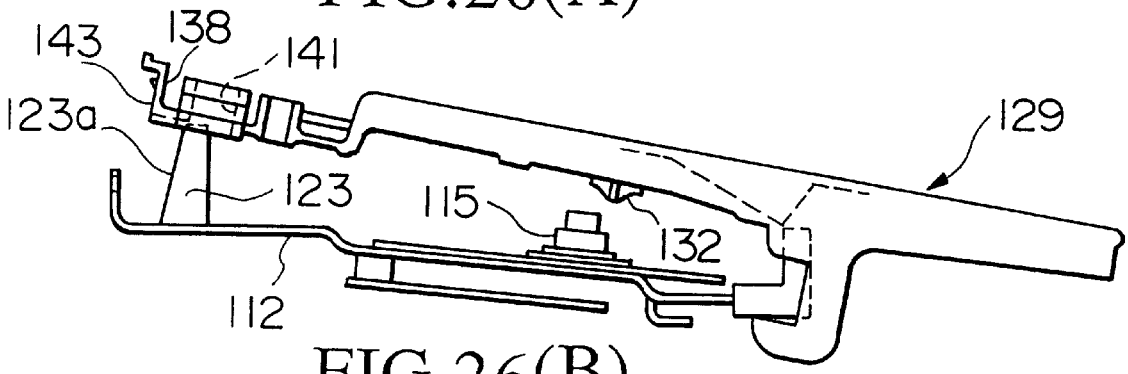
Figure 26C:
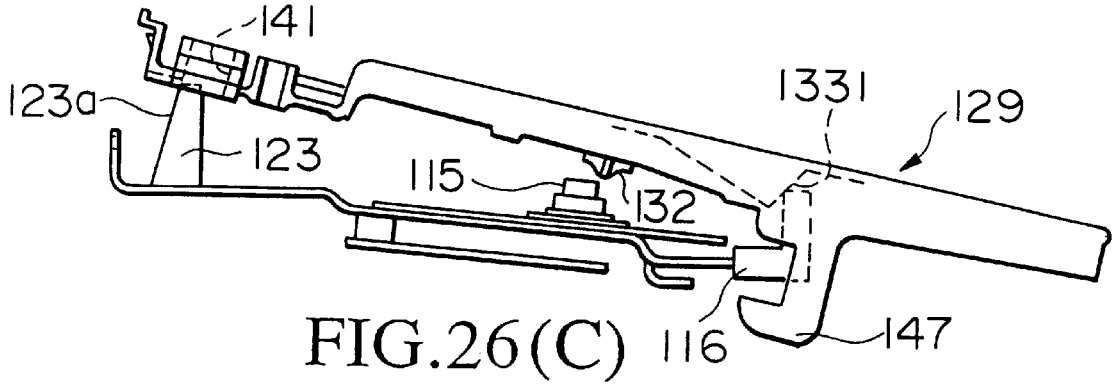
Figure 26D:
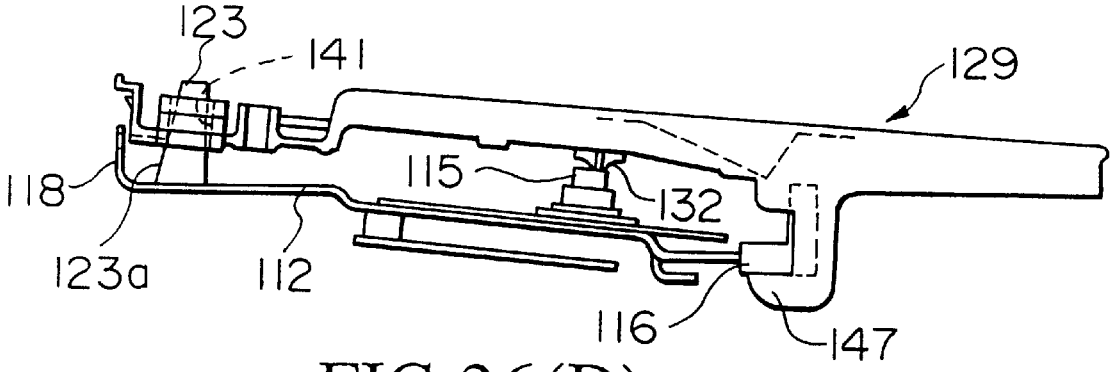

FIGS. 26(A) through 26(D) show another assembling procedure by which the key assembly 129 is assembled together with the key frame 112. The assembling steps as shown in FIGS. 26(A) and 26(B) are similar to those shown in FIGS. 25(A) and 25(B), hence, detailed description for these steps will be omitted. After achieving the assembling step shown in FIG. 26(B), due to the frictional force applied among some parts or a difference between grease-painting states of the key guide 116 and stopper element 147, a fall-down velocity of the key assembly 129 at its front-side portion is different from a fall-down velocity of the key assembly 129 at its back-side portion. In some cases, the slide guide 146 provided at the front-edge portion of the key assembly 129 is fallen down faster prior to the back-edge portion of the key assembly 129. As described above, if the front-edge portion of the key assembly 129 is fallen down faster as compared to the back-edge portion of the key assembly 129, the assembled state will be illustrated in FIG. 26(C). FIG. 26(C) shows the worst state of the key which is badly fallen down. Normally, however, during the fall-down movement of the key, a sharp-inclining portion 1331 of the rib 133 may slightly impart a horizontal component of force to the key assembly 129 so that both of the back-edge portion and front-edge portion of the key are simultaneously fallen down. In short, the worst state as shown in FIG. 26(C) can be avoided in a normal case. However, if the state shown in FIG. 26(C) is occurred, the actuator 132 of the key assembly 129 is fallen down in an approximately natural fall-down manner, so that the actuator 132 may be located above the key switch 115. In this case, the actuator 132 is located slightly apart from the key switch 115. In other words, even if such transition state is occurred, it can be assumed that no force is applied to the key switch 115 in its lateral direction. In the state where the key is falling down, a small horizontal component of force is imparted to the key, resulting that the back-edge portion of the key assembly 129 is continuously fallen down. Thereafter, the back-edge portion of the key assembly 129 is fallen down in a manner similar to that shown in FIG. 25(C). In other words, the key assembly 129 is fallen down in an approximately natural fall-down manner while the interior-edge portion of the guide hole 141 is slid along the guide face 123*a* of the guide portion 123. As a result, a state shown in FIG. 26(D) is obtained. As described above, after the actuator 132 of the key assembly 129 is fallen down from the above position of the key switch 115 attached on the key frame 112, the back-edge portion of the key assembly 129 is further fallen down. Therefore, no force is applied to the key switch 115 in a horizontal direction.

Figure 27:
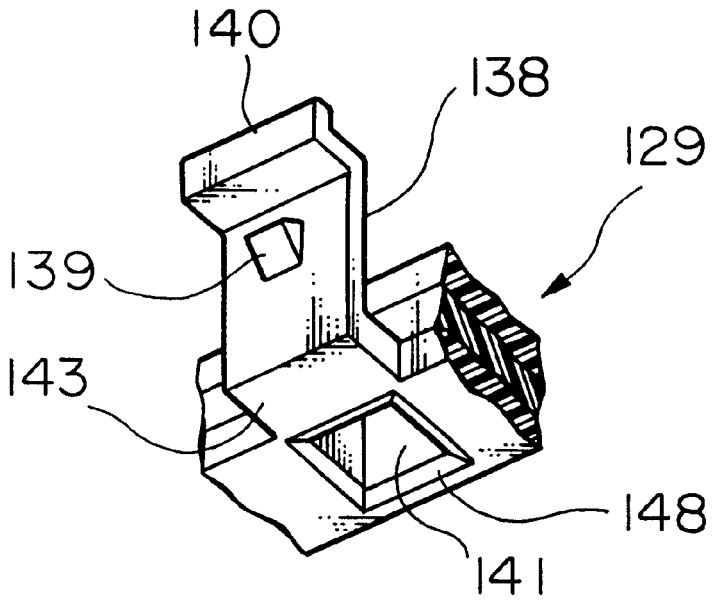
FIG. 27 is a perspective-side view illustrating another example of the key assembly.

FIG. 27 is a perspective-side view illustrating another example of the back-edge portion of the key assembly. In this example, there is no guide channel formed in the projecting portion 143 which projects from the guide hole 141 in its back-side direction. When assembling this key assembly to the key frame, the key is brought to the position as shown in FIG. 25(B) or FIG. 26(B) without being slid on the key frame in advance. From this state, the back-edge portion of the key assembly is fallen down while the interior-edge portion of the guide hole 141 is slid along the guide portion 123 attached on the key frame 112. Thus, as described before in conjunction with FIGS. 25(A) through 25(C) or FIGS. 26(A) through 26(D), the key assembly is fallen down in an approximately natural fall-down manner so that the actuator of the key comes in contact with the upper face of the key switch 115. For this reason, a round portion or a taper 148, which may corresponds to the foregoing round portion or the taper 144 formed in the guide channel 142 (see FIG. 23), is formed in the guide hole 141 in order to broaden the opening of the guide hole 141. In this example, the parts other than the above-mentioned parts are similar to those of the foregoing example, so that the same operations and effects can be achieved.

Figure 28:
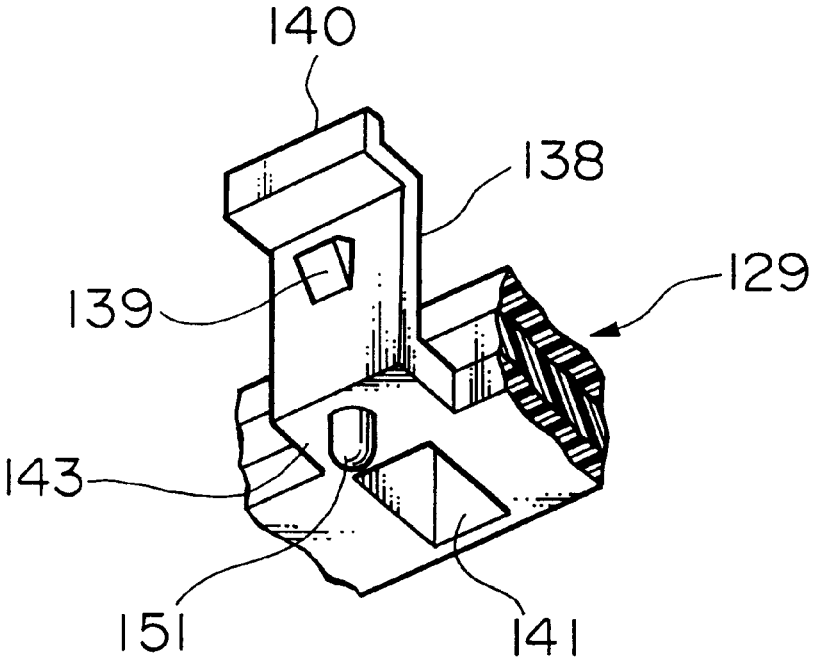
FIG. 28 is a perspective-side view illustrating a still another example of the key assembly.
Figure 29:
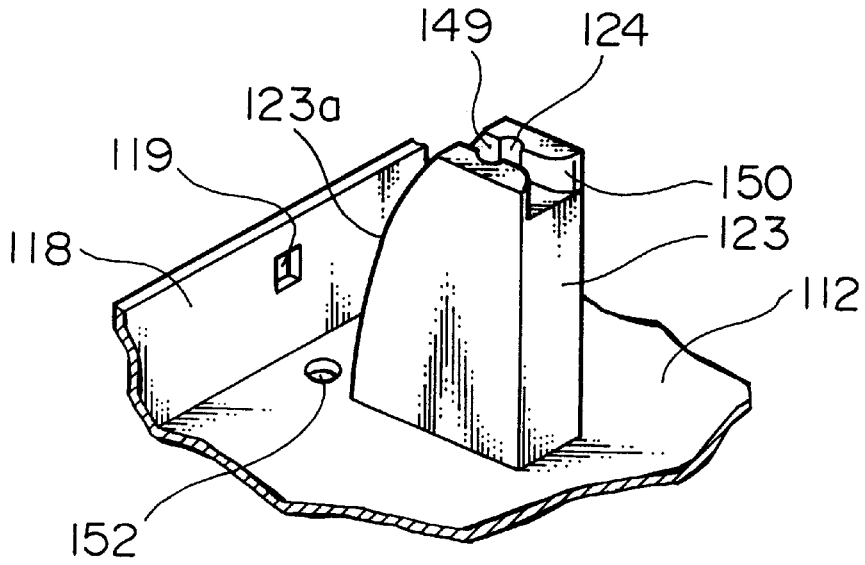
FIG. 29 is a perspective-side view illustrating an example of the key frame which corresponds to the key assembly shown in FIG. 28.

FIG. 28 is a perspective-side view illustrating a still another example of the back-edge portion of the key assembly. FIG. 29 is a perspective-side view illustrating a detailed construction of the guide portion 123, provided on the key frame 112, which corresponds to the key assembly shown in FIG. 28. In this example, the guide portion 123 is made of the resin material, independent of the key frame 112. Or, the guide portion 123 can be formed as one part of the key frame 112. In the key assembly 129, a projection 151 is projected downward from a back-side projecting portion 143 of the guide hole 141. In order to be matched with the projection 151, a guide channel 149 is formed on the upper face of the guide portion 123. At an entry portion of the guide channel 149, a round portion or a taper 150 is formed. The hole 124 is provided to fix the upper case with the key frame 112. At a lower side of the hole 124, a larger through hole (not shown) is provided to be matched with the screw head, and a smaller hole (not shown) conducting the larger hole is also provided so that the screw head will be prevented from being passed therethrough. A positioning hole 152 is formed through the key frame 112 at a position which departs from the back-side face of the guide portion 123. This positioning hole 152 may correspond to the foregoing hole 125 shown in FIG. 20. In the present example, the positioning structure for the key unit is provided between a D key and a D# key.

In the vicinity of the guiding structure (see FIGS. 28 and 29) provided between a G# key and an A key, the above-mentioned projection 151 and the hole 152 are not necessarily formed. Originally, the projection 151 shown in FIG. 28 or the projection corresponding to the hole 125 (see FIG. 20) is provided to overcome the heat contraction of the key unit made by the resin material and the precision error of the through hole formed in the key frame so that the key-depressing motion can be carried out smoothly. In short, these projections are provided as the positioning structure, so that only one positioning point may satisfy the needs of the positioning.

When assembling the above-mentioned key assembly and the key frame together, the key assembly 129 is moved toward the key frame 112, and then, the projection 151 attached to the key assembly 129 is inserted into the opening of the guide channel 149 at which the round portion 150 is formed. Then, the key assembly 129 is slid in a horizontal direction so that the guide hole 141 is guided to the guide portion 123. As similar to the foregoing example, the back-edge portion of the key assembly 129 is fallen down in an approximately natural fall-down manner. At the state where the key assembly 129 is completely fallen down, the projection 151 of the key assembly 129 is inserted into the positioning hole 152 of the key frame 112, while the projecting claw 139 of the elastic element 138 is snapped into the claw hole 119 of the key frame 112. Thus, the positioning of the key assembly 129 can be achieved in both of the longitudinal direction and the lateral direction of the key with respect to the key frame 112. In addition, the key assembly 129 is also securely fixed with the key frame 112 in a vertical direction.

In the present example, both of the guiding structure and the positioning structure are provided at approximately the same position. Thus, it is possible to simultaneously and accurately perform the assembling operation and the positioning operation between the key assembly 129 and the key frame 112. As a result, the assembling operation can be carried out at a high speed and with accuracy. This is a great advantage of the present example.

Figure 30:
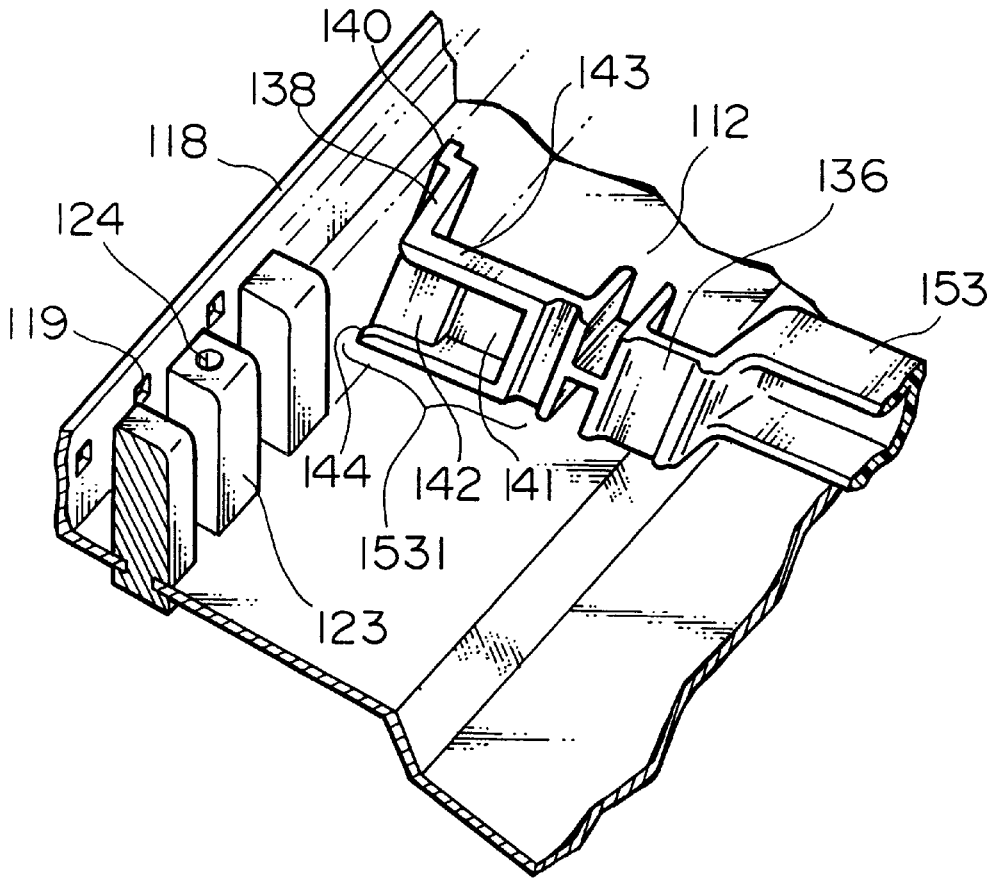
FIG. 30 is a perspective-side view illustrating a further example of the key assembly and the key frame which are not assembled together.

FIG. 30 is a perspective-side view illustrating a further example of the back-edge portion of the keyboard apparatus. According to this example, each of the keys is independently attached to the key frame 112. At a common base-edge portion 1531 of a key 153, there are provided the guide hole 141 having the projecting portion 143 at its back-side portion, the guide channel 142, the elastic element 138, the pressing element 140 and the like as similar to the foregoing examples. In the vicinity of the back-edge portion of the key frame 112, there is provided one guide portion 123 which corresponds to one key. The guide portion 123 can be formed by the resin material, independent of the key frame 112. Or, the guide portion 123 can be formed as one part of the key frame. In FIG. 30, the illustration of the guide rib 133 by which the key is slid in a horizontal direction is omitted from the illustration of the key 153.

Further, the holes 124 for fixing the upper case with the key frame are formed on the upper face of the guide portion 123 by appropriate spacing. For example, two fixing holes 124 are provided for one octave, and they are located at positions which respectively correspond to the D key and the A key within one-octave keys. In FIG. 30, the back-side face of the guide portion 123 vertically stands on the key frame 112. However, it is possible to modify the guide portion 123 such that its back-side face is inclined with respect to the key frame 112 or formed in an circular arc shape.

Figure 31A:
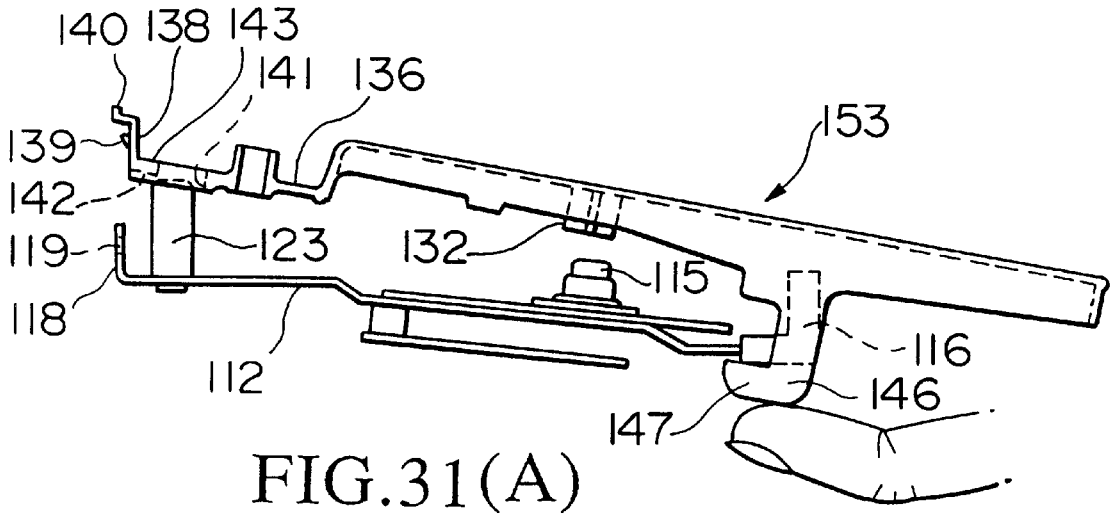
FIGS. 31(A) through 31(C) are side views illustrating an example of the assembling procedure by which the key assembly and the key frame shown in FIG. 30 are assembled together.
Figure 31B:
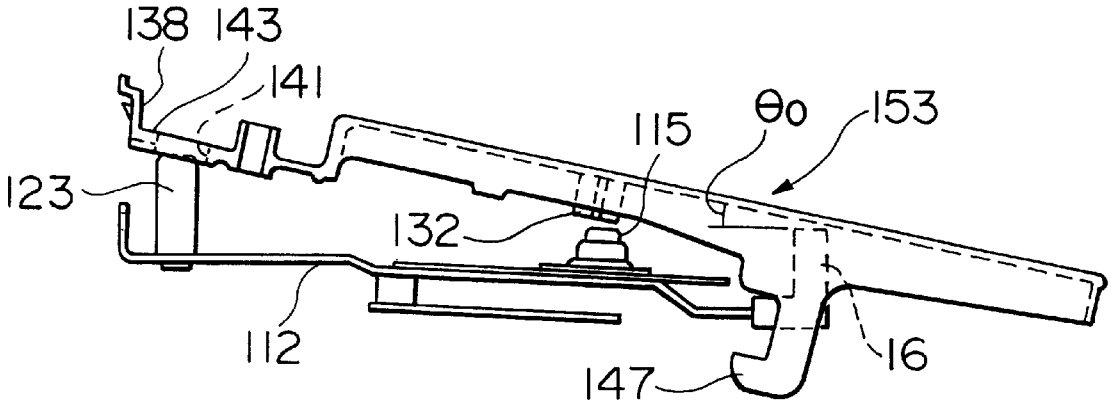
Figure 31C:
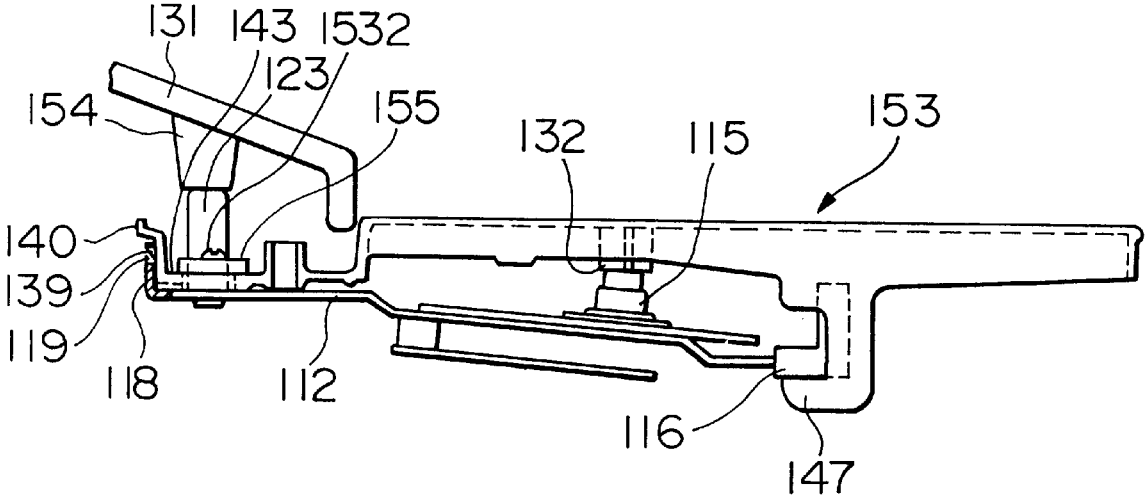

Next, the assembling procedure by which the key 153 is assembled with the key frame 112 in accordance with the present example will be described by referring to FIGS. 31(A) through 31(C). There are provided a plurality of assembling procedures for the present example, therefore, the detailed description will be given with respect to each of them.

(1) First Assembling Procedure

At first, the key 153 is brought to a certain position while being supported by a finger, so that the projecting portion 143 of the key 153 reaches the upper face of the guide portion 123 attached to the key frame 112. By further being supported by the finger, the guide channel 142 of the key 153 is slid on the guide portion 123 so that the key 153 is moved to a dropping point as shown in FIG. 31(A). At this dropping point, the actuator 132 is located just above the key switch 115. At the same time or slightly delayed from the time when the guide portion 123 is started to be inserted into the guide hole 141, the finger is separated from the key 153. Then, the back-edge portion of the key 153 is fallen down in an approximately natural fall-down manner, so that the key 153 comes in contact with the key frame 112. Thereafter, the common base-edge portion 1531 of the key 153 is pressed down so that the projecting claw 139 is snapped into the claw hole 119. Thus, the key 153 is completely assembled together with the key frame 112.

Figure 34:
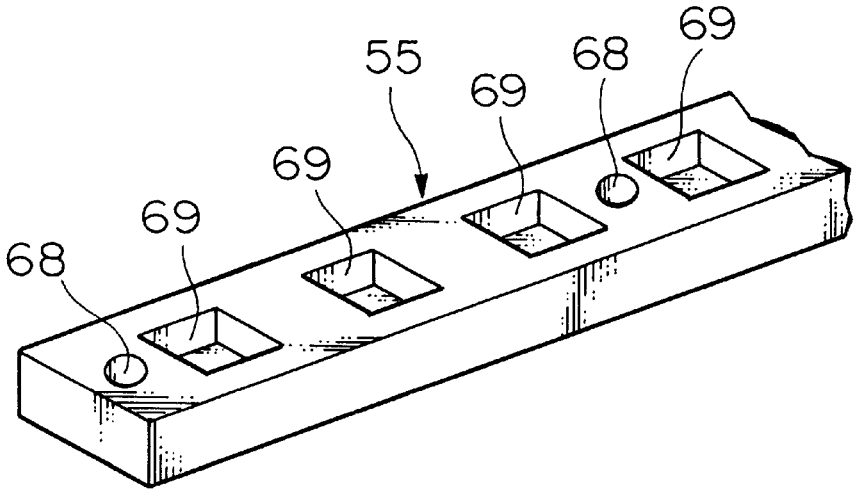
FIG. 34 is a perspective-side view illustrating an example of a fixing plate which is used for the keyboard apparatus shown in FIG. 30.

The above-mentioned assembling operation is repeatedly performed with respect to each of the keys. After completely assembling all of the keys with the key frame together, a common fixing plate 155 (see FIG. 34) of which length matches with the whole length of the keyboard is pressed and fixed to the back-edge portions of the keys. When being fixed with the upper case, the key frame to which the keys are fixed is reversed and located above the upper case. In this case, a screw is inserted through a boss 154 and also inserted into the hole 124 of the guide member 123 attached to the key frame 112, so that the upper case is screwed with the key frame 112. The fixing plate 155 provides a plurality of through holes 169 and a plurality of screw holes 168. The number of the through holes 169 is set equal to the number of the guide portions 123, while the number of the screw holes 168 can be adjusted such that one screw hole 168 can be provided for one, two or three keys. The fixing plate 155 is placed above on the common base-edge portions 1531, so that the common base-edge portions 1531 are sandwiched between the fixing plate 155 and the key frame 112. Then, a screw 1532 is inserted into the screw hole 168, and consequently, the fixing plate 155 is securely fixed with the key frame 112 by means of the common base-edge portions 1531.

(2) Second Assembling Procedure

At first, the key 153 is held by a human hand or an robot arm, and then, the key 153 is mounted on the key frame 112 such that the common base-edge portion 1531 is located on the upper face of the guide portion 123 while the slide guide 146 is located in the vicinity of the key guide 116. At this state, the guide channel 142 is located at the head portion of the guide portion 123. An angle $\theta$ is formed between a horizontal portion 1121 of the key frame 112 and the surface of the key 153. In the above-mentioned state, such angle $\theta$ is defined as "$\theta_1$". From this state, as a free-edge portion of the key 153 is moved backward by the human hand or robot arm, the angle $\theta$ is gradually increased. At a time when the back-edge portion of the guide hole 141 reaches the back-edge portion of the guide portion 123, this angle $\theta$ can be defined as follows: $\theta=\theta_0>\theta_1$. This state is shown in FIG. 31(B), wherein the back-edge portion of the key 153 is located just before the fall-down point. At this state, the height of the guide portion 123 or the height of the actuator 132 is determined such that the actuator 132 does not come in contact with the key switch 115 and the actuator 132 is located slightly apart from the key switch 115. Thereafter, the key 153 is further and slightly pressed backward so that the back-edge portion of the key 153 is fallen down so as to come in contact with the key frame 112. The next steps of this assembling procedure are similar to those of the foregoing assembling procedure, so that the description thereof will be omitted.

Next, superior features of the present embodiment will be described in detail. In general, when considering the number of the parts, switch-driving precision and whole thickness of the keyboard apparatus, it is necessary to construct the keyboard apparatus such that the key is not located apart from the key frame so much while the height of the boss 123 is formed lower.

In the present embodiment, the angle $\theta$ is set equal to $\theta_1$ before the key is slid backward, while this angle $\theta$ becomes equal to $\theta_0$, where $\theta_0>\theta_1$.

It is desirable that just before the fall-down motion of the key, the actuator 132 is located slightly apart from the key switch 115. Even if the distance between the actuator and the key switch is set at 1 mm when actually designing the construction of the keyboard apparatus, such distance should be increased to 2 mm in order to cope with the manufacturing errors of the keyboard apparatus. In this case, the distance between the actuator and the key switch is merely increased by 1 mm, however, the height of the guide portion 123 should be increased by 5 mm or 6 mm because the height of the guide portion 123 is varied in proportional to the increase of the distance between the actuator and the key switch. In the present example, a vertical position relationship is intensely maintained between the actuator 132 and the key switch 115 just before the assembling operation is carried out, in other words, just before the key is fallen down. Therefore, an allowable range for the distance between them can be reduced, so that the distance between them can be set at 1 mm. Even if such small distance of 1 mm is roughly cleared to zero when actually constructing the keyboard apparatus, small play is existed between the guide portion 123 and the guide hole 141, so that even if the actuator 132 slightly presses the key switch 115 in its lateral direction until the fall-down motion of the key is started, such pressing force can be perfectly cleared just before the fall-down motion of the key. Therefore, it is possible to improve the relationship between the key and the key frame. Moreover, it is possible to manufacture the thickness of the keyboard apparatus smaller.

Figure 32:
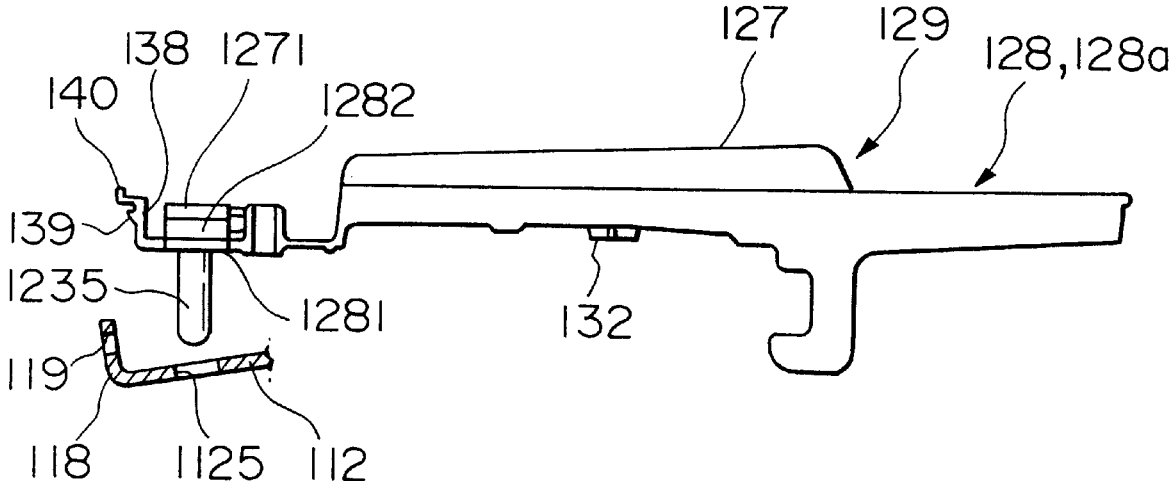
FIG. 32 is a side view illustrating a still further example of the keyboard apparatus.

FIG. 32 is a side view illustrating a still further example of the keyboard apparatus. According to a first feature of this example, the assembling operation and the positioning operation for the key unit and the key frame can be carried out simultaneously or at once. According to a second feature, a guide portion is attached to the key. When assembling the key unit and the key frame together, a temporary stopper can help the assembling operation to be carried out faster. For this reason, the present example provides a projecting portion 1235 which functions to perform both of the operation of the guide portion and the operation of the temporary stopper, wherein a lower-edge portion of the projecting portion 1235 is formed round. This projecting portion 1235 is projected downward from the lower face of the common base-edge portion 1281 of the key unit. More specifically, one projecting portion is provided between the D key and the D# key, while another projecting portion is provided between the G# key and the A key. A concave portion (or a through hole) 1125 is formed in the key frame 112, wherein the shape of the concave portion 1125 is designed to be matched with the round shape of the projecting portion 1235. Other parts of this example are similar to those of the foregoing examples (see FIGS. 20, 21, 22, 25(A) through 25(C) and 26(A) through 26(D)), hence, the description thereof will be omitted.

The projecting portion 1235 is guided by the concave portion 1125, and then, temporarily stopped by the key frame 112. When the projecting portion 1235 is fixed at a certain position on the key frame 112, the claw 139 is snapped into the claw hole 119 formed through the standing portion 118. The projecting portion 1235 is fixed at a contact point at which the front-edge face thereof comes in contact with the front-edge face of the concave portion 1125, while the back-side face of the elastic element 138 is fixed with the standing portion 118 such that they are pressed by each other. By raising the matching precision between the claw hole 119 and the claw 139, it is possible to completely perform the positioning operation between the key unit and the key frame. In this case, the key unit and the key frame are fixed together in all of the directions such as the width direction of key, longitudinal direction of key and vertical direction of key. Incidentally, such positioning can be performed well by merely raising the matching precision with respect to one of two pairs of the claw holes 119 and claw 139, so that in another pair of the claw hole and claw, the claw hole can be slightly enlarged in the width direction of key. The present example provides two pairs of the projecting portions and concave portions with respect to the key units which are provided within one-octave range of the keyboard. In order to regulate the movement of the key units in the width direction of key, one pair of the projecting portion and concave portion is provided as a first engaging structure in which the width of the projecting portion is formed to be well matched with the width of the concave portion, while some play is provided for another pair of the projecting portion and concave portion. In the vicinity of the first engaging structure, a pair of the claw 139 and claw hole 119 is provided as a second engaging structure. Due to the provision of the first and second engaging structures, it is possible to completely determine the positioning relationship between the key unit and the key frame.

Figure 33:
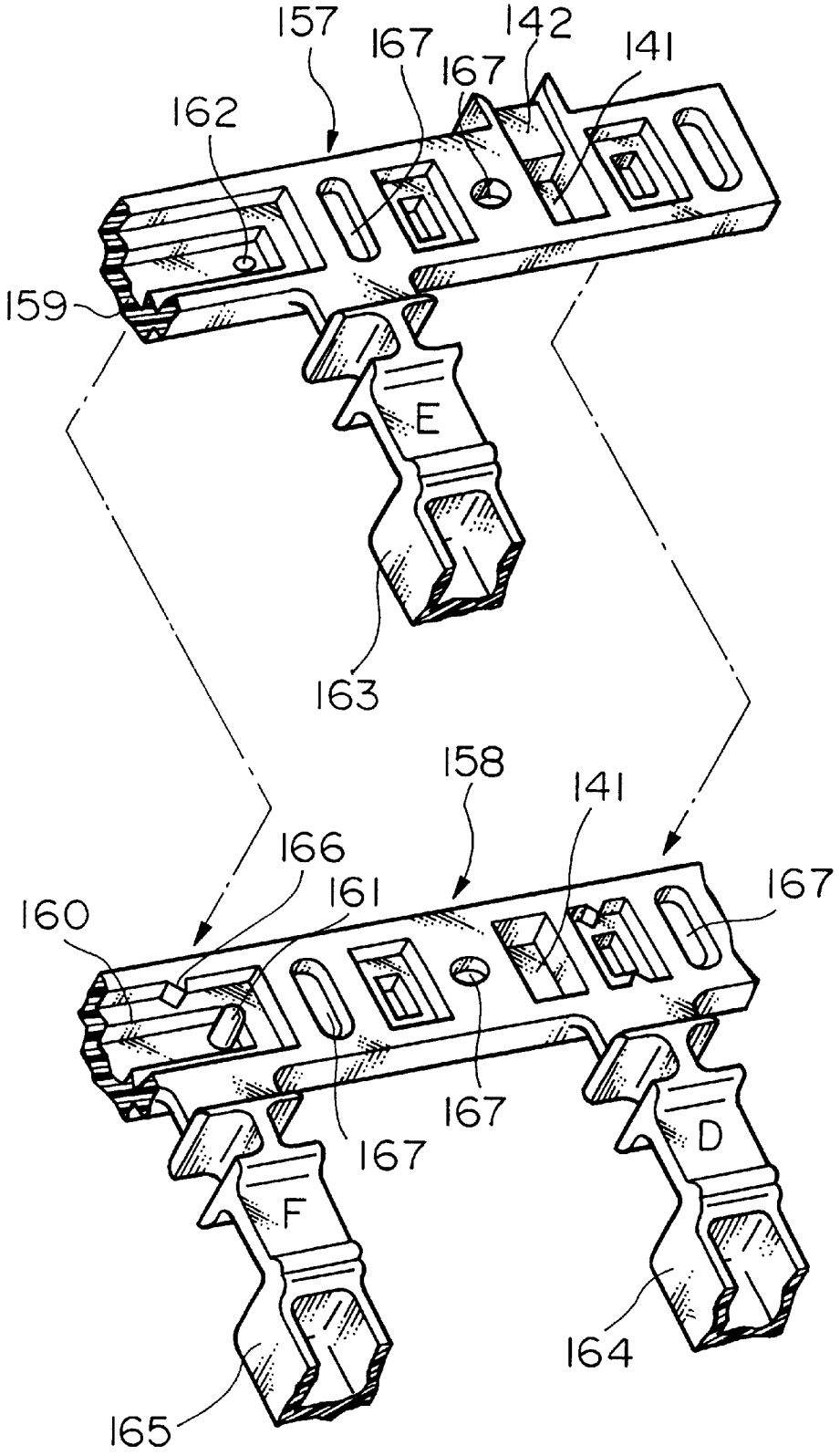
FIG. 33 is a exploded view partially illustrating the back-edge portions of the key units which are assembled together.

FIG. 33 is an exploded view illustrating the back-edge portion of the key assembly of the keyboard apparatus. Herein, two key units 157 and 158 to be assembled together are illustrated, wherein the key unit 157 provides a C key, an E key 163, a G key and a B key (wherein C, G and B keys are not shown), while another key unit 158 provides a D key 164, a F key 165 and an A key (not shown). The illustration of the black-key unit is omitted, however, it may be located beneath the key unit 158. In the exploded view, the back-key unit is located at the lowest position as compared to the white-key blocks, however, in the assembled view as shown in FIGS. 21 and 22, the black-key unit is located at the highest position. A plurality of projecting portions 159 are formed in the key unit 157 providing the E key 163. A plurality of concave portions 160, each of which corresponds to each of the projecting portions 159, are formed in the key unit 158 which will be assembled together with the key unit 157. In each of the concave portions 160, a rib 166 is formed. When the projecting portion 159 is engaged with the concave portion 160, the rib 166 is deformed while somewhat damaging the outside wall of the projecting portion 159. Thus, both of them is securely fixed together while both of them is pressed against each other by means of the rib 166. A numeral 161 designates a projection which is used for determining the positioning relationship between the key units 157 and 158. The projection 161 provided in the concave portion 160 of the key unit 158 is to be inserted into a positioning hole 162 formed through an upper wall of the projecting portion 159 of the key unit 157. In each of the key units 157 and 158, a plurality of through holes 167 is formed. Each of the through holes 167 of the key unit 157 matches with each of the through holes 167 of the key unit 158. These through holes 167 are provided as screw holes. By inserting the screw 137 (see FIG. 21) into the screw hole, the key assembly consisting of the key units is securely fixed with the key frame.

In the key unit 157 which will be located at the lowest position when all of the key units are assembled together, the guide channel 142 and the guide hole 141 are formed. In another key unit 158, another guide hole 141 is formed to be matched with the guide hole 141 of the key unit 157. As similar to the foregoing key assembly, the key assembly as shown in FIG. 33 can be assembled together with the key frame by dropping the guide hole 141 along with the guide portion of the key frame without deforming the key switch.

[C] Third Embodiment

The key assembly according to the third embodiment is shown by the foregoing exploded view of FIG. 19. Herein, a through hole 208 is newly used. When fixing the key assembly to the main body of the musical instrument, a screw is inserted through the through holes 208.

The sectional shape of the rib 38 is made substantially triangular, and the rib 38 extends in a vertical direction along the interior wall of the concave portion 37. In order to obtain an adequate pressure which is applied between the outside wall of the projecting portion 33 and the interior wall of the concave portion 37 by the ribs 38 when two key units (i.e., key blocks) 22 and 23 are assembled together, a vertical angle of the triangular-shaped rib 38 is set equal to 90°, while its height is set in a range of 0.1 mm to 0.2 mm, for example. In order to smoothly perform the inserting operation between the projecting portion 33 and the concave portion 37, it is desirable to form a round portion having R=0.3 mm at the entry edge portion of the concave portion 37.

Figure 35:
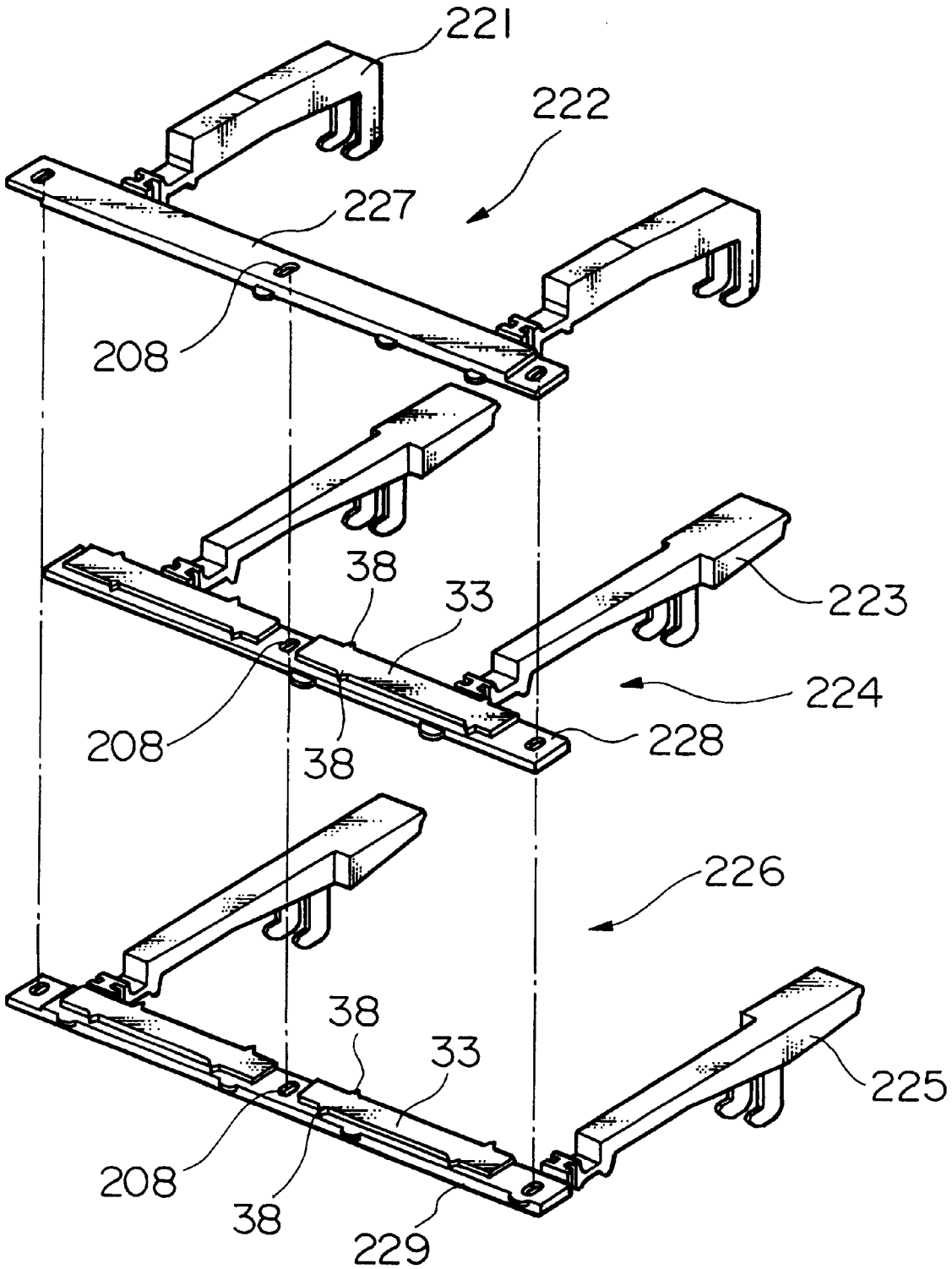
FIG. 35 is an exploded view illustrating three key units which are assembled together in accordance with a third embodiment of the present invention.

FIG. 35 is a exploded perspective-side view illustrating a modified example of the third embodiment. In this example, the above-mentioned rib 38 is formed at the outside face of the projecting portion 33. Herein, there are provided three key units, i.e., one black-key unit 222 and two white-key units 224 and 226. These three key units 222, 224 and 226 are assembled together to form a one-octave section of the keyboard. In the black-key unit 222, a plurality of black keys 221 are supported by a common base-edge portion 227 such that they can be swung freely. The interior portion (not shown in FIG. 35) of the common base-edge portion 227 is formed as the foregoing concave portion, into which the projecting portion 33 of the white-key unit 224 is to be inserted. In FIG. 35, only two black keys 221 are illustrated, however, there are actually provided five black keys which correspond to the notes of C#, D#, F#, G# and A# respectively. A plurality of white keys 223 are attached to a common base-edge portion 228 of the white-key unit 224 such that they can be freely swung. In FIG. 35, only two white keys 223 are illustrated, however, there are actually provided three white keys which correspond to the notes of D, F and A respectively. Similarly, a plurality of white keys 225 are attached to a common base-edge portion 229 of the white-key unit 226 such that they can be freely swung. In FIG. 35, only two white keys 225 are illustrated, however, there are actually provided four white keys which correspond to the notes of C, E, G and B respectively.

In the third embodiment as shown in FIG. 19 or 35, two ribs 38 are respectively formed at both-side walls of the concave portion 37 or of the projecting portion 33. However, it is possible to provide only one rib 38 for one concave portion 37 or one projecting portion 33. Of course, the location, size or attaching interval of the rib 38 can be arbitrarily changed. The shape of the rib 38 is not limited to the aforementioned triangular shape. Thus, it is possible to modify the shape of the rib 38 into a semi-circular cylindrical shape, a semi-spherical shape or the like.

[D] Fourth Embodiment

Next, the detailed description will be given with respect to a fourth embodiment of the present invention by referring to FIGS. 36 through 38. This embodiment is provided to avoid conducting errors of the circuit elements mounted on the circuit board. More specifically, a predetermined kind of lubricant such as the grease is painted at a sliding contact portion of the key guide in order to prevent the undesirable sounds from being occurred when the key is depressed down while being guided by the key guide. In some cases, however, the lubricant may flow over to the circuit board so as to cause the conducting errors of the switching elements provided on the circuit board. In order to overcome such drawback, the fourth embodiment is characterized by providing a special structure (e.g., rib) for avoiding the flow of the lubricant toward the circuit elements.

Figure 36:
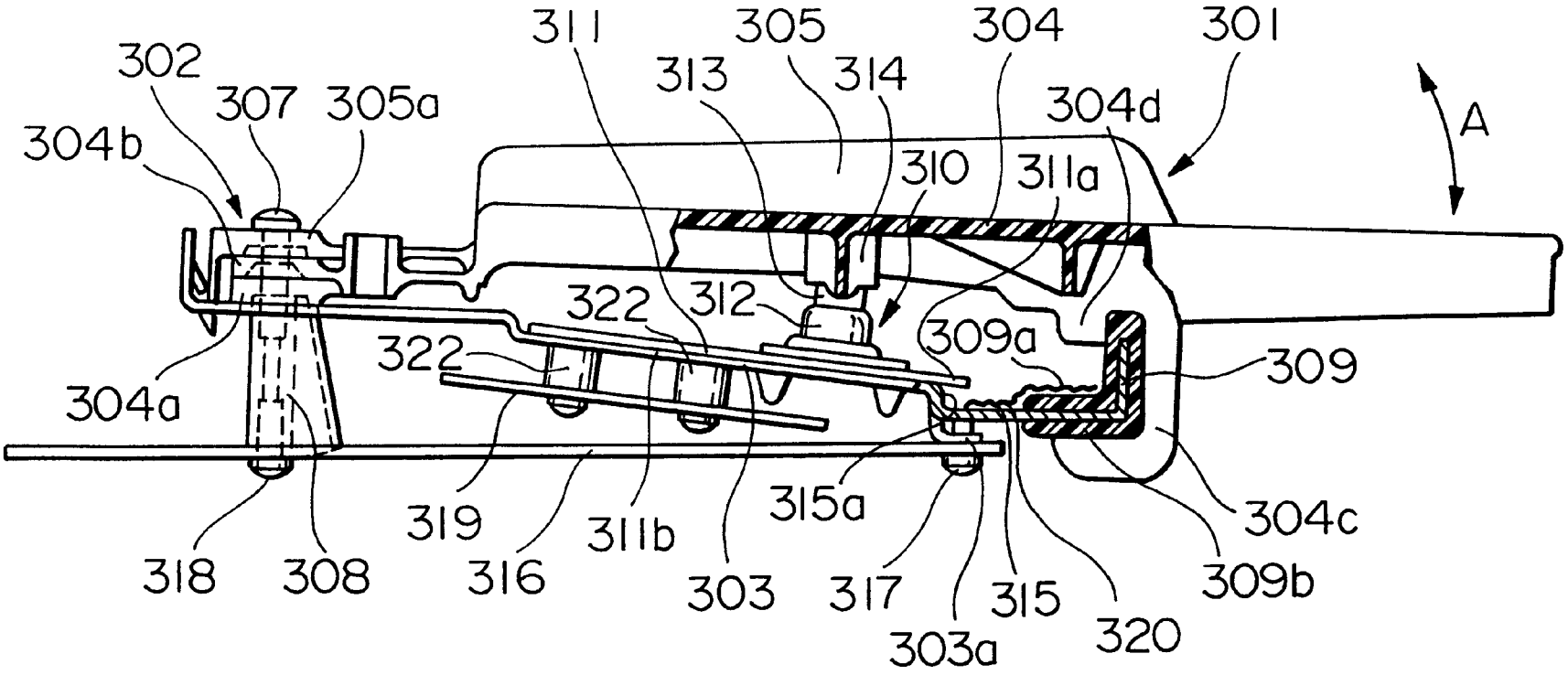
FIG. 36 is a sectional view illustrating an essential part of the keyboard apparatus according to a fourth embodiment of the present invention.

FIG. 36 is a sectional view illustrating an essential part of the keyboard apparatus according to the fourth embodiment of the present invention which is applied to the electronic musical instrument.

This keyboard apparatus provides a key 301 and a key frame 303. The key-depression event of the key 301 is sensed by a key switch 310. The key frame 303 supports and fixes a back-edge portion of the key 301. The key frame 303 is made by a metal plate having an elastic stability by which the key 301 is supported such that the key 301 can be swung up and down in a key-depression/release direction (see an arrow A).

The keys 301 contain a white key 304 and a black key 305, each of which is made by the resin material and also formed in a block-like shape. A predetermined number of white keys and black keys which correspond to one-octave or half-octave section of the keyboard are disposed in parallel in one key unit.

Similar to the foregoing embodiments, the fourth embodiment provides three common base-edge portions which are piled up together at the back-edge portion of the key 301. Herein, each of two common base-edge portions 304*a* and 304*b* corresponds to the white keys, while one common base-edge portion 305*a* corresponds to the black keys.

A through hole is formed through three common base-edge portions 304*a*, 304*b* and 305. In response to a supporting point 302 of the key 301, a boss 308 is attached to and partially inserted into a lower face of the key frame 303. Then, a screw 307 is inserted through the through hole and screwed into the boss 308. Thus, the boss 308 is securely fixed beneath the lower face of the key frame 303, while three common base-edge portions 304*a*, 304*b* and 305 are also securely fixed onto an upper face of the key frame 303.

Both-side walls of a front portion (see right-side portion) of the white key 304 are partially projected down to form stopper elements 304*c* each having a letter "L" like shape. A key guide 309 is provided with respect to a pair of the stopper elements 304*c*. In the present embodiment, a certain part of a front-edge portion of the key frame 303 is formed with a width which is slightly smaller than the width of the key 304; and then, such part is folded and bent so that a tip edge portion is projected upward to the lower-side face of the key; thereafter, the outside portion of the folded portion of the key frame 303 is covered by a guide member which is made by the resin material (e.g., sound absorbing material such as the flexible elastomer or foaming agent) so as to form the key guide 309. At both-side faces of the key guide 309 which are slid with the white key 304, the lubricant is painted. Interior walls of the stopper elements 304*c* are slid along the both-side faces of the key guide 309. Such sliding operation prevents the lateral swinging motion of the key from being occurred when moving the key up and down in the key-depression/release direction.

Similar to the white key 304, the black key 305 provides the stopper elements similar to the aforementioned stopper elements 304*c*. In response to these stopper elements of the back key 305, another key guide 309 is formed at the front-edge portion of the key frame 303.

On a surface of the key frame 303 facing with the lower face of the white key 304, a circuit board 311 is attached. Or, this circuit board 311 can be located close to the key frame 303. Switch contacts and the like are mounted on the circuit board 311. Two key switches 310 respectively corresponding to the white key 304 and the black key 305 are mounted on the circuit board 311.

As similar to the foregoing key switches, the key switch 310 consists of a fixed contact and a movable contact. The fixed contact is formed on the circuit board 311, while the movable contact is included in an inside portion of an elastic projecting member 312. For example, the fixed contact is constructed by a pair of non-conductive elements each having a comb-like shape or a letter "E" like shape, wherein these elements are arranged in parallel on the circuit board 311. Peripheral portions of these elements are enclosed by circular carbon printings.

In the elastic projecting member 312, a cylindrical projection is formed to be projected downward. At a lower-edge face of this cylindrical projection, the movable contact is formed so that the movable contact faces the fixed contact in parallel. The movable contact having a circular shape is made by a conductive elastic material such as the conductive rubber.

The elastic projecting member 312 is formed by the flexible elastic material such as the rubber as a whole. An annulus ring portion 313 is formed at the upper portion of the elastic projecting member 312, while an actuator 314 is projected downward from the lower face of the white key 304 (or black key 305). When the key is depressed down, the actuator 314 depresses down the annulus ring portion 313, and consequently, the elastic projecting portion 312 is elastically deformed so that the movable contact is elevated down to be in touch with the fixed contact formed on the circuit board 311, thus conducting the key switch 310. Then, the musical tone is sounded.

Meanwhile, a stage-difference portion 315 is formed at a certain portion of the key frame 303 between the key guide 309 and a free-edge portion 311*a* of the circuit board 311. This stage-difference portion 315 continuously extends in a disposing direction of the keys. A vertical level of the stage-difference portion 315 is lower than that of the circuit board 311.

The circuit board 311 is fixed on the key frame 303 such that the free-edge portion 311*a* thereof is slightly projected toward the key guide 309 from a wall portion 315*a* of the stage-difference portion 315.

Beneath the stage-difference portion 315 of the key frame 303, a screw base 303*a* is formed. The screw base 303*a* of which screw hole is formed in a downward direction is fixed with one edge portion of a main frame 316 by a screw 317. The foregoing boss 308 is fixed at the other edge portion of the main frame 316 by a screw 318. Thus, the keyboard apparatus as a whole is securely fixed with the main frame 316.

A key stopper portion 304*d* is projected downward from the white key 304 in the vicinity of the stopper elements

304*c*, while a lower-limit stopper 309*a* which regulates the swinging motion of the white key 304 in the key-depression direction is formed as a certain part of the upper face of the key guide 309. When the key stopper portion 304*d* comes in contact with the lower-limit stopper 309*a*, the lower-side location of the white key 304 is limited when the white key 304 is depressed down. On the other hand, an upper-limit stopper 309*b* is formed as a certain part of the lower face of the key guide 309. When the stopper elements 304*c* come in contact with the upper-limit stopper 309*b* while the white key 304 is returned from the key-depressed position, the upper-side location of the white key 304 is limited.

Similarly, the lower-side location and upper-side location of the black key 305 are limited by the lower-limit stopper and the upper-limit stopper respectively.

At a lower face of the key frame 303, a sub circuit board 319 is fixed by screws with are respectively inserted into plural bosses 322.

As described above, since the circuit board 311 is located close to the key guide 309, there is a possibility in that a small amount of lubricant 320 which is painted on the both-side walls of the key guide 309 may be gradually flown over toward the circuit board 311. In some cases, the lubricant 320 to be flown over may cause the conducting errors on the contacts of the key switch 310.

In order to avoid the lateral swinging movement of the key, gaps formed between the both-side walls of the key guide 309 and the interior walls of the white key 304 (or black key 305) must be minimized. When assembling the white key 304 with the key frame 303, the stopper elements 304*c* of the white key 304 are located such that they are partially overlapped with the key guide 309 at first; and then, the white key 304 is pressed in a left-side direction of FIG. 36. At this time, the stopper elements 304*c* may partially rub off the lubricant 320 painted on the both-side walls of the key guide 309, so that the rubbed lubricant may be easily moved toward the circuit board 311.

According to the present embodiment, however, even if the lubricant 320 is flown over to the circuit board 311 from the key guide 309, the stage-difference portion 315 which is existed between the key guide 309 and the free-edge portion 311*a* of the circuit board 311 functions to stop the flow of the lubricant 320, so that the flown lubricant will not be reached to the upper face of the circuit board 311.

Further, the circuit board 311 of the present embodiment is located such that the free-edge portion 311*a* thereof is slightly projected toward the key guide 309 from the wall portion 315*a* of the stage-difference portion 315. This location of the circuit board 311 further avoids the flow of the lubricant 320 to be reaching the circuit board 311.

Therefore, the lubricant 320 is not flown to the contacts of the key switch 310 mounted on the circuit board 311. Thus, the conducting errors of the key switch 310 is not occurred.

Incidentally, the location of the circuit board 311 can be modified such that the free-edge portion 311*a* thereof is not projected from the wall portion 315*a* of the stage-difference portion 315. Even in such modified location of the circuit board 311, the stage-difference portion 315 can satisfy the needs of avoiding the flow of the lubricant 320 to be flown to the circuit board 311.

Figure 37:
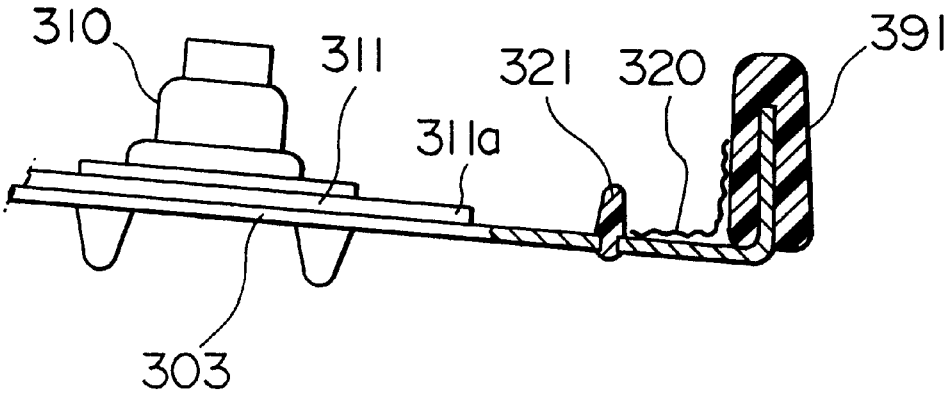
FIG. 37 is a side view illustrating an essential part of the keyboard apparatus according to a modified example of the fourth embodiment.

FIG. 37 is a side view illustrating an essential part of another example of the key frame 303, wherein parts identical to those shown in FIG. 36 will be designated by the same numerals.

As compared to the fourth embodiment shown in FIG. 36, this example is characterized by providing a rib 321 instead of the stage-difference portion 315. This rib 321 is provided between the free-edge portion 311*a* of the circuit board 311 and a key guide 391. The rib 321 is provided to prevent the lubricant 320 from being flown over toward the key switch 310.

Even if the lubricant 320 painted on the key guide 391 is to be flown over toward the circuit board 311, the rib 321 can stop the flow of the lubricant 320, so that the lubricant 320 is no longer flown over to the circuit board 311. As similar to the foregoing embodiment providing the stage-difference portion 315, the present example providing the rib 321 can prevent the lubricant 320 from being flown to the contacts of the key switch 310, in other words, it is possible to avoid the conducting error of the key switch 310.

Incidentally, the rib 321 can be formed by the resin material, independent of the key frame 303, so that the rib 321 is tightly attached to the key frame 303. Or, the rib 321 can be formed as a part of the key frame 303. In that case, a certain part of the key frame 303 made of the metal plate is bent upward to form the rib 321 by the drawing process and the like.

It is possible to further modify the present example such that both of the stage-difference portion 315 and the rib 321 are provided. In this case, the stage-difference portion as shown in FIG. 36 is formed on the key frame 303 at a position between the circuit board 311 and the key guide 391, while the rib 321 is planted on a bottom face of the stage-difference portion 315 so as to prevent the lubricant 320 from being flown over to the circuit board 311.

According to the above-mentioned modification, even if the lubricant 320 painted on the key guide 391 is flown over toward the circuit board 311, and then, the flown lubricant exceeds over the rib 321, the flown lubricant must be stopped by the wall portion 315*a* of the stage-difference portion 315. In short, the flown lubricant can be prevented from being reached to the upper face of the circuit board 311, and consequently, it is possible to certainly avoid the conducting errors to be occurred on the contacts formed on the circuit board 311.

Figure 38:
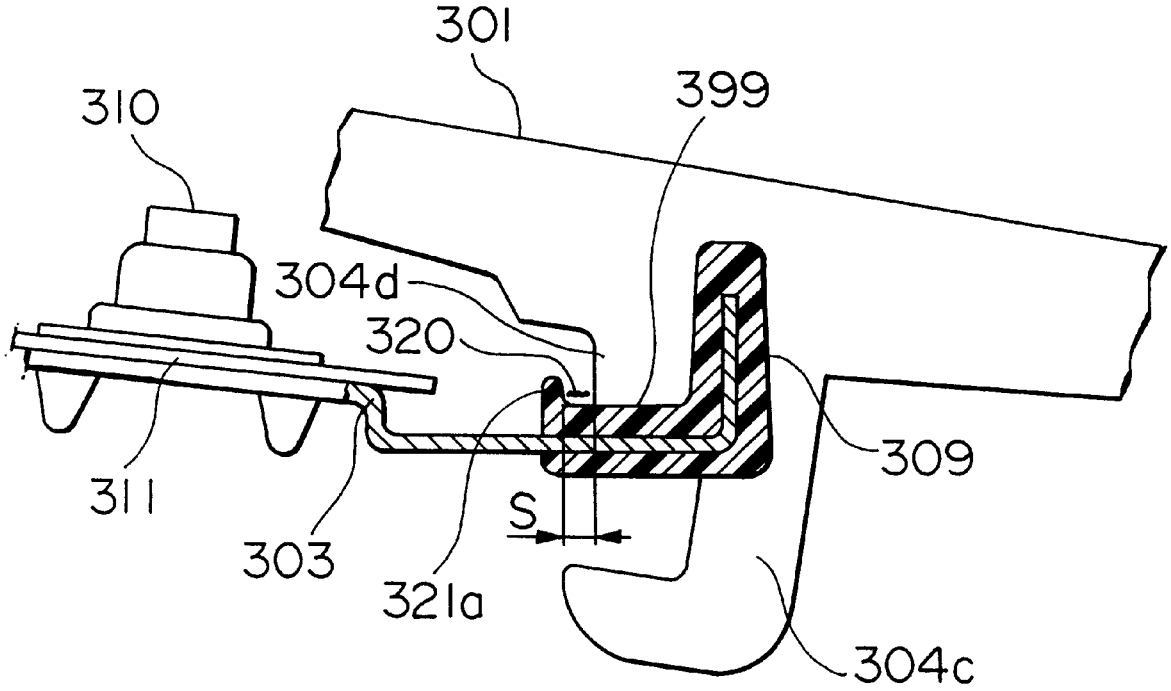
FIG. 38 is a side view illustrating an essential part of the keyboard apparatus according to another modified example of the fourth embodiment.

FIG. 38 is a side view illustrating an essential part of a still another example of the key frame 303 and the key 301, wherein parts identical to those shown in FIG. 3B will be designated by the same numerals.

Different from the foregoing embodiment shown in FIG. 36, a rib 321*a* for avoiding the flow of the lubricant 320 is projected from an upper-edge portion, facing with the circuit board 311, of the key guide 309 in which a lower-limit stopper 399 is formed as a part of the key guide 309.

As similar to the foregoing embodiment and the modified examples, the rib 321*a* of the present example can prevent the lubricant 320 flown from the key guide 309 from being flown over to the circuit board 311. Since both of the rib 321*a* and the lower-limit stopper 399 are formed as parts of the key guide 309, it is possible to reduce the manufacturing cost of the keyboard apparatus as compared to the foregoing example in which the rib is independently formed.

As shown in FIG. 38, when the key stopper portion 304*d* of the key 301 (corresponding to each of the white key 304 and the black key 305) comes in contact with the lower-limit stopper 399, a gap S is emerged between the side-edge face of the key stopper portion 304*d* and the rib 321. Therefore, even if the key 301 is depressed down to the lower-limit position as shown in FIG. 38 under the state where the lubricant 320 is flown over the upper face of the lower-limit stopper 399, there occurs almost no possibility in that the lubricant 320 exceeds over the rib 321*a* and flows over to the circuit board 311.

Further, the present example is designed such that the key stopper portion 304*d* does not come in contact with the rib

321*a*. Therefore, the rib 321*a* does not at all affect the key-depression stroke of the key 301 (i.e., rotation stroke of the key 301 which is limited by the lower-limit stopper 399).

[E] Fifth Embodiment

Next, the detailed description will be given with respect to a fifth embodiment of the present invention. This embodiment is characterized by the special-designed structure of the key switch which is applied to the keyboard apparatus according to the present invention.

In general, it is difficult to securely attach the key switch onto the circuit board. In some cases, hooking portions which are formed around the peripheral portion of the key switch are inserted into and snapped into holes of the circuit board, so that the key switch is securely fixed onto the circuit board. If the circuit board has a certain degree of hardness, such structure of the key switch may be effective for attaching the key switch on the circuit board. However, in the case of the flexible printed circuit board, such structure may not work well. On the other hand, the key switch can be directly attached to the circuit board by the adhesive agent. In this case, however, it is necessary to secure a certain size for the adhering area on the circuit board in order to obtain a sufficient adhering strength. This is a drawback because such adhering area restricts the shape and structure of the key switch and also reduces the freedom of degree in the operation of the key switch.

In order to cope with the above-mentioned circumstances, the present embodiment provides a brand-new structure for the key switch which can be easily applied to the keyboard apparatus according to the present invention.

Figure 39:
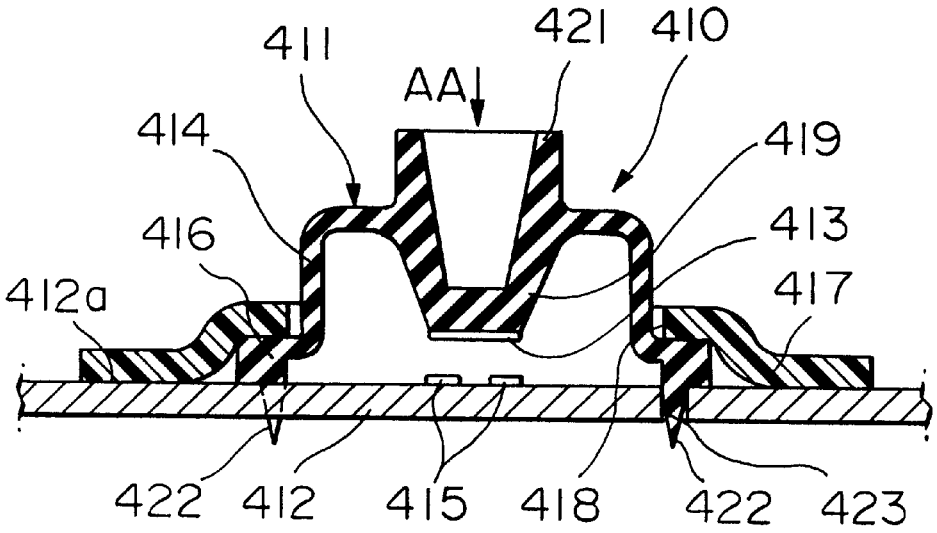
FIG. 39 is a sectional view illustrating a switch device which is employed as the key switch for the keyboard apparatus according to a fifth embodiment of the present invention.
Figure 40:
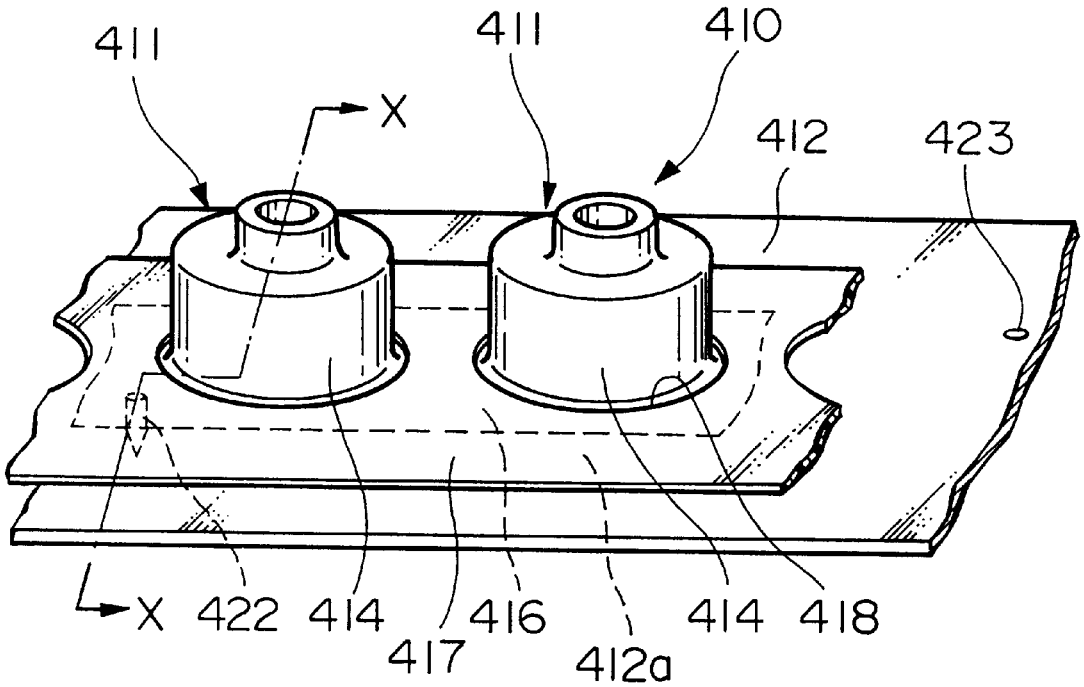
FIG. 40 is a perspective-side view illustrating one example of the switch device in which plural elastic swelling members are continuously located by a predetermined spacing.

FIG. 39 is a sectional view illustrating the mechanical structure of the key switch to be employed in the keyboard apparatus according to the fifth embodiment of the present invention, while FIG. 40 is a perspective-side view illustrating the key switch in which a pair of elastic projecting portions are formed. In short, the sectional view of FIG. 39 is obtained by cutting the key switch shown in FIG. 40 by a line X—X.

As shown in FIG. 39, a key switch 410 is mainly constructed by a base board 412 which functions as the base member for the key switch, a swelling portion 414 having a dome-like shape and an elastic swelling member 411. Fixed contact 415 is attached on the base board 412; a movable contact 413 corresponding to the fixed contact 415 is attached to an interior wall of the swelling portion 414; a pressed portion 416 is formed at the peripheral portion surrounding the elastic swelling member 411; and an opening hole 418 is formed through a presser member 417 having a sheet-like shape, so that the swelling portion 414 of the elastic swelling member 411 is inserted into and engaged with the opening hole 418 of the presser member 417.

As shown in FIG. 40, a plurality of elastic swelling members 411, of which number equals to six (corresponding to the half-octave section of the keyboard) or twelve (corresponding to the one-octave section of the keyboard), are linearly arranged by equal spacing, while lower-edge portions thereof are linked together by the pressed portion 416. These elastic swelling members 411 and the pressed portion 416 are formed as one unit.

The elastic swelling member 411 is formed by the flexible and elastic material such as the rubber. This elastic swelling member 411 provides the aforementioned swelling portion 414 having the dome-like shape, a cylindrical portion 419, an annulus ring portion 421 and the movable contact 413. The cylindrical portion 419 is projected downward from a center potion of the interior wall of the swelling portion 414; the annulus ring portion 421 stands at an opposite side of the cylindrical portion 419; the movable contact 413 is partially melted and attached to the lower-edge face of the cylindrical portion 419. This movable contact 413 having a disk-like shape is made by the conductive elastic material such as the conductive rubber. When the annulus ring portion 421 is depressed down by an external force applied thereto in a direction AA, the swelling portion 414 is partially deformed so that the movable contact 413 is moved down to be in touch with the fixed contact 415 attached on the base board 412.

The base board 412 is constructed by the printed circuit board of Bakelite or the flexible printed circuit board having a thin thickness. A pair of non-conductive elements each having a comb-like shape or a letter "E" like shape, and the periphery of them is surrounded by an approximately round element, thus forming the fixed contact 415. The fixed contact 415 is formed on the base board 412 by the carbon printing and the like at a predetermined position which corresponds to the movable contact 413 of the elastic swelling member 411.

As shown in FIG. 40, a positioning projection 422 is formed downward beneath the lower face of the pressed portion 416 at a position between the elastic swelling members 411 which are linearly arranged by the equal spacing. The number of the positioning projections 422 is determined such that a set of the elastic swelling members 411, which are continuously formed and linked together by the pressed portion 416, can be simultaneously and effectively fixed to the base board 412. For example, three or four positioning projections are provided for one key block. A plurality of positioning holes 423 are respectively formed through the base board 412 such that the projections 422 can fit with them respectively. By inserting the projections 422 into the holes 423, it is possible to accurately fix the positioning of the elastic swelling members 411. Thus, each of the movable contacts 413 can be located at an accurate position which faces with the fixed contact 415.

The aforementioned sheet-shaped presser member 417 is formed by the polyester film, for example. A plurality of opening holes 418 are formed through the presser member 417, so that each of the swelling portions 414 of the elastic swelling portions 411 can be smoothly inserted through each of the opening holes 418 of the presser member 417. When inserting the elastic swelling members 411 through the opening holes 418 of the presser member 417, the peripheral portion of the presser member 417 is located outside the edge portion of the pressed portion 416.

In order to securely fix the elastic swelling portions with the base board 412, after the projections 422 are respectively engaged with the holes 423 of the base board 412, the following steps are sequentially carried out. At first, the adhesive agent having a large adhesive strength is painted at a predetermined portion 412*a* of the base board 412 which is located outside the pressed portion 416; the presser member 417 covers the elastic swelling members 411 such that the swelling portions 414 are respectively inserted through the opening holes 418 of the presser member 417; and then, the presser member 417 is adhered to the base board 412 in such a manner that the pressed portion 416 linked with the elastic swelling members 411 is pressed by the presser member 417.

As described above, the pressed portion 416 linking the elastic swelling members 411 is securely fixed by the presser member 417. Thus, it is possible to establish an accurate positioning relationship among the elastic swelling members 411 on the base board 412.

Therefore, it is possible to easily attach the key switch 410 onto the circuit board by merely adhering the presser member 417 on the base board 412 while pressing the pressed portion 416 linking the elastic swelling members 411. In the conventional case where the elastic swelling member is directly adhered to the circuit board, the lower-face area of the elastic swelling member should be restricted such that the sufficient adhesive strength can be obtained. As compared to such case, the present embodiment is advantageous in that the shape of the elastic swelling member of the key switch 410 is not restricted by the above-mentioned factor. Thus, it is possible to improve the freedom of degree with respect to the design of the shape of the key switch.

In addition, due to the above-mentioned structure of the key switch, a certain layer caused by the adhesive agent is not at all existed between the upper face of the base board 412 and the lower face of the pressed portion 416.

In the aforementioned conventional case, the adhesive-agent layer must be formed between the lower face of the elastic swelling member and the upper face of the base board. Such adhesive-agent layer may be slightly altered in thickness by the amount of the adhesive agent or the adhesive pressure applied between the elastic swelling member and the base board.

A difference of the thickness of the adhesive-agent layer may cause the difference of the distance between the movable contact and the fixed contact. If so-called one-make contact is employed for the key switch, such difference may not affect the operation of the key switch. However, in the case of the so-called plural-make-contact-type touch-response switch, the above-mentioned small difference of the thickness affects the detection of the touch response. In other words, it may cause some deviation in the touch-response operations of the switches respectively used for the keys which are linearly disposed in the keyboard of the musical instrument. Or, it may cause another deviation in the touch-response operations among the musical instruments.

Figure 41:
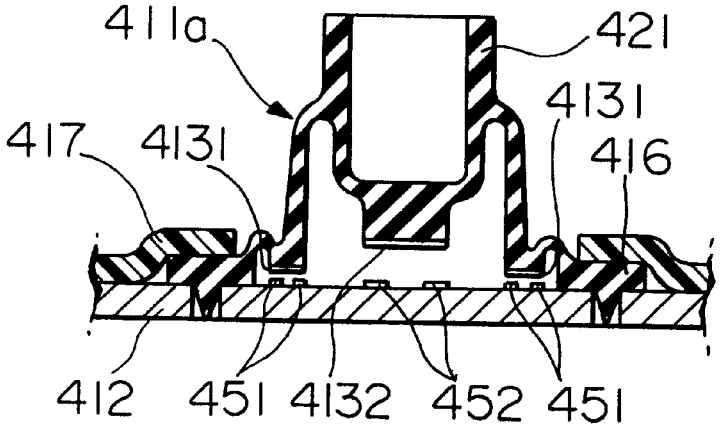
FIG. 41 is a sectional view illustrating another switch device which is made as a two-make-contact-type touch-response switch.

Due to the absence of the adhesive-agent layer in the present embodiment, even in the two-make-contact-type touch-response switch as shown in FIG. 41, there is no deviation of the touch-response operations among the keys or among the musical instruments. This touch-response switch shown in FIG. 41 provides a pair of a first movable contact 4131 and a first fixed contact 451 and another pair of a second movable contact 4132 and a second fixed contact 452. Thus, the present embodiment is advantageous in that the touch-response switch having a high precision can be embodied with a relatively low cost.

Incidentally, when adhering the presser member 417 onto the base board 412, the adhesive agent can be painted on a lower face of the presser member 417. Or, it is possible to attach a double side tape on either the presser member 417 or the base board 412. Or, it is possible to employ the other adhering technique.

Moreover, the adhesive agent can be painted on the upper portion of the pressed portion 416 of the elastic swelling member 411 or 411*a*. Similarly, when using the double side tape, the tape can be adhered to the upper portion of the pressed portion 416 of the elastic swelling member 411.

Figure 42:
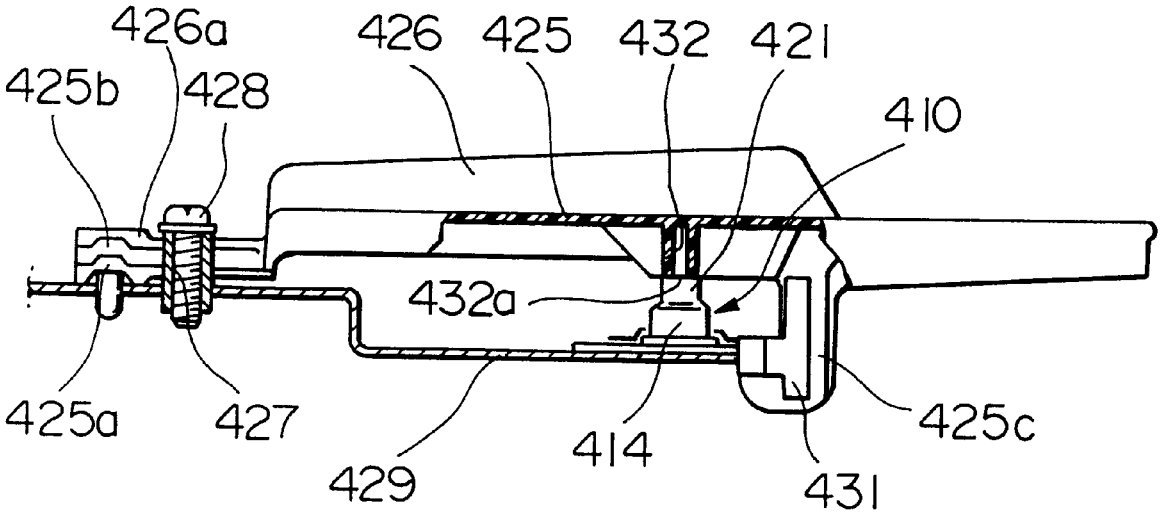
FIG. 42 is a sectional view illustrating an example of the keyboard apparatus in which the switch device is employed as the key switch.

FIG. 42 is a sectional view of the keyboard apparatus in which the above-mentioned switch device is assembled.

In FIG. 42, the key switch 410 is mounted on a main frame 429 at a position which corresponds to the white key 425 or a black key 426.

As similar to the foregoing embodiments, there are provided three common base-edge portions 425*a*, 425*b* and 426*a*. The common base-edge portion 426*a* corresponding to the black keys is piled on the common base-edge portions 425*a* and 425*b* respectively corresponding to the white keys.

Under the condition where three key blocks are piled up, a screw 428 is inserted into a screw hole 427 so as to tightly screw the key assembly with the main frame 429 made of a metal plate.

A pair of stopper elements 425*c* each having a letter "L" like shape are respectively projected downward from both-side walls of the white key 425. A key guide 431 is fixed to the main frame 429 in response to the stopper elements 425*c*. When the front portion of the white key 425 is elevated up and down, the interior walls of the stopper elements 425*c* are sliding along the side faces of the key guide 431, by which the lateral swinging movement of the white key 425 can be avoided.

The key switch 410 is fixed on a predetermined position of the main frame 429 in response to each of the white keys 425 and the black keys 426. An actuator 432 is projected downward from an lower face of the key such that the actuator can face with the key switch 410. When depressing the key, the actuator depressed down the upper portion of the key switch 410 so that the swelling portion 414 is elastically deformed. At this time, the movable contact 413 shown in FIG. 39 comes in contact with the fixed contact 415 so that the key switch 410 is turned on, resulting that the musical tone corresponding to the depressed key is produced.

Incidentally, a contact face 432*a* of the actuator 432 which comes in contact with the key switch 410 can be formed in a letter "H" like shape. In this case, it is possible to stabilize the depressing state between the actuator 432 and the annulus ring portion 421 of the key switch 410.

Figure 43:
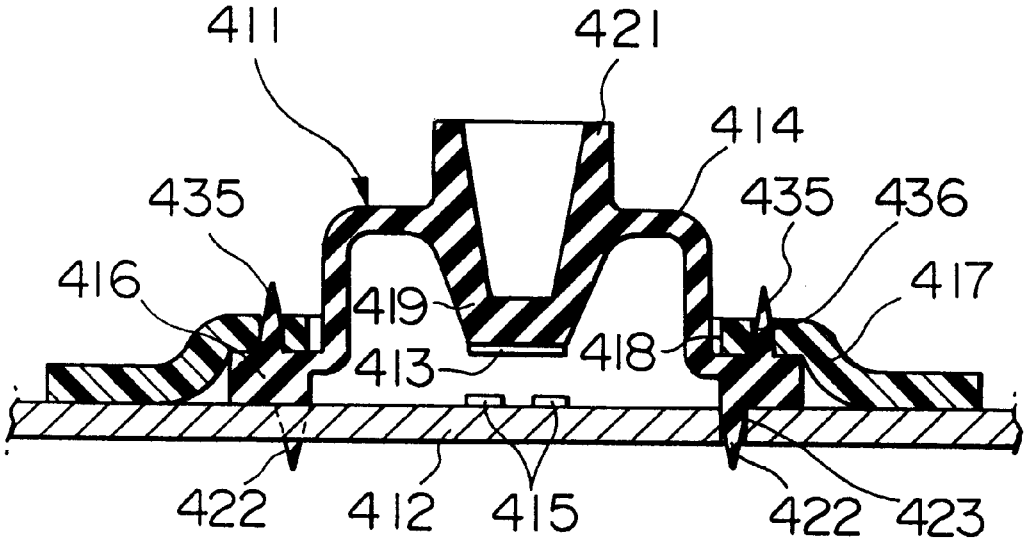
FIG. 43 is a sectional view illustrating another example of the switch device.

FIG. 43 shows another example of the key switch. This example is characterized by providing plural projections 435 which are formed on the pressed portion 416 of the elastic swelling member 411 in order to establish a positioning relationship between the elastic swelling member 411 and the presser member 417. For example, two projections 435 are formed on the pressed portion 416 of the elastic swelling member 411. Further, plural holes 436 are formed through the presser member 417 at certain positions respectively corresponding to the above-mentioned projections 435. The other parts of this example shown in FIG. 43 are similar to those of the foregoing embodiment shown in FIG. 41, hence, the detailed description thereof will be omitted.

According to this example, by inserting the projections 435 into the holes 436 respectively, it is possible to easily fix the position relationship between the elastic swelling member 411 and the presser member 417. Due to the above-mentioned fixing structure, the outside diameter of the opening hole 418 of the presser member 417 through which the swelling portion 414 of the elastic swelling member 411 is inserted can be relatively enlarged so as to easily cover the elastic swelling members 411 by the presser member 417. Even in this case, it is possible to accurately fix the position of the presser member 417 with respect to the elastic swelling members 411. In short, it is possible to improve the performance of the assembling operation.

Incidentally, the construction of the key switch 410 is not limited to that as shown in FIG. 40 wherein the elastic swelling members 411 are continuously located at adjacent positions. In other words, it is possible to modify the key switch such that one elastic swelling member is separately located from another elastic swelling member adjacent thereto. In this case, it is necessary to provide two or more projections 422 with respect to one elastic swelling member 411.

Figure 44:
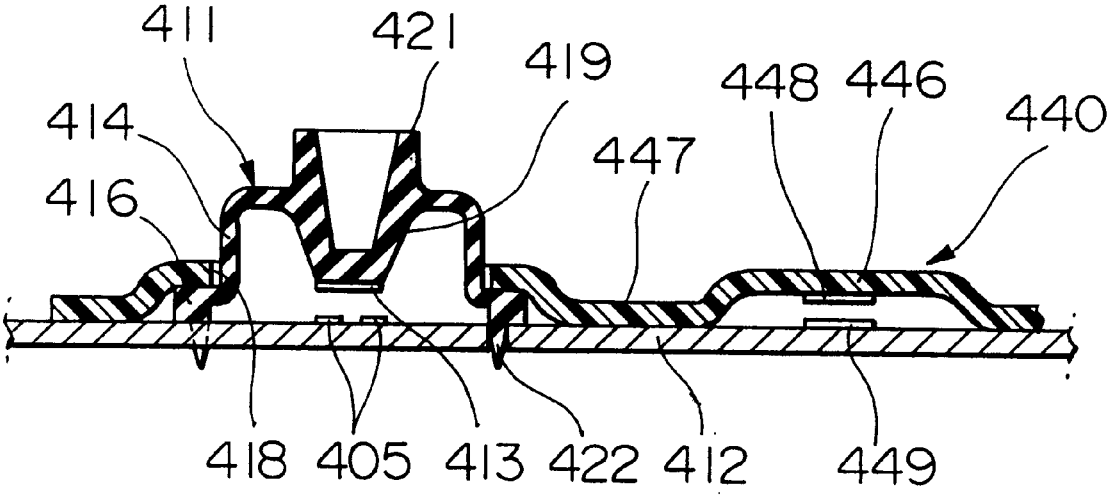
FIG. 44 is a sectional view illustrating a still another example of the switch device.

FIG. 44 is a sectional view illustrating another switch device which provides a switch having the elastic swelling member and another membrane switch, wherein parts identical to those shown in FIG. 39 are designated by the same numerals.

In this switch device, a presser member 447 made by a polyester film having a sheet-like shape is employed instead of the foregoing presser member 417 shown in FIG. 39. The size of the presser member 447 is larger than that of the foregoing presser member 417. A contraction portion 446 is formed in the presser member 447 at a position which departs from the position of the elastic swelling member 411 by a predetermined distance. This contraction portion 446 has a predetermined depth. Such contraction portion 446 can be formed by use of a metal mold. An upper contact 448 is attached on an interior face of the contraction portion 446, while a lower contact 449 is located on the base board 412 to face with the upper contact 448. Thus, a membrane switch 440 is constructed by the contacts 448, 449 and the contraction portion 446.

Each of the upper contact 448 and the lower contact 449 is formed as a metallic pattern made by a predetermined material such as the copper (Cu) or silver (Ag) to which the carbon is coated. In the normal state, both of the contacts 448 and 449 are located apart from each other. When the contraction portion 446 is depressed down, these contacts 448 and 449 come in contact with each other so that the membrane switch 440 is turned on.

In the present switch device as shown in FIG. 44, it is possible to simultaneously form two kinds of switches containing the membrane switch 440. When employing this switch device as the key switch for the electronic musical instrument, it is possible to further reduce the manufacturing cost of the instrument as a whole. Further, it is possible to reduce the size of the switches employed for the electronic musical instrument.

This type of the switch device can be used for tone-color switches, sound-effect switches or other press-button switches (e.g., part-selector switches), other than the key switches used for the keyboard apparatus of the electronic musical instrument. Or, it is possible to use this switch device for the other audio devices as the press-button switches.

[F] Sixth Embodiment

Finally, a sixth embodiment of the present invention will be described by referring to FIGS. 45 and 46. This embodiment is characterized by reducing the thickness of the keyboard apparatus. In general, a certain vertical length between the upper face of the key and the upper face of the key frame should be secured in order to avoid the lateral swinging movement of the key when the key is depressed down. By reducing the vertical length of the key frame, it is possible to reduce the thickness of the keyboard. However, such reduction of the vertical length of the key frame may function to also reduce the stability of the motion of the key in the lateral direction. Thus, the conventional keyboard apparatus suffers from the relatively large thickness of the keyboard apparatus at its front portion.

In order to reduce the thickness of the keyboard apparatus at its front portion, the present embodiment is invented.

Figure 45:
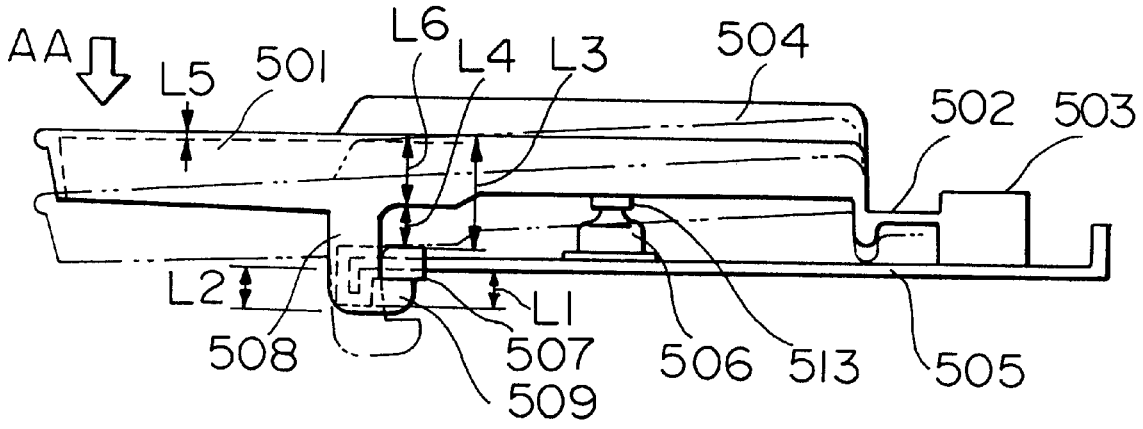
FIG. 45 is a side view illustrating an keyboard assembly according to a sixth embodiment of the present invention.

FIG. 45 is a side view illustrating the mechanical structure of the keyboard apparatus according to the sixth embodiment of the present invention. In FIG. 45, a white key 501 is connected to a connecting portion 503 by means of a hinge portion 502. A black key 504 is also connected to the connecting portion 503. A key frame 505 is securely fixed with the main body of the musical instrument (not shown). The key 501 can be swung up and down about the hinge portion 502. The key frames each corresponding to each of the keys are disposed in parallel beneath a line of the keys. On each of the key frame 505, a key switch 506 made of the elastic material is mounted on the key frame 505 to be related to each of the keys. An actuator 513 is attached to a lower face of the key 501. This actuator 513 is located such that when the key is depressed down, the key switch 506 is driven by the actuator 513.

At a front-edge portion of the key frame 505, a key guide 507 is attached, wherein this key guide is made of the polyurethane foam or other plastic materials. The key guide 507 is partially bent downward from the key frame 505.

Figure 46:
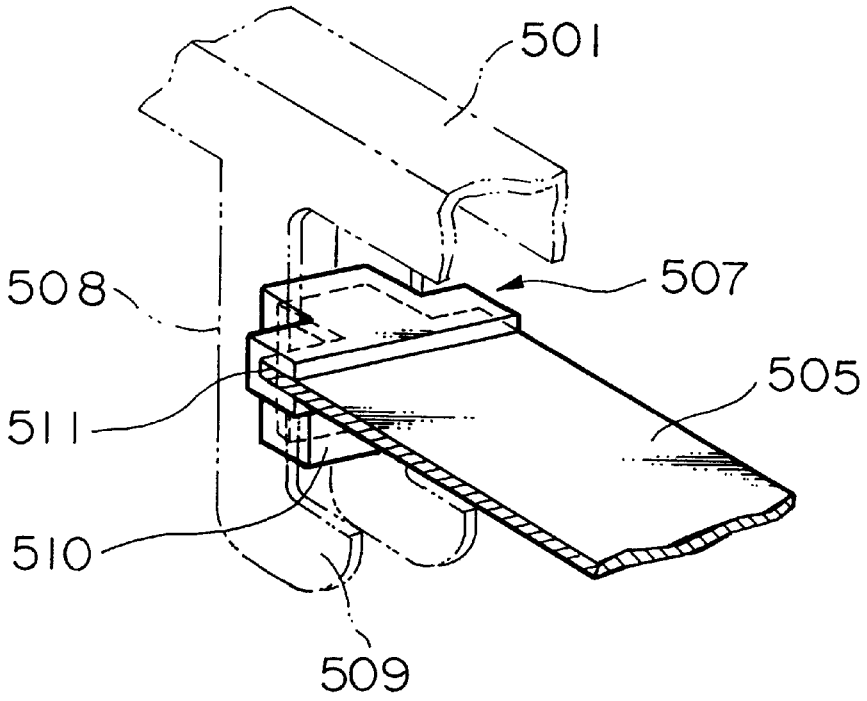
FIG. 46 is a perspective-side view illustrating a main part of said keyboard assembly according to the sixth embodiment.

FIG. 46 is a perspective-side view illustrating an example of the key guide 507. The key guide 507 is mainly constructed by a guide portion 510 and a stopper element 511. The guide portion 510 projects downward from the key frame 505, while the stopper element 511 is projected in both-side directions of the key frame 505. Side walls of the guide portion 510 are made as the guide faces along which the key 501 is elevated up and down. The guide faces are provided to avoid the lateral swinging movement of the key 501. A pair of guided portions 508 are projected downward from the key 501 such that the guide portion 510 is sandwiched by them. Stopper portions 509 each having a hook-like shape are projected from lower-edge portions of the guided portions 508 in a longitudinal direction of the key 501. When the key 501 is returned from a key-depressed position, the stopper portions 509 come in contact with a lower face of the stopper element 511 of the key guide 507 so that an elevating motion of the key 501 is stopped. In other words, both of the stopper portions 509 and the stopper element 511 are designed to form an upper-limit stopper.

The lower-limit position which is related to the lower-limit stopper can be determined responsive to the location of the key at a timing when the key switch 506 is depressed and deformed by the actuator 513. Or, it is possible to further provide a convex portion below the lower face of the hinge portion 502 as a part of the lower-limit stopper. In this case, the lower-limit position is determined when the convex portion comes in contact with the key frame 505 or with the upper face of the stopper element 511 of the key guide 507.

In FIG. 46, the upper-limit stopper 509 is formed as a part of the lower-edge portion of the guided portion 508. However, it is possible to form the upper-limit stopper independent of the guided portion 508 and locate it at another position. Or, the lower-limit stopper can be omitted, so that the function of the lower-limit stopper is satisfied by contacting the lower face of the key 501 with the upper face of the key guide 507. In this case, a felt cloth can be attached on the upper face of the key guide 507.

In the key-depressing operation (see an arrow AA in FIG. 45), the key 501 is rotated about the hinge portion 502 and swung down by a predetermined stroke as shown by a dashed line in FIG. 45. During the key-depressing operation, the guided portions 508 of the key 501 are moved down while sliding with both-side faces (i.e., guide faces) of the guide portion 510 of the key guide 507 which is located at the front-edge portion of the key frame 505. Thus, it is possible to avoid the lateral swinging movement or twisting movement of the key 501 which may be occurred in connection with the swing-down motion of the key 501. According to the present embodiment, the key guide 507 which is located at the tip-edge portion of the key frame 505 is formed in such a manner that the main part of the key guide 507 directs in a downward direction from the key frame 505. In addition, a projecting length of the key guide 507 is set identical to the length of the lower-edge portion of the guided portion 508 which is located beneath the key frame 505 when the key 501 is not depressed. Thus, it is possible to reduce the distance between the upper face of the key 501 and the key frame 505. The reason why such reduction in distance can be made by the present embodiment will be described below.

Since the key-depression stroke must be provided for the key 501, if the key guide 507 is projected upward from the key frame 505, a distance L3 (see FIG. 45) must require at least a sum of the key-depression stroke and the upward projecting length. If the present embodiment is designed such that a distance L1 is approximately equal to a distance L2, it can be theoretically understood that the distance L3 may be reduced to at least a sum of a stroke length L4 and a thickness L5 of the upper wall of the key 501. Actually, however, only the small thickness L5 of the upper wall of the key 501 can not resist the key-depressing pressure well. For this reason, in order to reinforce the key 501, side walls are provided for the key 501. Therefore, the distance L3 is equal to a sum of the stroke length L4 and a side length L6 of the key 501. In other words, if the side length L6 of the key 501 can be reduced to a small length by which the key 501 can also resist the key-depressing pressure, the distance L3 can also be reduced. As a result, the keyboard instrument according to the present embodiment can be manufactured with a relatively small thickness.

Incidentally, the guide portion 510 of the key guide 507 can be partially projected above the key frame 505, while the downward projecting length thereof is reduced.

Lastly, this invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

What is claimed is:

1. An keyboard assembly for an electronic musical instrument comprising:

a key frame:

a key including a fixing portion supported by said key frame such that a front portion of said key is freely rotatable;

an actuator attached to a lower side of said key;

a key-depression sensor having an elastic projecting portion, said key-depression sensor being provided on or above said key frame and driven by said actuator, said actuator depressing said elastic projecting portion when said key is depressed down; and guide means for guiding said key, said key being guided by said guide means in such a manner that said actuator does not contact said key-depression sensor during an assembling operation.

2. A keyboard assembly for an electronic musical instrument comprising:

a key frame;

a key of which fixing portion is supported by said key frame such that a front portion of said key can be freely rotated up and down;

an actuator which is attached to a lower side of said key;

a key-depression sensor having an elastic projecting portion, said key-depression sensor being attached on said key frame and being driven by said actuator when said key is depressed down so that said actuator depresses down said elastic projecting portion;

a guide member which is provided at a predetermined position of said key frame; and a contact avoiding means which is provided at the lower side of said key, said contact avoiding means sliding along said guide member while an assembling operation is carried out so that said key and said key frame are assembled together, said actuator being controlled not to come in contact with said key-depression sensor during said assembling operation by a sliding operation performed between said guide member and said contact avoiding means.

3. A keyboard assembly for an electronic musical instrument comprising:

a key frame;

a key of which fixing portion is supported by said key frame such that a front portion of said key can be freely rotated up and down;

an actuator which is attached to a lower side of said key;

a key-depression sensor having an elastic projecting portion, said key-depression sensor being attached onto said key frame and being driven by said actuator when said key is depressed down so that said actuator depresses down said elastic projecting portion; and an assembly guide means which is attached to and projected downward from the lower side of said key, said assembling guide means guiding said key just before an assembling operation for assembling said key and said key frame together is completed in such a manner that a lateral movement of said actuator is regulated with respect to said key-depression sensor, so that said key is guided in its longitudinal direction when assembling said key to said key frame, said assembly guide means providing a taper portion by which while said key is guided by said assembly guide means, a predetermined position relationship is established between said actuator and said key-depression sensor.

4. A keyboard assembly for an electronic musical instrument according to claim 1, wherein said guide means includes:

an assembly guide member provided on said key frame for guiding said key during the assembling operation such that the fixing portion of said key is guided to a predetermined position and then said actuator contacts an upper face of said key-depression sensor.

5. A keyboard assembly for an electronic musical instrument according to claim 1, wherein said guide means includes:

a guided portion formed at the fixing portion of said key; and an assembly guide member operatively connectible with said guided portion for guiding said key when assembling said key and said key frame such that the fixing portion of said key is guided to a predetermined position and then said actuator contacts an upper face of said key-depression sensor.

6. A keyboard assembly for an electronic musical instrument as defined in claim 5 wherein said assembly guide member comprises a projecting member projecting from said key frame, a height of said projecting member being determined such that at least one of just before and just after said projecting member engages said guided portion of said key, said actuator is located above and apart from said key-depression sensor.

7. A keyboard assembly for an electronic musical instrument as defined in claim 5 wherein said assembly guide member has a projection-like shape which projects upward from said key frame, said guiding member supporting an upper case portion of a main body of said electronic musical instrument.

8. A keyboard assembly for an electronic musical instrument comprising:

a key frame;

a key including a fixing portion supported by said key frame such that a front portion of said key can be freely rotated up and down;

a key-depression sensor which detects a key-depressing operation of said key;

a first fixing structure including a projecting member and a concave portion, said projecting member projecting upward from one of a fixing portion of said key frame and the fixing portion of said key, while said concave portion is formed at the other of said fixing portion of said key frame and the fixing portion of said key, said concave portion engaging said projecting member when said key and said key frame are assembled together; and a second fixing structure for coupling said key and said key frame together, said second fixing structure regulating a motion of said key in at least an longitudinal direction of said key.

9. A keyboard assembly for an electronic musical instrument according to claim 8, wherein said second fixing structure includes:

a standing portion formed at a fixing portion of said key frame;

an elastic element attached to said fixing portion of said key and flexible in a longitudinal direction of said key;

said first fixing structure further including a temporary stopper element projecting upward from one of the fixing portion of said key frame and the fixing portion of said key; and wherein said elastic element is disposed between said standing portion and said temporary stopper element when said key and said key frame are assembled together.

10. A keyboard assembly for an electronic musical instrument comprising:

a plurality of key units each providing a predetermined number of keys at a common base-edge portion, said plurality of key units being piled up and assembled together at respective common base-edge portions, wherein a fixing portion of each key is supported by the common base-edge portion of each key unit such that a front portion of each key can be freely rotated up and down;

a projecting member formed at the common base-edge portion of one key unit;

a concave portion formed at the common base-edge portion of another key unit; and a predetermined number of projections disposed at one of an exterior wall of said projecting member and an interior wall of said concave portion, wherein said projecting member of said one key unit is engaged with said concave portion of said another key unit, while said projections are pressed by one of said exterior wall and said interior wall so that two key units are tightly assembled together.

11. A keyboard assembly for an electronic musical instrument comprising:

a key frame;

a key of which fixing portion is supported by said key frame such that a front portion of said key can be freely swung up and down;

a key guide which is attached to a front portion of said key frame so as to guide said key in a key-depression/release direction, said key guide provides guide faces along which said key is guided, while a lubricant is painted on said guide faces so that a key-depressing motion can be smoothly performed;

a circuit board which is located between said key and said key frame;

a key-depression sensor which is mounted on said circuit board at a position to face with a lower face of said key, said key-depression sensor sensing a key-depressing operation of said key when said key is depressed down; and a rib which is planted at a position between a front-edge portion of said circuit board and said key guide, said rib functioning to prevent said lubricant from being flown over to said circuit board.

12. A switch device which is applied to a keyboard apparatus of an electronic musical instrument as a key switch, said switch device comprising:

a base board on which a fixed contact is provided;

an elastic swelling member providing a swelling portion and a pressed portion, said swelling portion containing a movable contact within an interior portion thereof so that said movable contact is located to face with said fixed contact, said pressed portion being formed at a periphery of said elastic swelling member; and a presser member having a sheet-like shape, said presser member providing an opening hole through which said swelling portion of said elastic swelling member is inserted, whereby said presser member is adhered to said base board under a state where said pressed portion of said elastic swelling member is pressed down by said presser member, resulting that said elastic swelling member is securely fixed to said base board.

13. A keyboard assembly for an electronic musical instrument comprising:

a key frame which is securely fixed to a main body of the electronic musical instrument;

a key of which fixing portion is supported by said key frame so that a front portion of said key can be freely swung up and down;

a key guide which is fixed to said key frame, said key guide providing at lease one guide face along which said key is guided when said key is swung up and down; and at least one guided member which is formed as a part of said key, said guided member being projected downward from a lower side of said key so that said key is swung up and down while said guided member is slid along said guide face of said key guide, whereby said key guide is projected downward from said key frame, whereas a lower-edge position of said key guide is roughly set identical to a lower-edge position of said guided member in a condition where said key is not swung up or down.

14. A keyboard assembly for an electronic musical instrument according to claim 4, wherein said fixing portion includes a guided portion and a hole, the guided portion being guided by the guide member during the assembly operation, and the guide member passing into said hole during the assembling operation.

15. A keyboard assembly for an electronic musical instrument according to claim 5, wherein said fixing portion has a hole formed next to the guided portion, and the guide member passing through the hole during the assembling operation.

* * * * *